US012758816B2

(12) United States Patent
Whalen et al.

(10) Patent No.: US 12,758,816 B2
(45) Date of Patent: Oct. 13, 2026

(54) HEIGHT-ADJUSTABLE SEAL FRAME STRUCTURE FOR DAP EXERCISE SYSTEM

(71) Applicants: Boost Treadmills, LLC, Palo Alto, CA (US); Robert Tremaine Whalen, Los Altos, CA (US)

(72) Inventors: Sean Tremaine Whalen, Mountain View, CA (US); Thomas Jack Waldo Allen, Palo Alto, CA (US); Robert Tremaine Whalen, Los Altos, CA (US); Gunnar Manglus, Uniküla (EE); Kristjan Tiimus, Tabasalu (EE); Mart Seger, Tallinn (EE)

(73) Assignee: BOOST TREADMILLS, LLC, Palo Alto, CA (US)

( * ) Notice: Subject to any disclaimer, the term of this patent is extended or adjusted under 35 U.S.C. 154(b) by 0 days.

(21) Appl. No.: 17/965,517

(22) Filed: Oct. 13, 2022

(65) Prior Publication Data

US 2023/0109901 A1 Apr. 13, 2023

Related U.S. Application Data

(60) Provisional application No. 63/254,972, filed on Oct. 12, 2021, provisional application No. 63/254,969, filed on Oct. 12, 2021.

(51) Int. Cl.
*A63B 21/00* (2006.01)

(52) U.S. Cl.
CPC .... *A63B 21/4033* (2015.10); *A63B 2208/053* (2013.01); *A63B 2225/093* (2013.01); *A63B 2225/62* (2013.01)

(58) Field of Classification Search
None
See application file for complete search history.

(56) References Cited

U.S. PATENT DOCUMENTS

| | | | |
|---|---|---|---|
| 1,152,014 | A | 8/1915 | Farkell |
| 1,182,018 | A | 5/1916 | Koenig |
| 1,336,774 | A | 4/1920 | Cooper |
| 2,262,019 | A | 11/1941 | Lincoln |
| 2,785,004 | A | 3/1957 | Leon |

(Continued)

FOREIGN PATENT DOCUMENTS

WO WO-2015195983 A1 * 12/2015 ..... A61G 10/02

*Primary Examiner* — Nyca T Nguyen
(74) *Attorney, Agent, or Firm* — Kevin Paganini, Esq.

(57) ABSTRACT

A height-adjustable seal frame structure for a DAP exercise system has a seal frame, opposing lateral vertical lifts, and opposing lateral tensile restraints. The seal frame defines opposing lateral side restraint connectors and can be attached to an inflatable enclosure top portion about a user port. The vertical lifts can be attached at lateral sides of the system and a longitudinal position proximate the user port for vertically driving a carriage to adjust height. The first end of each tensile restraint can securely attach to a lift carriage connector and the second end can securely attach to the corresponding restraint connector at a restraint length therebetween. In use, the seal frame can be retained in a floating arrangement forced upward solely by the enclosure top portion and restrained downward against the upward force at a seal frame height by the tensile restraints. Quick disconnects can permit manual seal frame release.

20 Claims, 62 Drawing Sheets

(56) References Cited

U.S. PATENT DOCUMENTS 3,165,314 A 1/1965 Clearman
3,176,793 A 4/1965 Hlacia
3,192,014 A 6/1965 Leyshon
3,332,176 A 7/1967 Knetzer
3,428,015 A 2/1969 Cloud
3,768,467 A 10/1973 Jennings
3,911,913 A 10/1975 June
4,149,712 A 4/1979 Murphy
4,257,407 A 3/1981 Macchi
4,343,302 A 8/1982 Dillon
4,411,422 A 10/1983 Solloway
4,509,513 A 4/1985 Lasley
4,536,163 A 8/1985 Schnirch et al.
4,576,376 A 3/1986 Miller
4,614,337 A 9/1986 Schonenberger
5,133,339 A * 7/1992 Whalen ..... A63B 21/00181 482/52
5,174,590 A * 12/1992 Kerley ..... A61H 3/04 280/87.051
5,176,597 A * 1/1993 Bryne ..... A61H 3/008 482/54
5,221,241 A * 6/1993 Bare, II ..... A63B 69/0064 482/43
6,120,418 A * 9/2000 Plough ..... A63B 21/4009 482/121
6,170,840 B1 * 1/2001 Mathias ..... A63B 69/0064 280/87.051
6,742,523 B2 * 6/2004 Dubats ..... A61H 3/008 482/68
6,932,709 B1 * 8/2005 Gubitosi ..... A47D 13/101 297/274
7,141,007 B2 11/2006 Egger
7,166,064 B2 1/2007 Watterson et al.
7,556,040 B2 7/2009 Meyer et al.
7,591,795 B2 9/2009 Whalen
7,594,281 B1 9/2009 Stinson et al.
7,762,930 B2 7/2010 Egger
7,780,587 B2 8/2010 Thornton et al.
7,785,242 B2 8/2010 Solomon
7,837,597 B2 11/2010 Reves et al.
7,850,629 B2 12/2010 Ravikumar
7,857,731 B2 12/2010 Hickman et al.
7,862,478 B2 1/2011 Watterson et al.
7,914,420 B2 3/2011 Daly et al.
8,235,724 B2 8/2012 Gilley et al.
8,447,401 B2 5/2013 Miesel et al.
8,464,716 B2 * 6/2013 Kuehne ..... A63B 21/068 601/19
8,480,602 B1 7/2013 Cook
8,639,455 B2 1/2014 Horst et al.
8,679,040 B2 3/2014 Horst
8,840,572 B2 9/2014 Whalen et al.
8,900,074 B1 12/2014 Johnson et al.
8,900,098 B2 12/2014 Egan
8,968,163 B1 3/2015 Vidmar
9,272,175 B2 * 3/2016 Egan ..... A63B 21/00181
9,370,680 B1 * 6/2016 Macaulay ..... A63B 71/023
9,554,964 B1 1/2017 Johnson et al.
9,561,149 B2 2/2017 Johnson et al.
9,642,764 B2 5/2017 Kuehne et al.
9,914,003 B2 3/2018 Kuehne et al.
10,004,656 B2 * 6/2018 Whalen ..... A63B 22/02
10,130,554 B2 11/2018 Aronson
10,132,011 B2 11/2018 Malina et al.
10,179,078 B2 1/2019 Bhugra et al.
10,265,565 B2 * 4/2019 Jue ..... A63B 69/0064
10,307,653 B2 * 6/2019 Ebsen ..... A63B 69/0064
10,345,791 B2 7/2019 Basta et al.
10,398,619 B2 * 9/2019 Crombie ..... A63B 21/068
10,427,293 B2 10/2019 Asbeck et al.
10,493,309 B2 * 12/2019 Jue ..... A63B 21/00069
10,533,913 B2 1/2020 Lee et al.
10,596,365 B2 3/2020 Hyde et al.
10,709,926 B2 7/2020 Baverlein et al.
10,773,121 B2 9/2020 Del Monaco et al.
10,816,177 B1 10/2020 Baverlein et al.
10,843,036 B2 * 11/2020 Bayerlein ..... A63B 22/025
10,905,914 B2 2/2021 Baverlein et al.
10,918,926 B2 2/2021 Pennington
11,097,175 B2 * 8/2021 Rodriguez ..... A63B 69/0064
11,517,781 B1 * 12/2022 Whalen ..... A61G 10/023
11,752,858 B2 9/2023 Sasaki et al.
11,806,564 B2 11/2023 Basta et al.
2002/0022554 A1 2/2002 Borsheim
2002/0025889 A1 2/2002 Egger
2002/0065173 A1 5/2002 Cook
2003/0046113 A1 3/2003 Johnson et al.
2003/0153438 A1 8/2003 Gordon
2004/0016043 A1 1/2004 Uno et al.
2004/0019304 A1 1/2004 West
2004/0249675 A1 12/2004 Stark et al.
2004/0259689 A1 12/2004 Wilkins
2005/0239613 A1 10/2005 Colombo et al.
2006/0052728 A1 3/2006 Kerrigan
2006/0240947 A1 10/2006 Qu
2008/0070757 A1 3/2008 Albert
2009/0047644 A1 2/2009 Mensah et al.
2009/0082700 A1 3/2009 Whalen et al.
2010/0000547 A1 1/2010 Johnson et al.
2010/0006737 A1 1/2010 Colombo et al.
2010/0170546 A1 * 7/2010 Popovic ..... A61H 3/008 135/67
2011/0098615 A1 4/2011 Whalen et al.
2011/0120567 A1 5/2011 Kuehne et al.
2011/0312473 A1 12/2011 Chu
2012/0029666 A1 2/2012 Crowley et al.
2012/0238921 A1 * 9/2012 Kuehne ..... A63B 71/0009 601/5
2012/0277643 A1 11/2012 Whalen et al.
2012/0302301 A1 11/2012 Homsi
2013/0117908 A1 5/2013 Dyson
2013/0325491 A1 12/2013 Ferrari
2014/0026893 A1 1/2014 Johnson et al.
2014/0058312 A1 2/2014 Ziehler et al.
2014/0113775 A1 4/2014 Egan
2014/0194252 A1 * 7/2014 Arimoto ..... A63B 23/04 482/51
2015/0011917 A1 1/2015 Whalen et al.
2016/0242993 A1 8/2016 Whalen et al.
2017/0014295 A1 1/2017 Whalen et al.
2017/0128769 A1 * 5/2017 Long ..... H04L 67/10
2017/0367916 A1 12/2017 Kuehne
2019/0046828 A1 2/2019 Kuehne et al.
2019/0099315 A1 * 4/2019 Kuehne ..... A63B 69/0064
2019/0099320 A1 4/2019 Whalen et al.
2019/0392939 A1 * 12/2019 Basta ..... G16H 20/30
2020/0221975 A1 * 7/2020 Basta ..... A61B 5/112
2021/0187348 A1 * 6/2021 Phillips ..... A63B 22/025
2021/0196552 A1 7/2021 Whalen et al.
2021/0205165 A1 7/2021 Kuehne et al.
2021/0251841 A1 8/2021 Whalen et al.
2021/0267833 A1 9/2021 Kuehne
2022/0054893 A1 2/2022 Basta et al.
2022/0059198 A1 2/2022 Basta et al.
2022/0288439 A1 * 9/2022 Whalen ..... A63B 21/00181
2022/0401782 A1 12/2022 Whalen
2023/0058141 A1 2/2023 Long et al.
2023/0109901 A1 4/2023 Whalen
2023/0263695 A1 8/2023 Whalen et al.

* cited by examiner

FIG. 17A
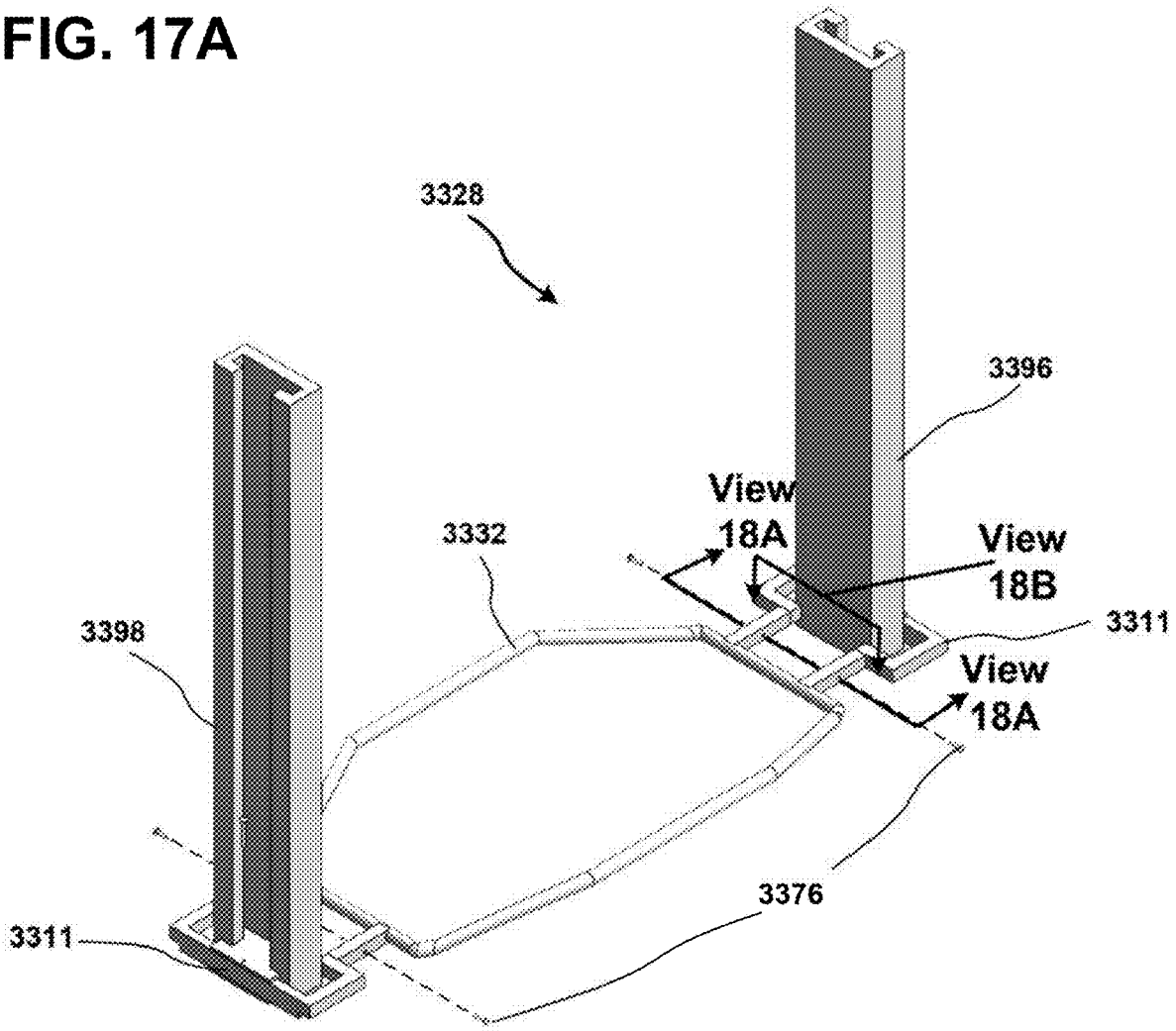
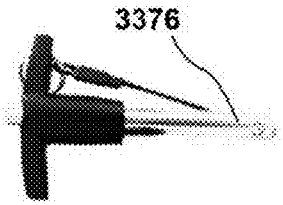
FIG. 17B
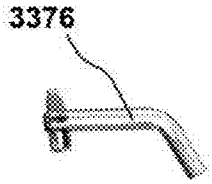
FIG. 17C
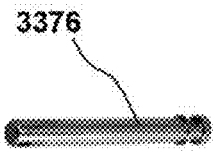
FIG. 17D

HEIGHT-ADJUSTABLE SEAL FRAME STRUCTURE FOR DAP EXERCISE SYSTEM

CROSS-REFERENCES TO RELATED APPLICATIONS

This application is related to copending U.S. patent application Ser. No. 17/351,236 filed on Jun. 18, 2021, entitled "Unweighting Exercise Equipment", which is a continuation of U.S. patent application Ser. No. 16/016,340 filed on Jun. 22, 2018, entitled "Unweighting Exercise Equipment", which claims priority to U.S. provisional patent application No. 62/523,363 filed on Jun. 22, 2017.

This application is also related to U.S. nonprovisional patent application Ser. No. 17/688,890 filed on Mar. 7, 2022, entitled "DAP System Adjustments Via Flexible Restraints and Related Devices, Systems and Methods," which claims priority to U.S. provisional patent No. 63/159,697 filed Mar. 6, 2021, entitled, "DAP System Adjustments Via Flexible Restraints and Related Devices, Systems and Methods." This application is further related to U.S. nonprovisional patent application Ser. No. 17/540,225, filed on Dec. 1, 2021, entitled "Unweighting Enclosure, System and Method for an Exercise Device."

Further, this application is related to the following U.S. nonprovisional patent applications filed on even date herewith identified by title and docket no. including the following:

- Ser. No. 17/964,849 entitled "DAP Platform, Integrated Lifts, System and Related Devices and Methods;" and
- Ser. No. 17/964,851 entitled "DAP System Control and Related Devices and Methods."

In addition, this application is related to the following U.S. provisional patent applications:

- U.S. app. No. 63/254,969 filed on Oct. 12, 2021, entitled "DAP System, Platform, Integrated Lifts and Related Devices and Methods";
- U.S. app. No. 63/254,972 filed on Oct. 12, 2021, entitled "DAP System, Enclosure, Seal Frame and Related Devices and Methods"; and
- U.S. app. No. 63/255,001 filed on Oct. 12, 2021, entitled "DAP System, Enclosure, Controls and Related Devices and Methods".

Each of the above applications is hereby specifically incorporated by reference in its entirety.

BACKGROUND

Aspects, features, and concepts described herein relate to supplemental equipment for exercise and rehabilitation devices, and particularly to equipment known as unweighting, antigravity, or differential air pressure (DAP) enclosures, systems and related methods for exercise or rehabilitation devices. More particularly, the subject matter described herein relates to height-adjustable seal frame structures and related devices, systems and methods that can be integrated with, or integrated as components of, or used with a differential air pressure (DAP) system.

Systems for unweighting individuals for rehabilitation and fitness training have been a popular modality. Traditional methods have included aquatic training and using a hoist to lift a person or animal off a walking surface. Harness and hoist systems provide benefits related to their historical use in that they are well-known and can also allow for precise and granular unweighting, but become significantly uncomfortable at off-loading greater than about 25% of normal body weight. Further, aquatic systems can be difficult to control in terms of degree of off-loading, and are cumbersome to use along with having large space and resource requirements.

Systems that create a pressure differential can vary pressure differentials more precisely and are easier to use allowing for a wide range of unloading in small steps. One benefit of this is in the case of rehabilitation, for which it has been shown that increments as small as 1% of normal body weight can effectively determine and bypass a pain threshold below which a user can exercise pain free. More recently, systems creating a pressure differential across a portion of a user have been developed and are generally in commercial use in the rehabilitation and training centers around the world. These systems apply a pressure difference at a portion of the user's body with a net force at the center of pressure. If the net pressure differential is oriented parallel with the force of gravity and located near the user's waist, this off-loading force acts approximately directly counter to the force of gravity and therefore minimally alters the users natural gait patterns.

DAP systems have been commercialized by companies like Showa Denki in Japan, Sasta Fitness of the UK, Vacuwell of Poland, and AlterG Inc. in the US. While these systems offer benefits, they are expensive, large, non-adjustable, require specialized power sources, or are generally limited in access to the market because of the high cost and space burden, or general discomfort in design for users of different body types or heights.

Conventional DAP systems rely on the use of a shell placed around an existing treadmill or similar exercise device. A completely separate chamber is formed that encompasses a base portion of the exercise equipment including the running belt/rollers/deck of a treadmill or the seat and pedals of a stationary bicycle placed inside. These structures duplicate the framing of the combined system and therefore increase the cost, size, shipping bulk, part count, and overall complexity of the system. Further, such conventional DAP systems limit user adjustment of the corresponding exercise device including modifying incline or tilt settings, which impact the pressure differential of conventional DAP systems.

In addition, conventional DAP systems develop substantially vertical and lateral forces in the thousands of pounds in the DAP chamber during use due to conventional unweighting designs exposing large surface areas to unweighting pressures. These systems include supplemental reinforcements and structural additions for the corresponding exercise equipment, which typically is not designed to accommodate such extreme external loading. The elevated forces developed by such conventional systems include outboard expansion forces exerting lateral forces and upward/downward expansion forces applying vertical loads against nearby components of the exercise equipment or applying torque to the framing that can impact lifetime and function of the exercise equipment. Further, even though safety mechanisms and system can reduce and mitigate risks of failure and user injury in conventional DAP systems within low probability ranges, the extreme forces involved, and potential harms inflicted in the event of failure nonetheless amount to significant design risk.

Height adjustment and modification mechanisms for conventional DAP systems operate by cumbersome adjustments of the corresponding frame structures, reinforcements and structural additions, which can further concentrate the high forces of conventional systems and direct forces toward weakened locations, which can pose increased risks for the user. In view of the high forces involved, many conventional DAP systems are unable to modify or fine-tune height settings. Conventional DAP systems that provide height adjustability involve complex, geared high torque drive mechanisms for driving height adjustments and have fixed connections between height adjustable frame members and the seal frame, in which the user is unable to manually disconnect or change a height of the seal frame in the event of power loss during use. As such, a user is required to physically climb out of the seal frame at the usage height to exit the DAP system in the event of power loss during use. In addition, competing interests for providing upward unweighting and withstanding operating forces in conventional DAP systems and user seal structures for the same unduly restrict natural gait movements for the user during use.

Thus, a need exists for overcoming drawbacks and limitations of conventional DAP systems, reducing usage risks, and simplifying user-adjustments and customizations of DAP systems.

SUMMARY

This summary introduces certain aspects of the embodiments or example arrangements described herein to provide a basic understanding. This summary is not an extensive overview of the inventive subject matter, and it is not intended to identify key or critical elements or to delineate the scope of the inventive subject matter.

According to aspects and features of inventive subject matter described herein, a floating seal frame structure usable with a DAP exercise system and enabling seal frame height adjustment during use thereof includes a seal frame, a pair of vertical lifts, a first tensile restraint, and a second tensile restraint. The DAP exercise system includes an inflatable enclosure having a base secured to a support platform and an opposite top portion defining a user port configured for a portion of a user's body and a user seal worn by the user to extend therethrough and create an airtight seal with the enclosure, wherein during use, air pressure within the inflatable enclosure applies upward force on the top portion and unweighting force on the user.

The seal frame is configured for attachment to the top portion about the user port and defines a first and a second restraint connector at opposite lateral sides thereof. The pair of vertical lifts include a first lift and a second lift each configured for securely connecting with the DAP system located at opposite lateral sides thereof and at a corresponding longitudinal position along the DAP system proximate the user port, in which each of the first and second lifts are configured for driving movement of a corresponding vertically drivable carriage to adjust a height of the carriage. The first tensile restraint has a first end configured for securely attaching to a first carriage connector of the first lift and a second end configured for securely attaching to the first restraint connector. The second tensile restraint has a first end configured for securely attaching to a second carriage connector of the second lift and a second end for securely attaching to the second restraint connector. When installed on the DAP exercise system, during system use, each of the first and second tensile restraints define a restraint length between the corresponding carriage connector and the corresponding restraint connector, and the seal frame is retained in a floating arrangement such that the seal frame is forced upward solely by pneumatic force applied by the enclosure top portion on the seal frame and fully restrained downward against the upward pneumatic upward force at a seal frame height by the first and second tensile restraints attached to the carriage connectors. A user seal boundary region is defined by regions of the enclosure top portion framed by the seal frame in the floating arrangement and extending inward to the user seal. The seal frame height can determine a boundary region height and a user seal height.

Implementations can include one or more of the following features. The seal frame structure, from a top view, defines a two-dimensional hoop-like shape about a top view, two-dimensional shape of the user port, and from a front, cross-sectional view corresponding with a front, cross-sectional view of the DAP system, the seal frame defines an arch-like, two-dimensional contoured shape having a middle region centrally arranged about a middle region of the user port, in which the middle region is elevated an offset height from the opposite first and second restraint connectors. The two-dimensional hoop-like shape and the arch-like, two-dimensional contoured shape can correspond with a transverse curvature and a contoured shape of the enclosure top portion. At least one of the offset height for the arch-like, two-dimensional contoured shape and a transverse width of the two-dimensional hoop-like shape between the first and second restraint connectors can be customized according to a feature for use of the seal frame structure with the DAP system, which can include one of the following: a height of the pair of lifts; a height of a structure connected to the pair of lifts; a height of a pair of handlebars supported by the pair of lifts; a carriage height; the carriage height range; the seal frame height; the seal frame height range; user freedom of movement in or more directions; user arm swing; inflatable enclosure wear, pinch or bind risk during use including during height adjustments; height adjustment controls; height adjustment performance; system or component stresses; seal frame integrity; user safety including emergency releasability of the seal frame; user ease of access including entry into and withdrawal from the seal frame, the user seal or the user port; and manipulation, handling or control of the seal frame before, after or during use.

Further, during use, the offset height can be configured such that a height of an upper portion of the user seal boundary region and the user seal height are higher than a height of the first and second restraint connectors of the user frame and heights of each of the first and second carriage. A seal frame transverse width between the first and second restraint connectors can be configured such that each of the first and second restraint connectors extends laterally away from the seal frame middle region and beyond lateral extents of the enclosure top portion when the seal frame height is disposed at a maximum height, and each of the first and second restraint connectors is disposed adjacent to the corresponding carriage connector.

In addition, the seal frame further can include: first and second pairs of side arms, first and second wing arms, and a pair of middle members. The first pair of side arms can laterally extend away from the seal frame middle region to a first side region of the user seal in a horizontally converging, vertically downward orientation, and the first wing arm can connect the first pair of side arms to each other at the first side region. The second pair of side arms can laterally extend away from the seal frame middle region to the second side region of the user seal in a horizontally converging, vertically downward orientation, and the second wing arm can connect the second pair of side arms to each other at the second side region. The pair of middle members can connect the left pair of arms to the right pair of arms at opposite fore-aft regions of the seal frame middle region. In some implementations, the first pair of side arms can each define an intermediate bend in a vertical angular direction opposite a downward vertical angle of the first pair of side arms to form substantially horizontal distal end portions, and the second pair of side arms can each define an intermediate bend in a vertical angular direction opposite a downward vertical angle to the second pair of side arms to form substantially horizontal distal end portions.

In some implementations, the seal frame structure can include a first lateral shaping member and a second lateral shaping member. Each of the first and second shaping lateral shaping members can be oriented substantially parallel with the DAP system longitudinal direction and, during use, each can be configured to engage and bridge across the corresponding first and second pair of side arms and interfere with a region of the enclosure top portion proximate a longitudinal gap between the corresponding first or second pair of side arms. Each first and second lateral shaping member can extend an interference length greater than the corresponding longitudinal gap at an interference location for the corresponding first and second pair of side arms. Each first and second lateral shaping member can also be configured to be attached to the inflatable enclosure top portion proximate the interference location without being affixed to the seal frame.

In some implementations, the pair of middle members can be longitudinally spaced apart and vertically below a corresponding adjacent fore and aft portion of the user seal by a longitudinal gap and a longitudinal drop defining a fore and an aft boundary region portion each having a matching slope and a matching extent. The interference location for each first and second lateral shaping member can be horizontally spaced apart and vertically below a corresponding adjacent first and second side region of the user seal by a lateral gap and a lateral drop defining a first and a second lateral boundary region portion each having a matching slope and extent. The lateral gap and the lateral drop, and the matching slope and extent of the first and second lateral boundary region portions can be greater than the longitudinal gap and the longitudinal drop, and the matching slope and extent of the fore and aft boundary region portion. The first and second lateral boundary region portions and the fore and aft boundary region portions can cooperate with each other to enhance for the user, arm swing clearance space, mobility during use and transverse user freedoms of movement during ambulation.

In some implementations, the first and second lateral shaping members can be located within the inflatable enclosure and affixed to an interior side of the top portion via a longitudinal stitch line along at least one side of each lateral shaping member, in which each longitudinal stitch line can define a fold line along a proximate region of the enclosure top portion at a corresponding side region of the corresponding first and second lateral shaping member. The fold lines can enhance arm swing clearance space and transverse user freedoms of movement during use. The seal frame can define a plurality of interference locations disposed along an extent of each first and second pair of side arms for the corresponding first and second lateral shaping member. The interference location for each first and second lateral shaping member can be selected from the corresponding plurality of interference locations for customizing at least one performance parameter that can include: reducing potential tears or damage to the inflatable enclosure; reducing inflatable enclosure infiltration into opposing seal frame lateral regions for at least a portion of the user seal range of heights; enhancing arm swing clearance; customizing the user seal boundary region proximate the seal frame lateral regions; and adjusting characteristics of the user seal boundary region for enhancing user movement freedom during ambulation.

In some implementations, the seal frame first restraint connector can include a forward first restraint connector at a forward location of the first side region of the seal frame and a rearward first restraint connector at a rearward location of the first side region of the seal frame. The seal frame second restraint connector can include a forward second restraint connector at a forward location of a second side region of the seal frame and a rearward second restraint connector at a rearward location of the second side region of the seal frame. The first tensile restraint can include a first pair of tensile restraints each having a first end configured for securely attaching to the first carriage connector and a second end for securely attaching to a corresponding one of the forward first restraint connector and the rearward first restraint connector. The second tensile restraint can include a second pair of tensile restraints each having a first end configured for securely attaching to the second carriage connector and a second end for securely attaching to a corresponding one of the forward second restraint connector and the rearward second restraint connector.

In some implementations, at least one of the first restraint connector of the user seal and the first carriage connector of the first lift can include a first quick disconnect, at least one of the second restraint connector of the user seal and the second carriage connector of the second lift can include a second quick disconnect, and each of the first quick disconnect and the second quick disconnect can be configured for rapidly releasing attachment of the corresponding tensile restraint from one of the user seal and the carriage when disconnected. In some implementations, each first and second quick disconnect can include a withdrawable pin extending through a connector channel and arranged for quickly disconnecting the corresponding tensile restraint connector when pulled out of the connector channel, and user disconnection of the tensile restraint connectors can enable manual disconnection of the user frame from the pair of lifts and lowering of the seal frame by the user when disconnected for exiting the DAP system with the seal frame lowered in the event of power loss.

According to aspects and preferences described herein pertaining to seal frame structures, a seal frame structure usable with a DAP exercise system and enabling seal frame height adjustment during use thereof can include a seal frame configured for attachment to the top portion about the user port or top opening, in which the seal frame defines a first and a second lift connector at opposite lateral sides thereof. The structure can also include a pair of vertical lifts including a first lift and a second lift each configured for securely connecting with the DAP system located at opposite lateral sides thereof and at a corresponding longitudinal position along the DAP system proximate the user port. The structure can also include a first carriage connected to the first lift and vertically drivable by the first lift, in which the first carriage has a first carriage connector configured for securely coupling with the seal frame. The structure also includes a second carriage connected to the second lift and vertically drivable by the second lift, in which the second carriage has a second carriage connector configured for securely coupling with the seal frame. The structure also includes a user-releasable coupling configured to maintain a secure connection between the seal frame and at least one of the first carriage connector and the second carriage connector while disposed in a reinforcement arrangement corresponding with DAP exercise system use, in which the user-releasable coupling is configured to disconnect the secure connection upon user release from the reinforcement arrangement. Each vertical lift can include one of a vertically lockable lift and a non-backdrivable lift configured to maintain a height setting for the respective first and second carriage connector and for the seal frame securely connected thereto until each lift is vertically unlocked or driven under electrical power. The structure can be configured such that user release of the coupling from the reinforcement arrangement causes disconnection of the secure connection between the user seal and the at least one of the first and second carriage connectors. The structure can also be configured such that in the event of power loss for the DAP exercise system, user release of the coupling enables manual modification of the seal frame height setting for facilitating user withdrawal from seal frame and DAP exercise system.

In some implementations, the seal frame structure can include: a coupling passage defined through at least one of the first lift connector, the first carriage connector, the second lift connector and the second carriage connector, in which the coupling passage is configured for receiving and retaining a portion of the coupling when in the reinforcement arrangement; and a sensor configured to detect presence of the portion of the coupling extended through the coupling passage in the reinforcement arrangement and further sense withdrawal of the portion of the coupling at least partially from the coupling passage; such that user release of the coupling from the reinforcement arrangement can include removal of the portion of the coupling at least partially from the passage, and the sensor can be configured to send an immediate alert notification to a control device of the DAP system for performing urgent actions. The urgent actions can include: interrupting one or more operations of the DAP system or the exercise device, disconnecting power to the DAP system or the exercise device, and activating an alert notification including a visible or audible alert. The user-releasable coupling can include at least one engagement member including: a pin; a bolt; a shackle; a lock ring; a detente pin, a spring-loaded clip; a hook and loop interface; a coaxial interface between support members; a buckle; a post; a pivotable or rotatable lock member; an over-center lock linkage; a rigid interface structure; mated pairs of structural members; multi-member assemblies; combinations of rigid interface members; and combinations of the at least one engagement member with one or more engagement members or fixed supports.

In some implementations, the seal frame structure can include: a first tensile restraint connecting a first carriage connector with a first seal frame connector; a second tensile restraint connecting a second carriage connector with a second seal frame connector; a first and a second vertical drive device each operatively connected to the corresponding first and second lift; and at least one controller operatively connected to the first and second lift. The at least one controller can be configured to control vertical drive operations for the first and the second lift within a range of relative heights between the carriages of each lift without racking between the first and second vertical drive devices or racking between a corresponding lead screw assembly of the vertical drive devices. In some implementations, the range of relative heights for lift operations without the racking can include a vertical offset distance between the carriages of less than fourteen (14) inches.

Other exercise-related support devices, related systems, and components, and/or methods according to embodiments or example arrangements described herein will be or become apparent to one with skill in the art upon review of the following drawings and detailed description. It is intended that all such additional devices, related components, systems, and/or methods included within this description be within the scope of this disclosure.

BRIEF DESCRIPTION OF THE DRAWINGS

FIG. 17A a schematic perspective view of the example seal frame structure of FIG. 16A, which is shown with the carriage of each lift fully lowered.

FIGS. 17B to 17D are plan views depicting alternative example quick release pin arrangements of the seal frame structure of FIG. 17A.

DETAILED DESCRIPTION

Figure 1A:
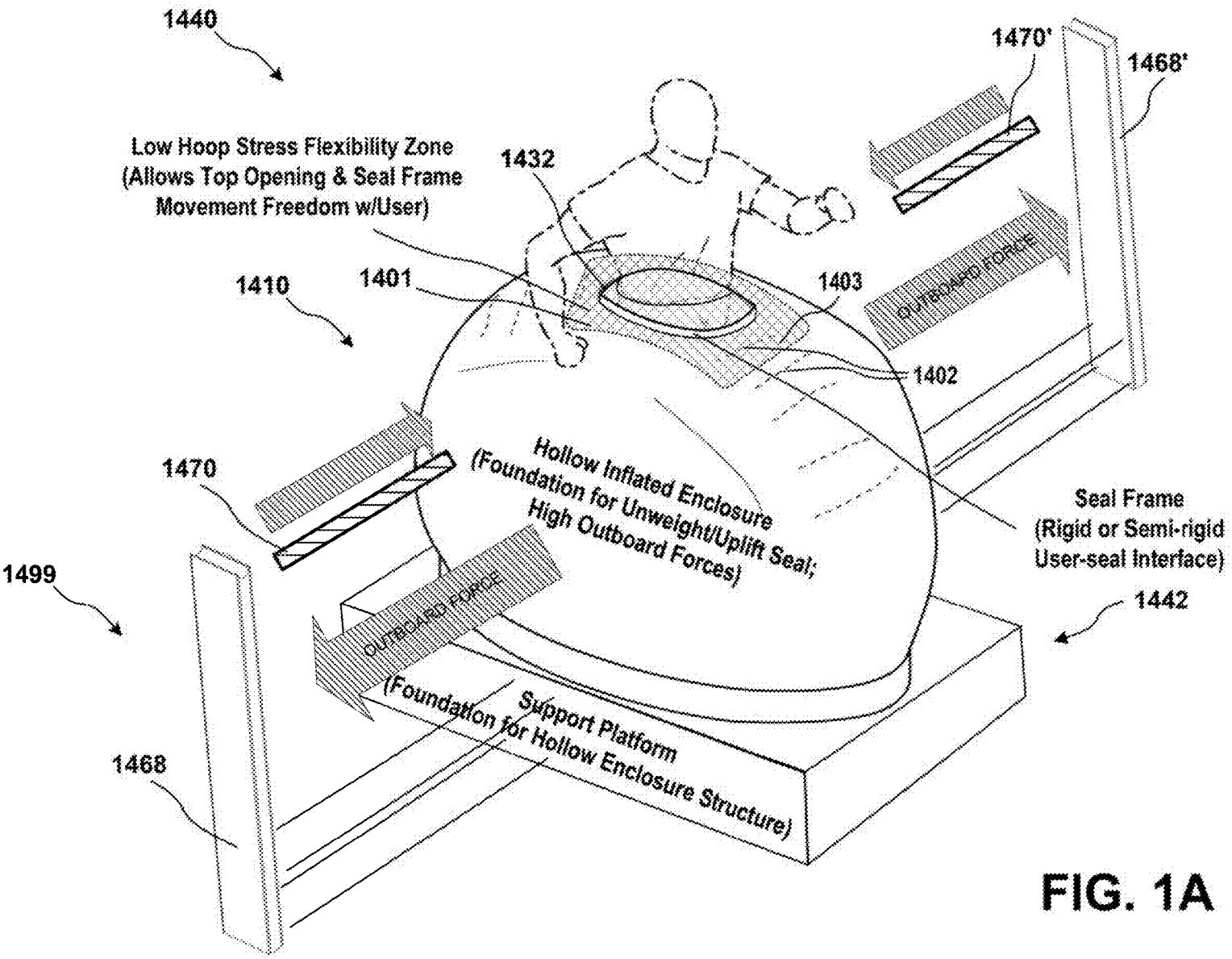
FIG. 1A is a top perspective view of a schematic representation of system operations for an independently supportable, flexible movement, inflatable enclosure secured by the platform of an of an example DAP System.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one arrangement," "an arrangement," or similar language means that a particular feature, structure, or characteristic described in connection with the arrangement is included in at least one arrangement of the present invention. Thus, appearances of the phrases "one arrangement," "an arrangement," and similar language throughout this specification can, but do not necessarily, all refer to the same arrangement, different arrangements, or component parts of the same or different illustrated invention. Additionally, reference to the wording "an arrangement," or the like, for two or more features, elements, etc. does not mean that the features are related, dissimilar, the same, etc. The use of the term "an arrangement," or similar wording, is merely a convenient phrase to indicate optional features, which may or may not be part of the invention as claimed.

Each statement of an arrangement is to be considered independent of any other statement of an arrangement despite any use of similar or identical language characterizing each arrangement. Therefore, where one arrangement is identified as "another arrangement," the identified arrangement is independent of any other arrangements characterized by the language "another arrangement." The independent arrangements are considered to be able to be combined in whole or in part one with another as the claims and/or art may direct, either directly or indirectly, implicitly, or explicitly.

Finally, the fact that the wording "an arrangement," or the like, does not appear at the beginning of every sentence in the specification, such as is the practice of some practitioners, is merely a convenience for the reader's clarity. However, it is the intention of this application to incorporate by reference the phrasing "an arrangement," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions away from the ground level of an exercise device in its typical or intended usage orientation at or towards a higher elevation, and the words "bottom," "below," "base" and "downward" refer to elevation directions at or towards the ground level of an exercise device at a lower elevation in its typical usage orientation. Thus, for example, the top of a structure for an exercise device that is farthest from the ground level of the exercise device would be the vertical distal end of the structure, and the end opposite the vertical distal end (i.e., the end interfacing with the exercise device closest to ground level) would be the vertical base or bottom end of the structure.

Further, specific words chosen to describe one or more arrangements and optional elements, or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below", or "beneath" other elements or features would then be "above" or "over" the other elements or features. Thus, the term "below" can encompass both positions and orientations of above and below, A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear," "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

In this specification, the applicant may refer to an exercise machine and an existing exercise machine. The reader shall note that the distinction is that an existing exercise machine may be already designed prior to consideration for use as a DAP system and an existing exercise machine may be further already installed in the field, for example in a gym, training facility, etc. The reader shall interpret minor modifications of the exercise machine or existing exercise machine for use with a DAP system as still part of the exercise machine and still within the spirit of the scope of the subject matter disclosed.

As used herein, an "independently-supportable" inflatable enclosure refers to an inflatable enclosure formed from a substantially inelastic material defining a base opening configured to be secured to a base support, configured to form an airtight connection with an air supply, and defining a top port configured to form an airtight connection with a user interface such that, when inflated, secured to the air supply, and forming an airtight connection with a user, the inflatable enclosure is capable of independently extending in an upward direction from the base support and providing unweighting forces on the user without requiring a support framework or other attachments or connections to support members regardless of whether the inflatable enclosure makes contact with a supplemental support member. As such, an independently supportable inflatable enclosure forms a hollow, thin-shelled inflatable support enclosure extending from the secure attachment with the base support upward to the top port and user interface.

DAP Example System with Transverse Hybrid Framework Including Vertical Supports and Bi-Lateral Flexible Tensile Connections Between the Seal Frame and Supports Referring now to FIG. 1A, a DAP System 1440 and enclosure 1410 are generally shown that can enable a top bracket or seal frame 1432 attached to the enclosure along a perimeter of a top port 1430 formed therein to selectively connect with a supplemental support mechanism formed via vertical supports 1468 and 1468' located on opposite outboard sides of the enclosure proximate the top port 1430 and seal frame 1432. A base region of each vertical support can be structurally attached to side regions of the support platform and extend upward therefrom for a height substantially corresponding with the enclosure height when inflated.

The DAP 1410 System can further include an arrangement of at least two (2) flexible transverse restraints 1470 & 1470' each attached to an opposite side of the seal frame 1432 disposed about the user and a corresponding vertical support 1468 or 1468'. In such an arrangement, an uninterrupted skeletal framework loop can be formed that transversely extends around the enclosure including through the support platform on which the enclosure is mounted, upward from the platform along opposite outboard sides of the enclosure through the pair of vertical supports, and through the pair of flexible restraints 1470 and 1470' for firmly connecting on opposite sides with the seal frame 1432. The skeletal framework can be considered a hybrid framework, in that the framework reinforces or enhances independent support features already provided as baseline or default support arrangement provided via a flexible enclosure formed from a pair of joined flexible sheets mounted on a support platform as described above. As such, corresponding directional support is provided by the skeletal framework along a transverse plane extending around the enclosure proximate the user and top bracket for a vertical range of movements.

Inflatable enclosure 1410 as shown forms a low hoop stress flexibility zone 1401 along at least an upper central portion thereof through which the top opening 1430 is formed along with a seal frame 1432 for securing a user interface (not shown) disposed about the user in an airtight manner within the top opening. The low hoop stress flexibility zone 1401 is naturally formed along a rounded edge or rim portion of the generally disc-shaped enclosure 1410 formed from a pair of joined sheets as discussed in greater detail along with the provisional application filed in December 2020. The flexibility zone 1401 can be characterized by regions of transversely oriented low stress segments interposed by series of wrinkles 1402, which indicate negative hoop stress or compression stresses. The low hoop stress zone 1401 can be created by the balanced pair of opposing flexible sheets having a pair of high, opposite outboard forces acting thereon when inflated in a zero length cylinder extending therebetween based on direct attachment of the opposite flexible sheets to each other.

The low hoop stress flexibility zone 1401 can allow the user to move fore and aft within the zone 1401 while receiving upweighting support applied to the user via the user's airtight interface within top opening 1430. The low hoop stress flexibility zone 1401 can further enable tilt movements to be readily made by the user along corresponding motions of the seal frame 1432. Such movement flexibility including ready fore-aft movements and tilt movements provide a highly unique 'floating' unweighting support arrangement via DAP System 1410 and similar systems described herein. As discussed hereafter, the low hoop stress flexibility zone 1401 arrangement further enables vertical height adjustment of the seal frame 1432 via vertical lifts that can provide similar support as provided from vertical supports 1468 and 1468' and corresponding hybrid framework 1499.

Hybrid framework 1499 can be arranged for providing transverse and vertical support and movement for seal frame 1432 and the user therein without significantly limiting the high levels of movement freedoms otherwise provided by DAP System 1410. This is due in large part to balanced application of transverse support between the pair of vertical supports 1468 and 1468' via a pair of flexible, high tensile strength supports 1470 naturally constrained for only applying unidirectional tensile force directly counteracting or contradicting opposite forces from the opposing vertical support. These high forces are created by opposing large outboard forces of the inflated enclosure that create the low hoop stress flexibility zone 1401, which are transmitted by the inflated enclosure to the support platform 1442 as outboard moments applied to the platform. Each of the vertical columns 1468 and 1468 are uniquely able to provide large moment arms based on their height and do so with minimal structural impact to the system based on the transverse connection of the vertical supports across the seal frame 1432.

These high forces are also created by the top frame 1432 compressing the upper surface of the inflatable enclosure 1410 against the differential pressure when the top frame 1432 height is adjusted for individual users. The respective tensile supports 1470 and 1470' impart a resultant tensile force and a transverse force to each respective vertical support 1468 and 1468'. The level of force applied by the tensile supports 1470 and 1470' to the vertical support columns is greatest at maximum differential pressure when the top frame 1432 is at its lowest position and adjusted to the shortest user. However, despite the high tensile forces being applied through the top frame 1432, the hybrid frame 1499 applies only minimal impacts on movement flexibility for the user-without significant impacts on fore-aft movements perpendicular to restraints provided by the hybrid framework nor significant rotational impacts for tilt of the seal frame 1432.

The unique hybrid framework's uninterrupted framework loop allows for very efficient load carrying of the outward forces applied by the inflatable enclosure. In fact, the nature of the flexible restraints and purposeful transverse connection to the vertical lifts across the floating seal frame, allow a symbiosis between the vertical restraining force and the outboard restraining force on the enclosure based on the angle of the flexible restraints. Therein, a higher outboard force actually tries to actively pull the vertical lifts closer together, directly countering the outboard force from the enclosure on the lifts which is trying to push the lifts further apart. The benefit of this balancing of forces is a dramatic reduction in metal and structural elements that would otherwise be required to contain the forces in the system.

General Height-Adjustable Seal Frame Structure

Figure 1B:
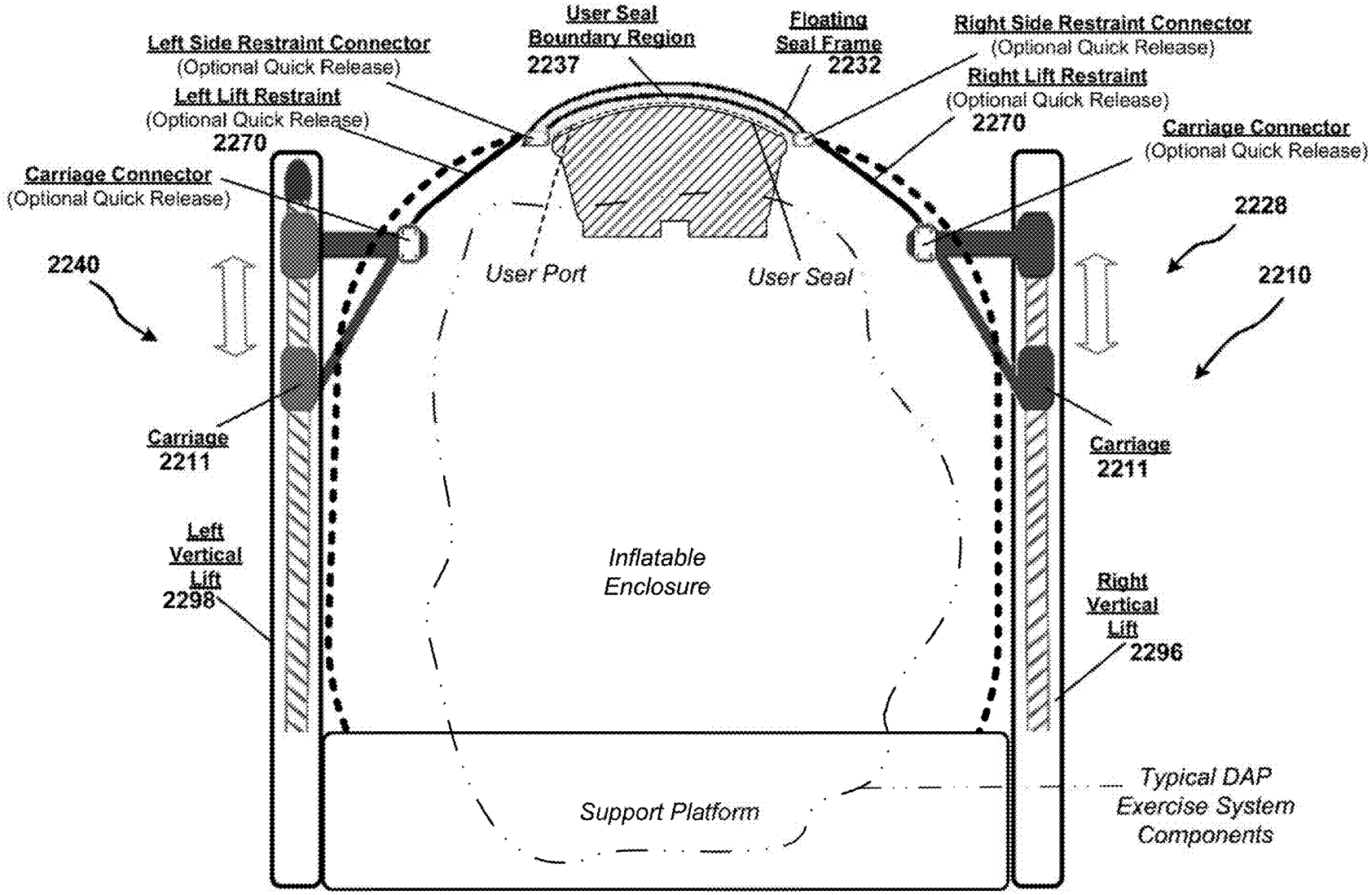
FIG. 1B is a schematic cross-sectional view depicting an example DAP exercise system arrangement having installed thereon an example seal frame structure in accordance with inventive aspects and features described herein.

Referring now to FIG. 1B, a seal frame structure 2228 is generally shown according to aspects and features described herein pertaining to seal frame structures, which can be used with a differential air pressure (DAP) System for providing adjustable height functionality along with other benefits. The seal frame structure 2228 can be used with a conventional DAP System, as well as with various arrangements, options and configurations for DAP Systems discussed herein and in related applications identified at the beginning of this specification and incorporated herein by reference. As shown, a DAP system typically includes a support platform disposed about or enclosing an exercise device (not shown) therein, and an inflatable enclosure attached at a base portion to the platform in a substantially airtight connection, as well as an inflation source (not shown) connected to the platform for inflating the enclosure, and control system (not shown) for controlling DAP system operations. When inflated, the enclosure extends upward from its base portion to a top opening or user port defined at a top portion of the enclosure above the exercise device, which is accessible through the enclosure for performing exercises.

A user wearing a user seal configured for removably attaching to the enclosure at the top opening extends through the top opening, connects the user seal to the enclosure at the top opening via a user seal interface, and when inflated receives unweighting vertical support while being able to interact with the exercise device (not shown) through the inflatable enclosure and access provided through the platform to the exercise device. Due to the high forces exerted based on pneumatic pressure in the enclosure during use and other challenges, DAP systems typically lack powered or automated height adjustment features overall, and especially for in-use, inflated height adjustments. Rather, conventional DAP systems rely on manually adjusting structural features prior to use for height related modifications, and/or rely on adjustments for the user seal worn by the user or offsetting the interface between the user seal and the inflatable enclosure to accommodate height differences between users. Such options are cumbersome for the user and impact user comfort and performance while using the DAP system based on improper or less than optimal engagement between the user and the inflatable enclosure.

Seal frame structure 2228 can be used with various DAP system arrangements for providing automated or powered height adjustment features. The seal frame structure includes a right vertical lift 2296 and a left vertical lift 2298, each of which are configured for secure attachment with the platform at opposite lateral sides thereof at a middle region of the platform in the longitudinal direction of the DAP system proximate or generally centered or aligned with respect to the top opening user port and, optionally, can be integrated with the platform for enhanced integrity and structural strength. Aligning the lifts with the top opening can avoid having unbalanced or offset, cantilever type forces from being exerted on the lifts during use and enable focused height adjustments for a region of the enclosure proximate and about the user seal interface with the top opening.

Each lift 2296, 2298 is configured for driving a vertically adjustable carriage 2211 attached thereto, which can be controlled by the DAP control system, for performing the height adjustment operations. Each lift can optionally include a non-backdrivable or vertically lockable lift, such that when in the inflated condition pneumatic forces are not transmitted to lift drive mechanisms. Each lift is connected to a seal frame 2232, which is attached to a top portion of the enclosure proximate and extending about the top opening. The seal frame can stabilize a boundary region about the user seal interface extending from the user seal interface to the seal frame, and can provide height adjustment for the user seal interface and the user based on controlling a height of the stabilized user seal boundary region 2237.

As shown in FIG. 1B, opposite lateral side regions of the seal frame can be connected to each corresponding carriage 2211 via a corresponding left and right lift restraint 2270. The left and right lift restraint can include a flexible tensile restraint, such as one or more high strength straps, ropes, cables or other type of flexible tensile restraint having high tensile strength properties under stress in the tensile direction while being otherwise flexible, and can further include rigid connections between opposite lateral regions of the seal frame and each carriage. As further shown in FIG. 1B, a vertical height of the seal frame 2232 can be offset from a height of the carriage or, more precisely, from a height of a connection with the carriage for the seal frame. Such an offset can provide performance benefits for the user, such as allowing great arm swing clearance, and further allow for lower vertical heights for the lifts along with applied force angles for connections with the carriages, which can further enable height adjustment features described herein. These and other aspects and features pertaining to seal frame structures described herein can provide powered or automated height adjustment for the user based on height adjustment of the user seal interface with the enclosure when used with a DAP system.

Floating Seal Frame Structures

Figure 2A:
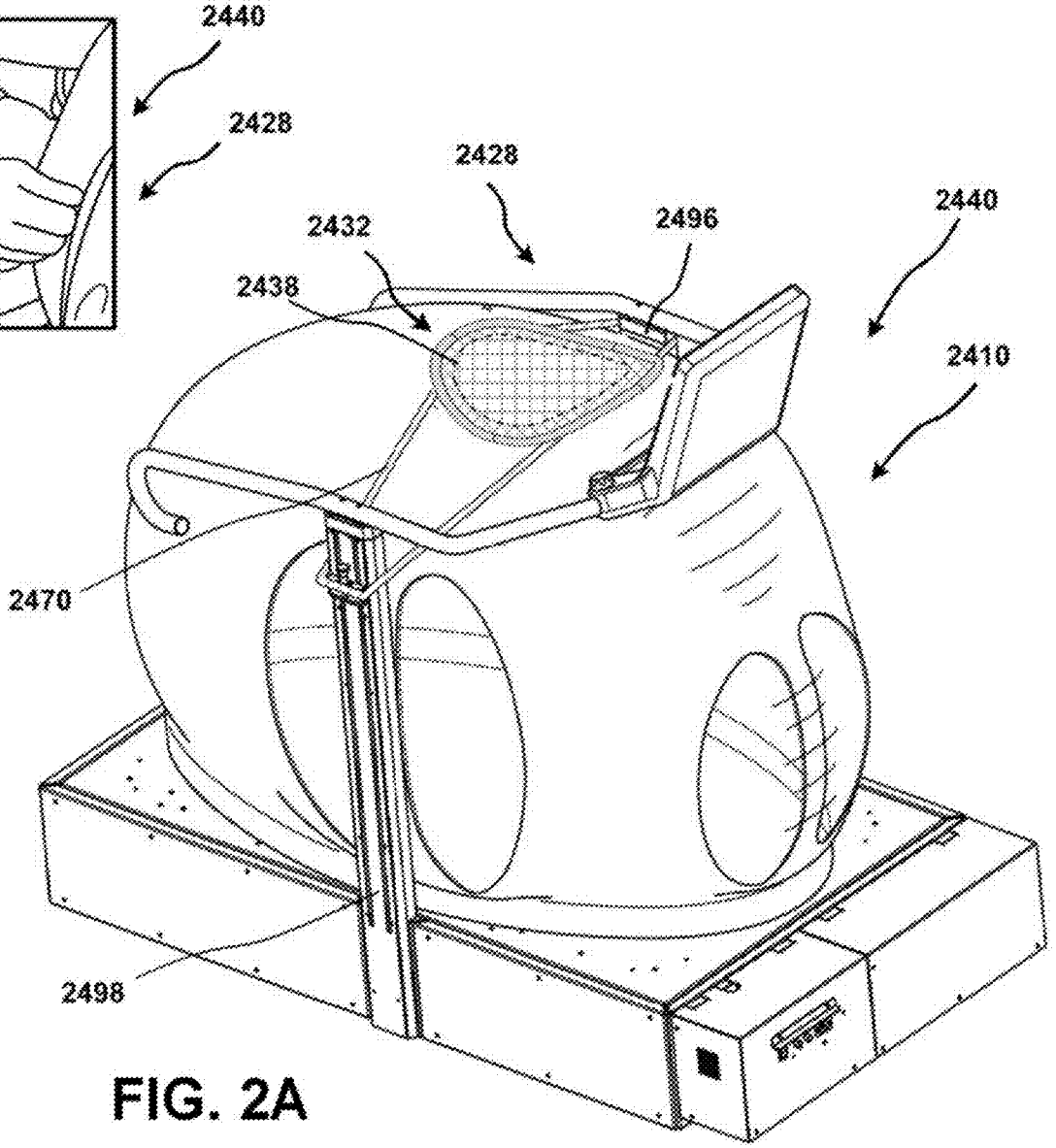
FIG. 2A is schematic, upper right perspective view depicting another example DAP exercise system arrangement having installed thereon an example seal frame structure in accordance with inventive aspects and features described herein, which is shown in an inflated, raised usage condition.
Figure 2B:
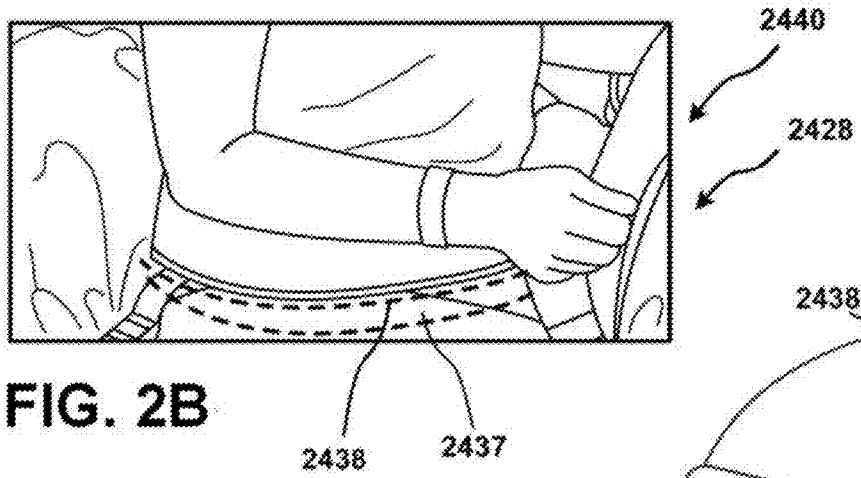
FIG. 2B is a right perspective view of a portion of the DAP exercise system arrangement and the seal frame structure of FIG. 2A proximate a user, which is shown in an inflated, reduced height usage condition

Referring now to FIGS. 2A to 2B, a seal frame structure 2428 is generally shown in use with a DAP System 2440 according to aspects and features seal frame structures described herein and further described in related applications identified at the beginning of this specification that have been incorporated herein by reference. Seal frame 2428 generally includes aspects and features of seal frame structure 2228 discussed above and similar descriptions in the related applications, except as discussed hereafter. Accordingly, like numbers refer to like features.

Seal frame structure 2428 includes a similar arrangement as described above for seal frame structure 2228, but includes flexible tensile restraints 2470 connecting each side region of the seal frame 2432 to a corresponding carriage 2411 along with using a contoured or generally saddle-shaped arrangement for the user seal 2432. The use of flexible tensile restraints 2470 can enable a "floating" seal frame arrangement that can provide various benefits including greater movement flexibility for the user that can provide for a more natural feel and gait during ambulation. Further, in some arrangements, a floating seal frame arrangement can permit customization according to user preferences, such as modifying an inclination of the seal frame like a forward inclination as depicted in FIG. 2B that can be enabled via a pair of flexible tensile restraint connection at each lateral side including a fore and an aft tensile restraint connection. In addition, as also depicted in FIG. 2B, such a floating arrangement combined with a contoured seal frame 2432 can improve a force application angle, Σ, which can reduce the downward force components applied to the lift for resisting upward pneumatic forces applied to the seal frame 2432 when inflated along with other benefits like greater arm swing space due to force application angle.

Figure 2D:
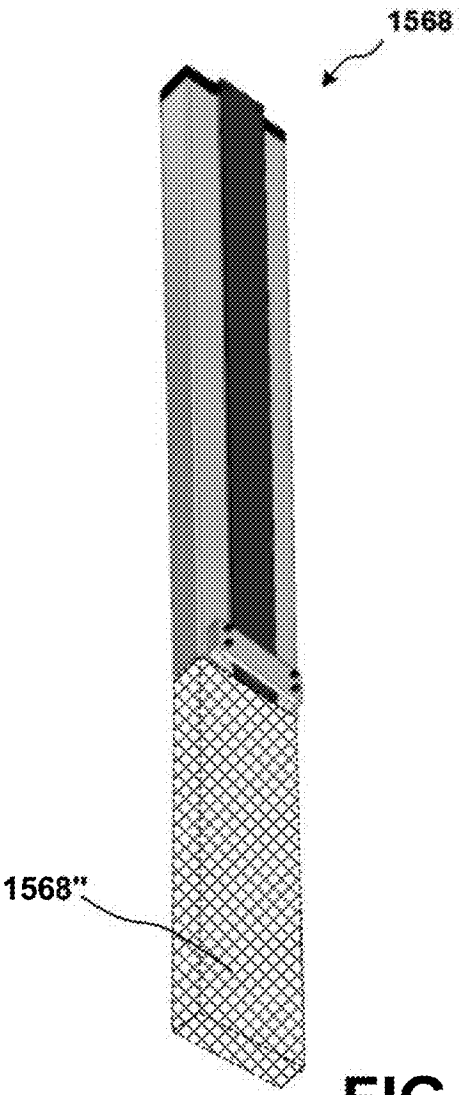
FIG. 2D is a perspective view of the lift mechanism of FIG. 2C.
Figure 2C:
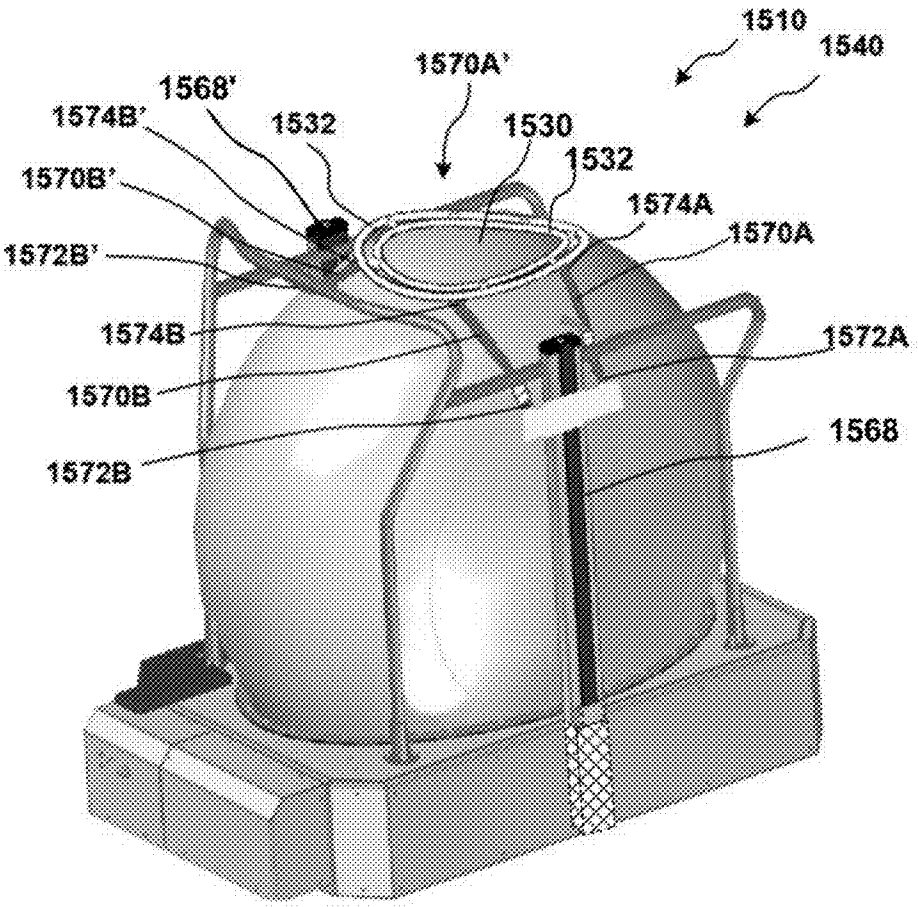
FIG. 2C is a schematic front perspective view depicting System operations for a flexible-movement DAP System including an enclosure secured on a platform, a pair of lift mechanisms along the lateral portions of the enclosure, and a seal frame attached to the enclosure at a top port according to aspects and features of various examples and inventive concepts discussed herein.

Referring now to FIGS. 2C and 2D, a DAP System 1540 and enclosure 1510 are generally shown that can enable a top bracket or seal frame 1532 attached to the enclosure along a perimeter of a top port 1530 formed therein to selectively connect with a supplement support mechanism formed via a pair of vertical lifts 1568 and 1568' located on opposite outboard sides of the enclosure proximate the top port 1530 and seal frame 1532. A base region of each vertical lift can be structurally attached to side regions of the support platform and extend upward therefrom for a height substantially corresponding with the enclosure height when inflated. As shown in FIG. 2C, each of the vertical lifts 1568 and 1568' can include optional extensions 1568" along with optional attachment brackets (not shown) for firmly attaching each of the vertical lifts to side portions of the corresponding platform The DAP System can further include an arrangement of four (4) flexible lift restraints 1570 A,B,A'&B' attached at each of their first ends 1572A, 1572B, 1572A', 1572B' to a vertically movable control device or carriage 1569 of a corresponding vertical lift. A second attachment end 1574 A,B,A'&B' of each flexible lift restraint can selectively attach to a portion of the seal frame 1532, or extension thereof extending about the top opening 1530 of the enclosure 1510. In such an arrangement, an uninterrupted skeletal framework loop can be formed that transversely extends around the enclosure including through the support platform on which the enclosure is mounted, upward from the platform along opposite outboard sides of the enclosure, for firmly connecting on opposite sides with the seal frame 1532, which provides a flexible support about the user that allows significant translation (several inches) of the seal frame in a vertical axis, and in some cases more than one axis and even all three axis, after the height setting is achieved, and attachment to the enclosure at the top opening 1530. The skeletal framework can be considered a hybrid framework, in that the framework reinforces or enhances independent support features already provided as baseline or default support arrangement provided via a flexible enclosure formed from a pair of joined flexible sheets mounted on a support platform as described above. Further, the skeletal framework can be arranged to provide limited support appropriate for enabling enhanced DAP System functionality or a range or set of enclosure operations, such as height adjustment and automated pre-loading for the user. As such, corresponding directional support is provided by the skeletal framework along a transverse plane extending around the enclosure proximate the user and top bracket for a vertical range of movements.

As such, the vertical lifts 1568 and 1568' can each be disposed on an external, outboard side of the driven slide with respect to the enclosure 1510. Accordingly, inadvertent contact can be avoided with outer portions of the enclosure wall during vertical movements that can potentially pinch or otherwise weaken outer portions of the enclosure wall. Although vertical lifts 1568 and 1568' can be spaced apart and arranged with respect to the enclosure to avoid contact with outer walls, an outboard arrangement of vertical lifts 1568 and 1568' can further avoid any potential inadvertent contact to further protect long-term integrity of the enclosure and decreases the overall width of the machine. The orientation may however be flipped without departing the inventive concepts herein, so that the lift carriages are located on the inner face of the channel. Such a configuration may shift the loading on connecting members to a more vertical orientation which may reduce the tensile forces on those connecting members (e.g. STRAPS). Further motivations for outboard orientation of the lift carriages may be to promote an angled configuration of the lift restraint while maintaining a narrow seal frame in an inner position between vertical lifts. As discussed further below, an angled configuration can improve efficient carrying of forces within the skeletal framework loop.

Figure 2E:
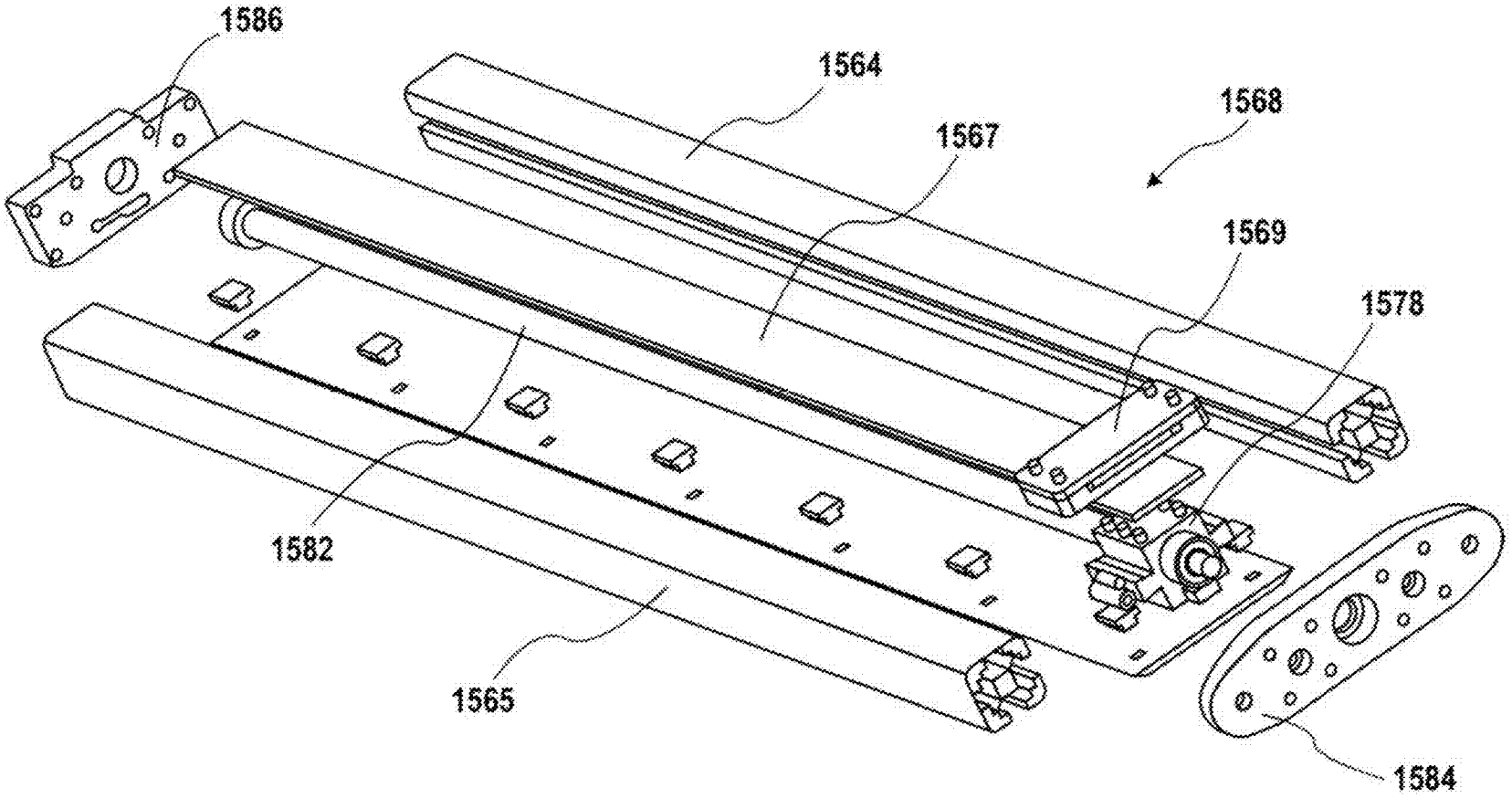
FIG. 2E is an exploded perspective view of the lift mechanism of FIG. 2A.

Referring to FIG. 2E, an exploded view of an example linear drive vertical lift 1568 is generally shown. Vertical lift 1568 includes a pair of spaced apart, opposing vertical side rail supports 1564 and 1565 and a vertical inboard wall extending therebetween and oriented toward the enclosure during use, which protects against contact with the enclosure wall. A slide surface 1567 is disposed opposite the inboard wall 1587 and likewise extends between the side rail supports 1564 and 1565 about which a driven slide or carriage 1569 translates vertically during use for controlling height of seal frame 1532 and tensile forces imparted to the top bracket 1532 via lift restraints 1570A,B,A'&B'. A drive screw 1582 is vertically and rotatably retained within the vertical lift 1568 extending parallel with the vertical central rail 1567 between an opposing top cap 1584 and bottom cap 1586. A drive slide 1578 forms a threaded connection about the drive screw 1582 for movement along the drive screw 1582, which is connected to driven slide or carriage 1569. A drive motor (not shown) controls rotations of drive screw 1582 for accurately and quickly controlling vertical movements of drive slide 1578 along the drive screw and, thereby, vertical movements of driven slide 1569 and lift restraints 1570A,B,A'&B' connected thereto. All the railing features may also be formed as an integrally formed component Cooperative groups of vertical lifts 1568 and 1568' can be controlled substantially in unison for precisely controlling position through tensile forces imparted about the perimeter of the float bracket 1548. It is understood that height differentials can be selectively applied for desired results, such as to impart tilt or other preferences on the float bracket 1548 for a user. The drive screw and corresponding nut may have a pitch angle such that the mechanism is not backdrivable. In this manner, the motor does not need to compensate for the high loads imparted by the enclosure on the top frame and thus carried through the drive screw. A safety method of height adjustment may therefore be to check the pressure inside the enclosure to ensure it is below a predetermined safety limit before allowing activation of the lifting columns and power applied to the motor as a safety precaution not to burn out the motor. Additionally, since motor current may be low due to the non-backdrivability of the system, another safety method may be to monitor motor current, and if motor current is above an impingement current limit, i.e. the current defined as higher than normal operation, the lift drive system may cut power to the lift if the lift were moving vertically upwards, or may in fact reverse the direction of the lift if, for example, the lift were moving down. One reason for reversing the direction of the lift, and then moving a short distance, say 18 inches, is that there may be an obstruction, including a person, under the lift and the safer default position for the lift is up.

Figure 3B:
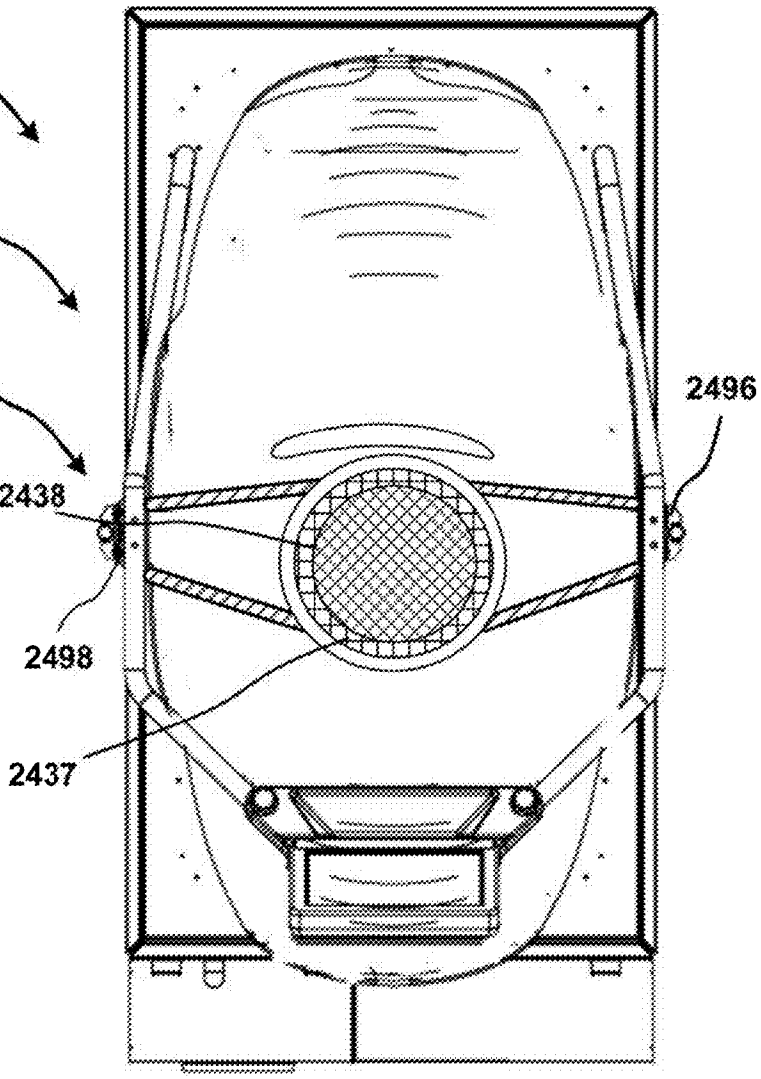
FIG. 3B is a top view of the DAP exercise system arrangement and seal frame structure of FIG. 2A.
Figure 3A:
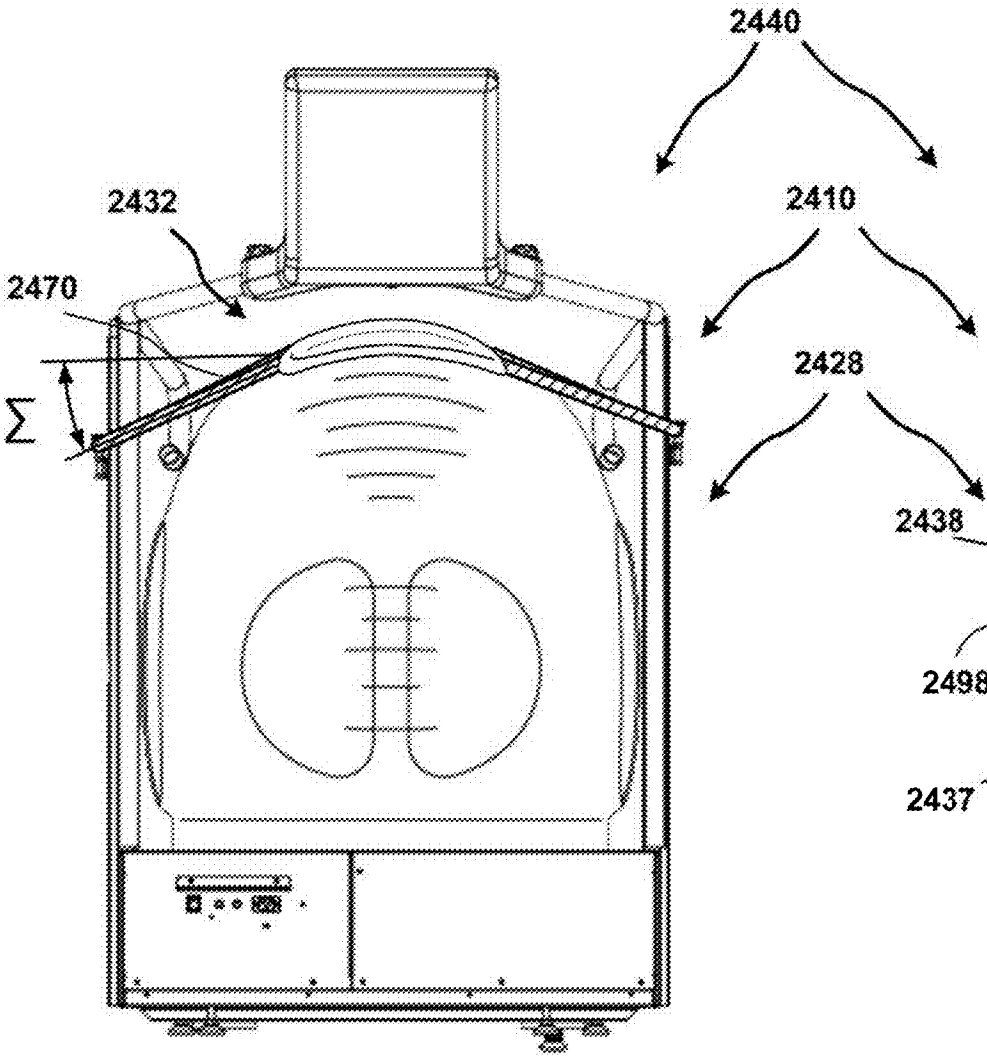
FIG. 3A is a front view of the DAP exercise system arrangement and seal frame structure of FIG. 2A.
Figure 3C:
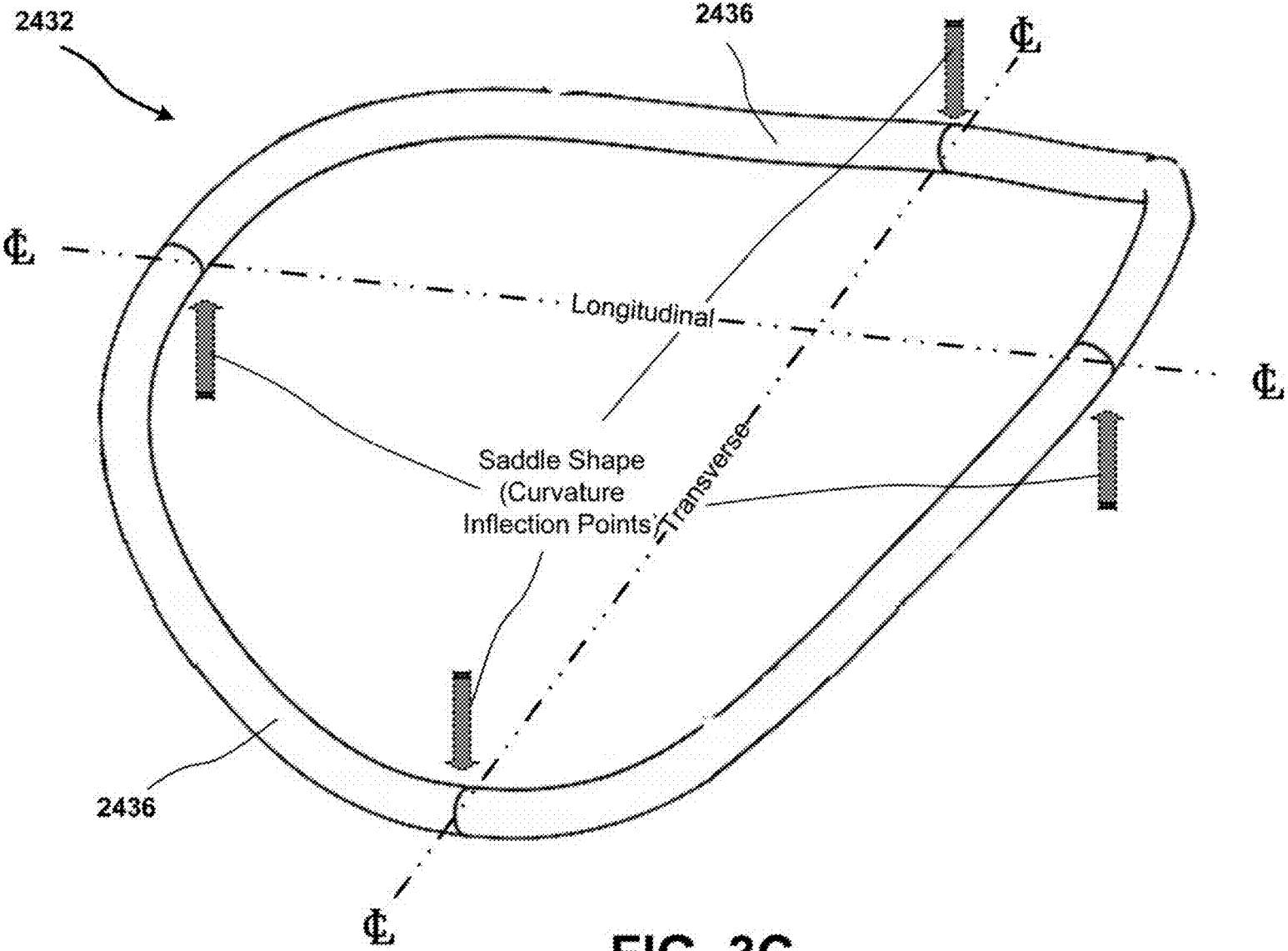
FIG. 3C is an upper, right perspective view of the hoop-shaped, arched seal frame of the seal frame structure of FIGS. 2A to 3B.

Referring now to FIGS. 3A and 3B, an example seal frame structure 2828 is generally shown along with user seal 2832, which generally include the aspects, features and preferences discussed above and in related applications identified herein at the beginning and incorporated herein by reference for the same or related features except as described hereafter. As such, like numbers refer to like features. Seal frame structure 2828 primarily differs from seal frame structure 2428 based on the shape and arrangement of seal frame 2832. Seal frame 2832 depicts, as an example, a seal arrangement that implements various optional and beneficial aspects and features in a combined example arrangement. However, it is understood that various aspects and features shown and described along with example seal frame 2832 and/or with other example arrangements herein can implemented alone and/or in various other combinations.

As best shown in FIGS. 3A to 4C, an example contoured seal frame 2832 is provided and shown on its own, which can provide various enhanced features and customizations based on user preferences for improved functions, operational benefits and other advantages. As best shown in FIGURES SA to 6B, the example contoured seal frame 2832 is provided and shown installed as part of an example DAP System 2840 along with depicting an example usage environment during use of the DAP System by a user (not shown) extending through a top opening of an inflated enclosure along with extending through the seal frame 2832.

Figure 4A:
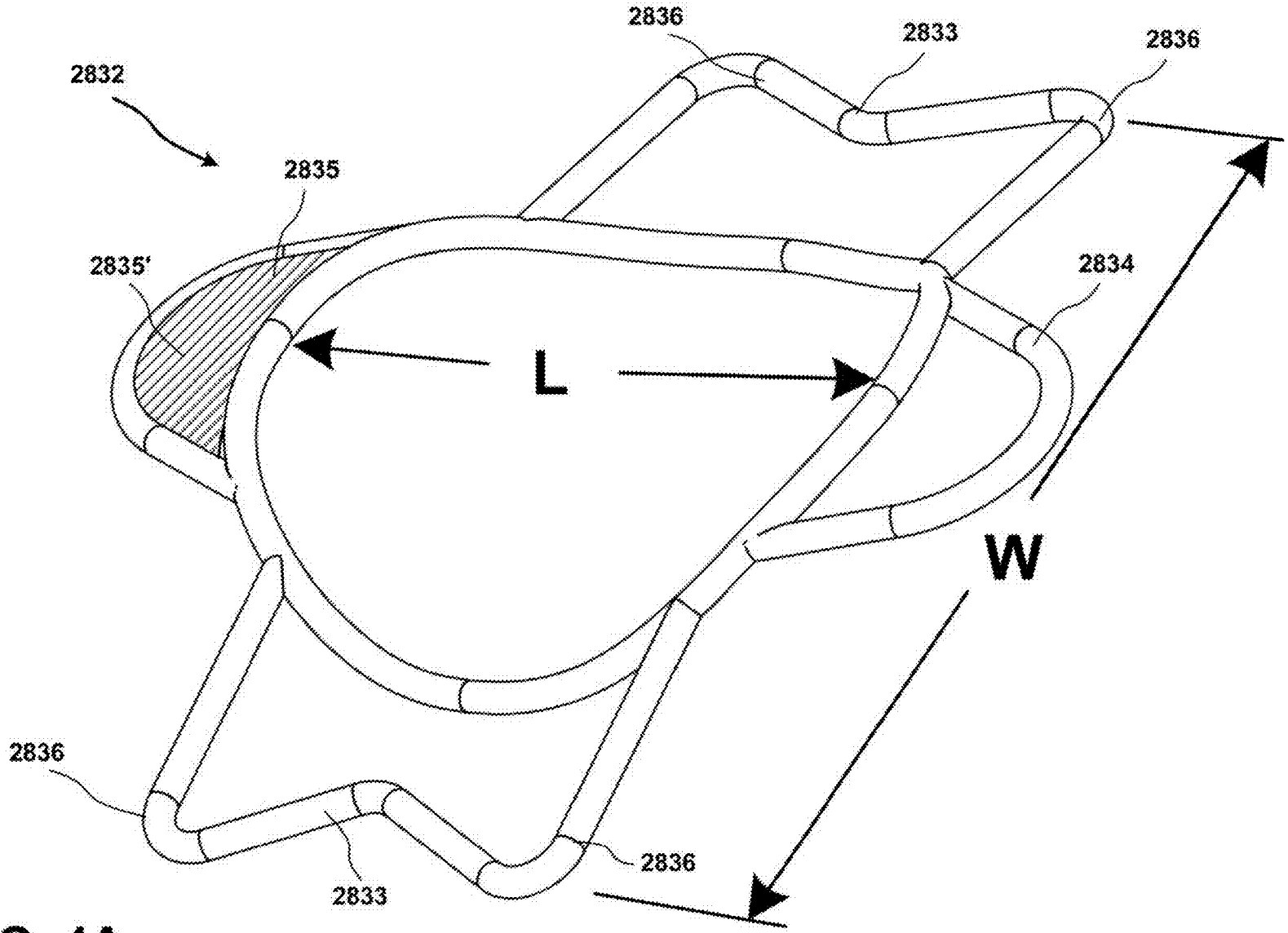
FIG. 4A is an upper, front right perspective view depicting a schematic representation of an example hoop-shaped, arched user seal having an extended transverse width according to inventive aspects and features described herein.
Figure 4B:
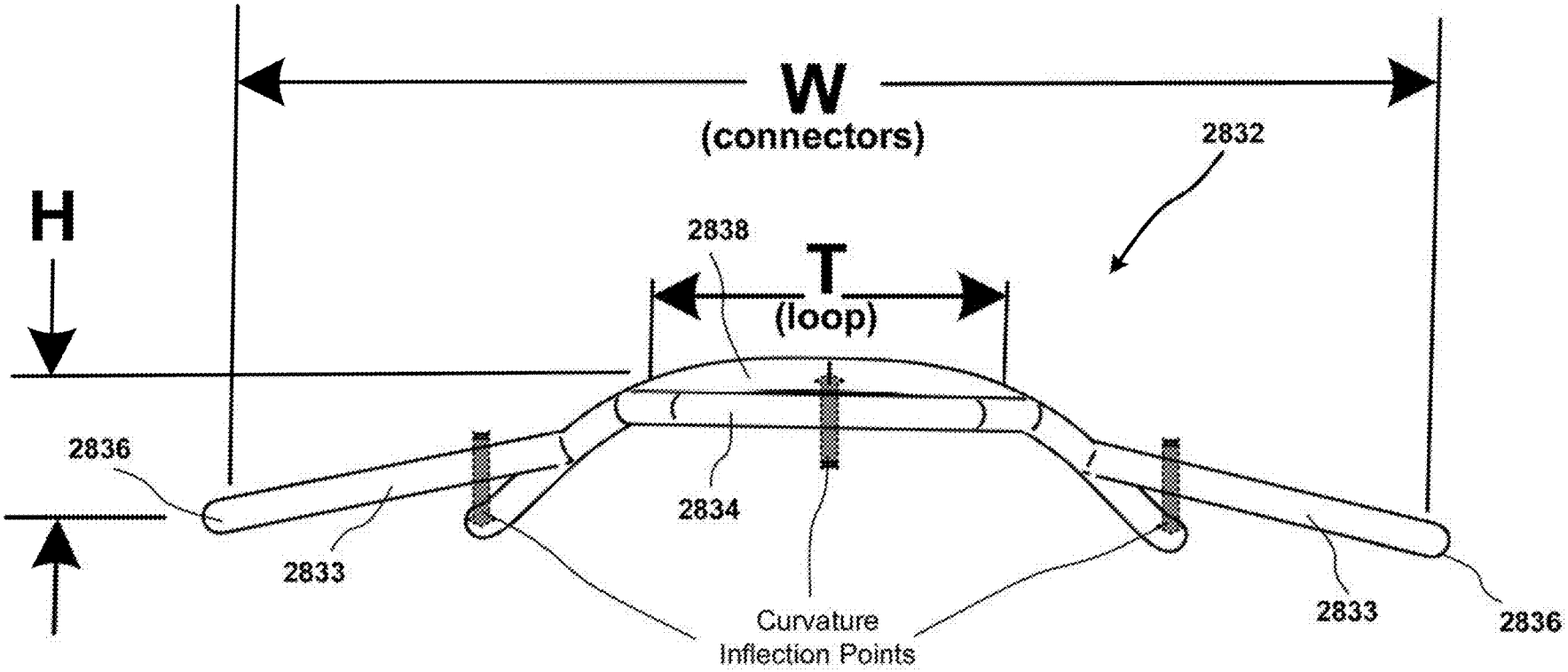
FIG. 4B is a front view of the user seal of FIG. 4A.
Figure 4C:
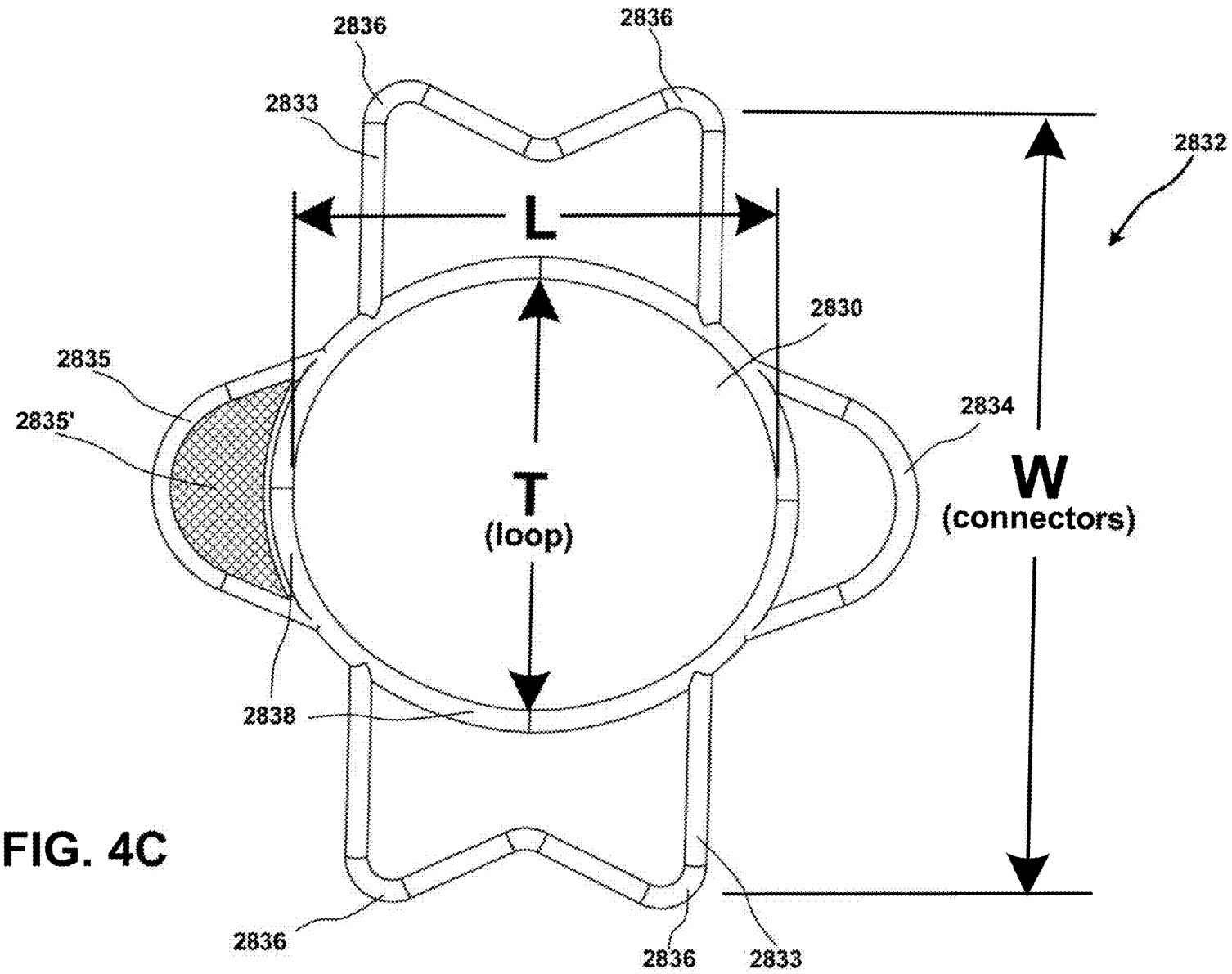
FIG. 4C is a top view of the user seal of FIG. 4C.
Figure 5A:
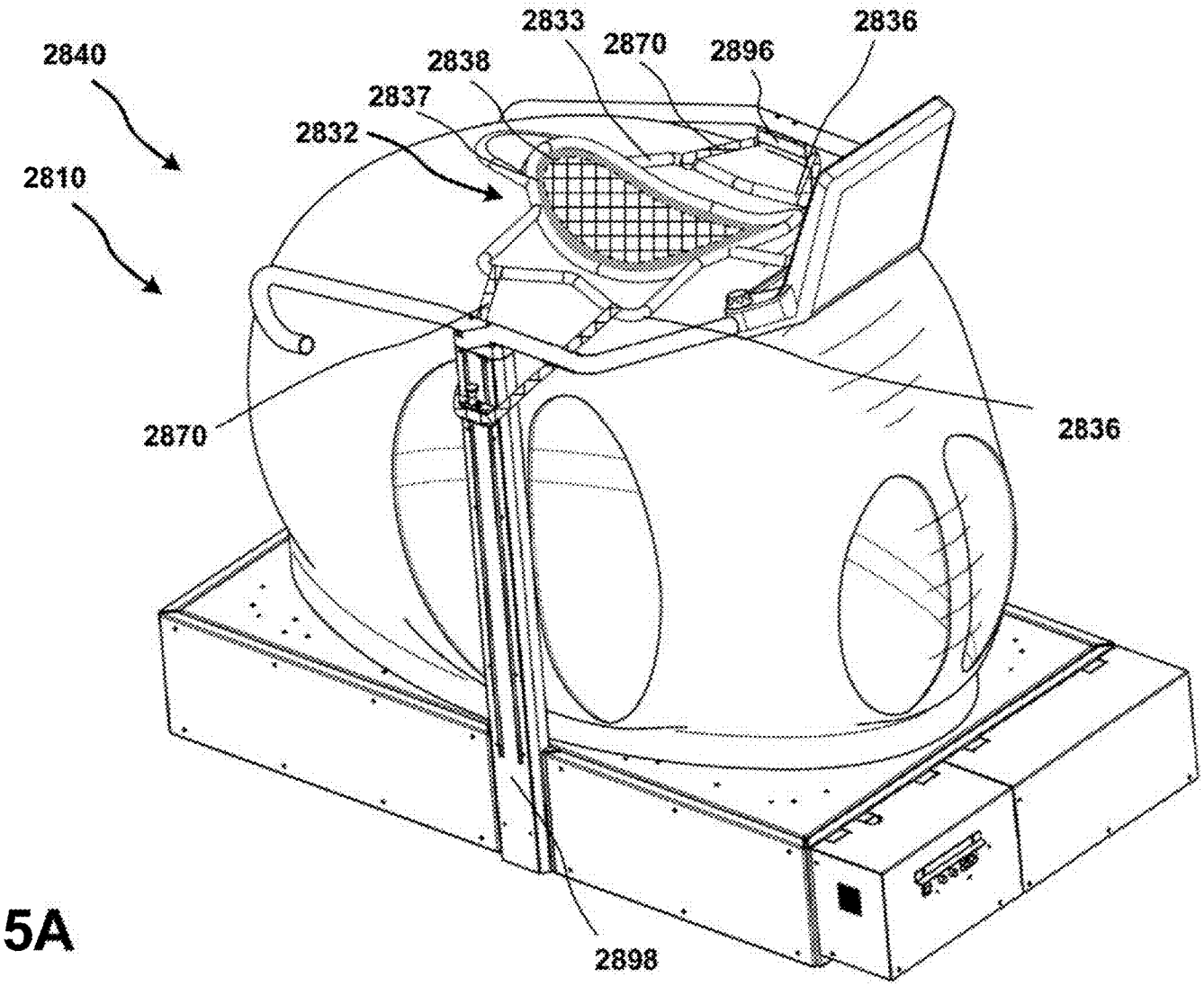
FIG. 5A is a schematic upper, front right perspective view depicting an example DAP exercise system arrangement having installed thereon a seal frame structure in accordance with aspects and features described herein, which is shown with the seal frame of FIG. 4A.
Figure 5B:
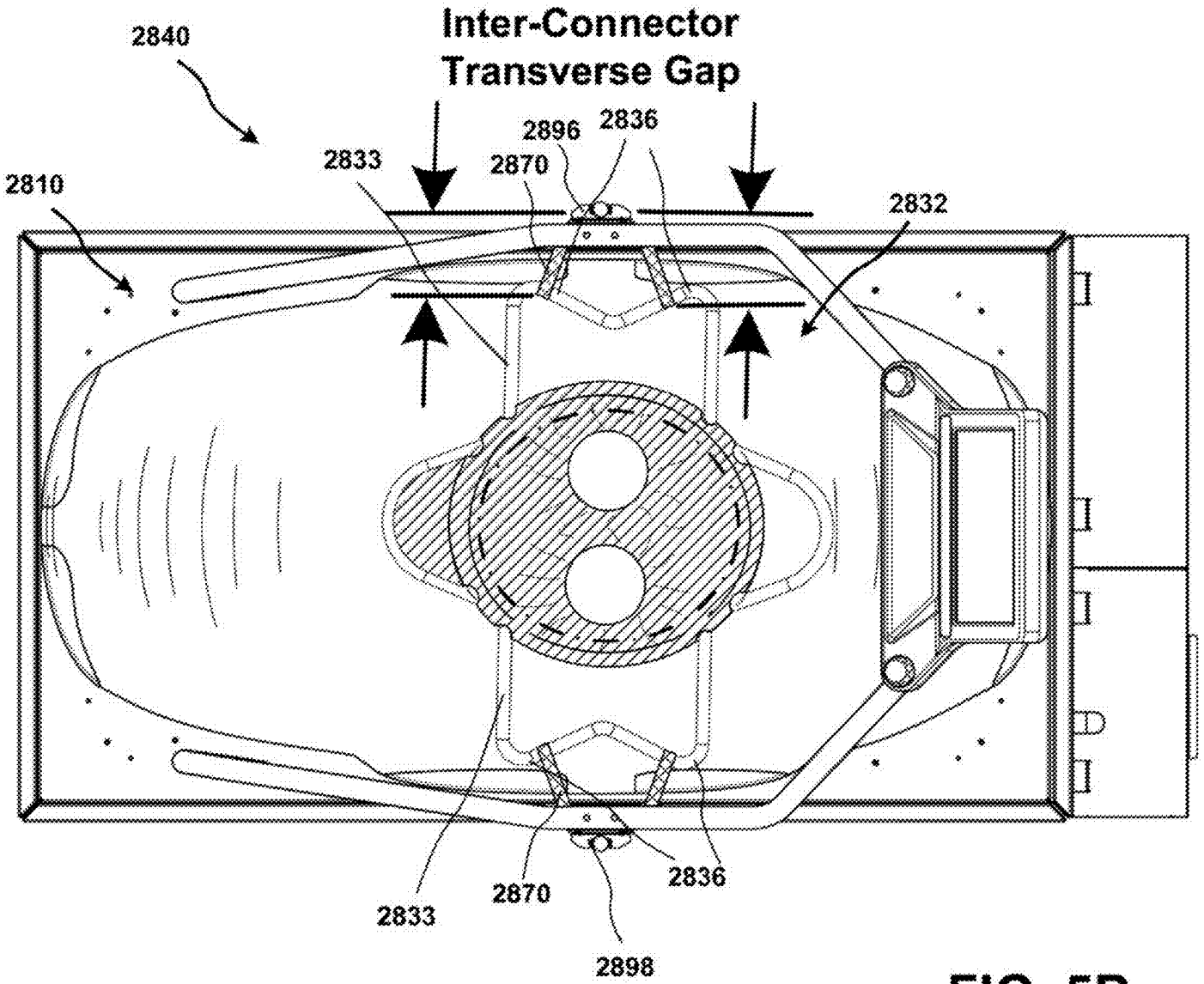
FIG. 5B is a top view of the DAP exercise system, seal frame structure and seal frame of FIG. 5A.

With particular reference to FIGS. 4A to 4C, seal frame 2832 can include an optional contoured inner loop arranged for providing close support and stabilization about a user seal interface 2838 with the enclosure top opening for assisting the user seal interface with maintaining an airtight connection with the enclosure, in which the user seal interface is attached to a harness device and/or an integrated garment like shorts. Thus, as shown in FIG. 5A, the inner loop can be attached to in and be in close proximity to the user seal interface 2838 and a perimeter of the top port 2830 via attachment of the seal frame 2832 to a top portion of the enclosure by a sewn connection, through use of attachment straps, and by other attachment mechanisms. Further, the user seal interface 2838 likewise be attached through the use of connection material for attaching and removing the same like zippered or strap connections, and the like. Optionally, user interface support materials or features can include combinations of materials having various stretch and support properties, as well as reinforcing members like straps sewn within an interface region oriented to provide increased support for the user, and/or for enhanced comfort.

Seal frame 2832 can further include a pair of lateral extensions or wings 2833, which can each include two or more restraint connectors 2836 formed in each wing as a pair of bends 2836 defined along the outboard extents of each wing. Seal frame 2832 can optionally include a front extension or head 2834, and a rear extension or tail 2835. The head and tail extensions can cooperate to form a natural bias for the seal frame 2832 in an installed state on a DAP System 2840 and enclosure 2810 when the enclosure is inflated based on tail 2835 having a gap defined therein that is filled or covered by a shield 2835' while head 2834 forms a corresponding gap that can be left open or unfilled. As such, during use when installed on a DAP System 2810, a portion of applied pressure exerted against the enclosure 2810 can be applied against the shield 2835' and thereby exert an outward or upward force against the tail without a corresponding counteracting force or a lower counteracting force being applied for the open gap at the head. In other words, the tail can be urged upward away from the enclosure and the head can be angled a similar amount downward toward the enclosure. A minor forward pitch bias can thereby be imparted to the seal frame during usage, which can be a desired affect for encouraging the user to exercise harder for the corresponding forward tilt motion. The rear shield can have a greater surface area than the front extension 2834 which may further be used to bias the tilt forward and promote toe strike ambulation.

In addition, each of the head 2834 and the tail 2835 can also provide benefits for functioning as bloom shields to reduce or prevent potential enclosure 'bloom' or bulges from occurring immediately in front of or behind the user. Enclosure bloom or bulges can occur during inflation or use of the DAP System 2810 and at lower height setting, such as in some implementations along hoop or curved edge portions including along a low hoop stress zone extending in the fore-aft direction of the enclosure about the seal frame 2832. For such arrangements, bloom can occur responsive to inward resistance or force being placed against the enclosure along or proximate its hoop or curved edge portions and toward its interior region, and/or responsive to the enclosure encountering point specific inflation limitations along its hoop or curved edge portions. Meridional stress line aspects and features of inflatable enclosures described herein and along with related applications can create regions of low hoop stress that can include series of low hoop stress segments intermixed with compressive tangent stress segments that form a wrinkle or fold in a transverse direction of the enclosure along a curved edge region of the enclosure.

Seal frame 2832 can be attached to the enclosure 2810 along the perimeter of the top port 2830 or at one or more discrete points on the top port via inner loop 2838 and thereby extend around a user during use of the DAP System 2810. The seal frame 2832 extensions, sub-portions and subcomponents including the inner loop 2838, wings 2835, head 2834, and tail 2835 can be formed as a unitary, rigid device, and thereby provide benefits and perform supplemental functions based on the structural strength and integrity of the unitary seal frame. For the example shown along with FIGS. 4A to 6B, seal frame 2832 can be formed as a weldment for rigidly attaching each of the seal frame subcomponents and extensions to each other, such as an arrangement of bent and contoured aluminum or steel tubes, for instance. As shown, such tube or rod-like structural components can be combined to form a contoured seal frame 2832 having a general form resembling a saddle shape, which can provide various beneficial features for use with a DAP System 2810. Alternatively seal frame 2832 can avoid having wings and flexible vertical restraints may connect directly to the inner loop 2838.

For example, contoured or saddle-shaped inner loop can have a pair of front and rear inflection points at central regions of the inner loop that are generally aligned with a lengthwise longitudinal axis of the enclosure when installed thereon during system use. The inner loop can be curved downward toward the enclosure from the pair of front and rear inflection points. Further, the downward curve can correspond with the radius of curvature along a top curved edge region of the enclosure, which can help the top frame remain centered and properly oriented on the enclosure during use along with encouraging the top frame 2832 to float on the enclosure. In addition, the saddle-shaped inner loop can include an opposite lateral pair of lower inflection points around a midlength of the center loop. Each of the lower inflection points can be centered along the side portions of the center ring and perpendicular to the front and rear centered inflection points. The center ring can have bends corresponding with the inflection points to form the saddle shape, which can provide a comfortable interface around the user arranged for providing a floating support for applying unweighting assistance to the user.

The saddle shape can be arranged to conform with the shape and curvature of enclosure 2810 across its width/depth when inflated. Further, the saddle shape can provide a natural reference and visual indicator to the user for maintaining proper alignment and orientation with the enclosure during use, as well as provide a natural interface feel for the user as being integrally connected with the seal frame. In addition, the front curvature can provide easy control access to the user for adjusting orientation and tilt as desired by the user.

With particular reference now to FIGS. 5A to 6B, seal frame 2832 is shown in an installed state as part of an example DAP System 2840. As best viewed in FIG. 5B, the pair of lateral wings 2833 provide an opposing pair of extended, rigid attachments for connecting the seal frame 2832 to each of the vertical lifts, 2896, 2898 via a pair of flexible, high tensile strength restraints 2870 for each lift. Each wing 2833 forms a pair of restraint connectors 2836 at its outboard end that maintain attachment with a front restraint within a front restraint connector and attachment with a rear restraint within a rear restraint connector and do so at an angle for each restraint connector that is oriented toward the corresponding lift. As such, when placed under tension, each of the restraint attachments for the corresponding restraint connector are urged firmly into engagement with the appropriate restraint connector with minimal misalignment and potential adverse effects. Each pair of restraint connectors 2836 for each wing 2833 are spaced apart in the fore-aft direction along the corresponding wing, and each wing is further spaced apart for corresponding attachments with the center ring 2838, such that large moment arms can be applied between each corresponding vertical lift 2896, 2898 and fore-aft connections to the center ring 2838 of the seal frame 2832 for imparting effective pitch control to the seal frame based on potentially adjustable lengths of the each restraint 2870. Note, restraints need not be adjustable in length in order to provide a suitable skeletal framework.

However, each vertical lift 2896, 2898 can be centered in the fore-aft direction along the seal frame 2832 for acting as a pair of pivots that enable the user to impart pitch rotations of the seal frame 2832. In other words, adjustable restraints lengths, should the restraints be adjustable, in combination with spaced apart wing attachment moment arms allow provide for pre-adjustable tilt or pitch rotation bias to be set according to user preferences or other factors. In addition, centered attachments with each of the vertical lifts, and relatively short spans across each of the vertical lifts separating attachments between each pair of restraints for each lift, provide 'pivot' points allowing the user to modify pitch rotations on demand, or simply provide pitch rotation during natural movement about the vertical lifts acting as a pair of lateral pivots. Further, it is understood that an additional benefit for a zero to low hoop stress zone along a curved, upper edge portion of the enclosure allows for both pre-set pitch rotations and for on demand user-modified pitch rotations.

Figures 6A, 6B:
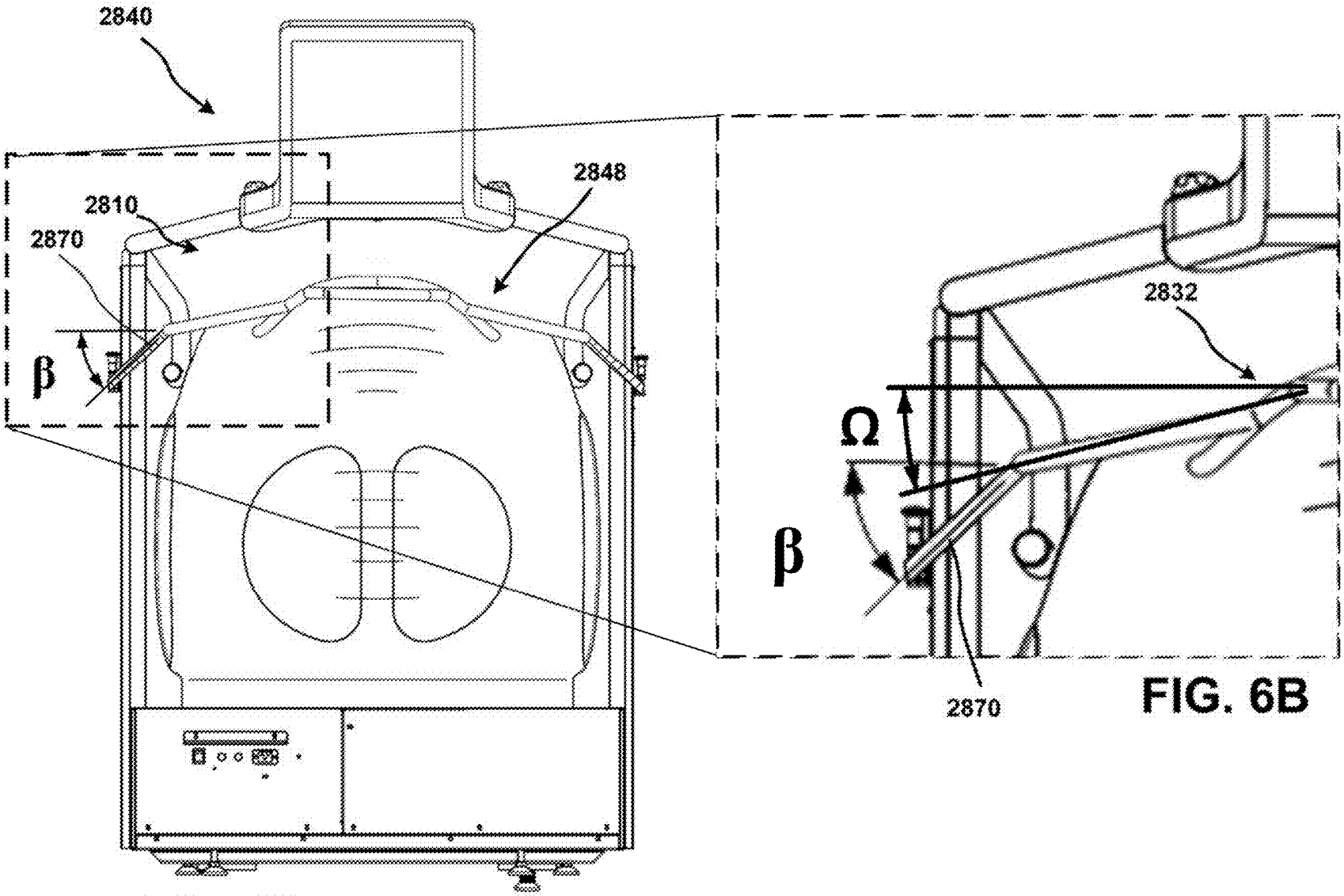
FIG. 6A is a front view of the DAP exercise system, seal frame structure and seal frame of FIG. 5A.
FIG. 6B is a close view of a portion of the DAP exercise system, seal frame structure and seal frame shown in FIG. 6A as indicated in FIG. 6A.
Figure 7:
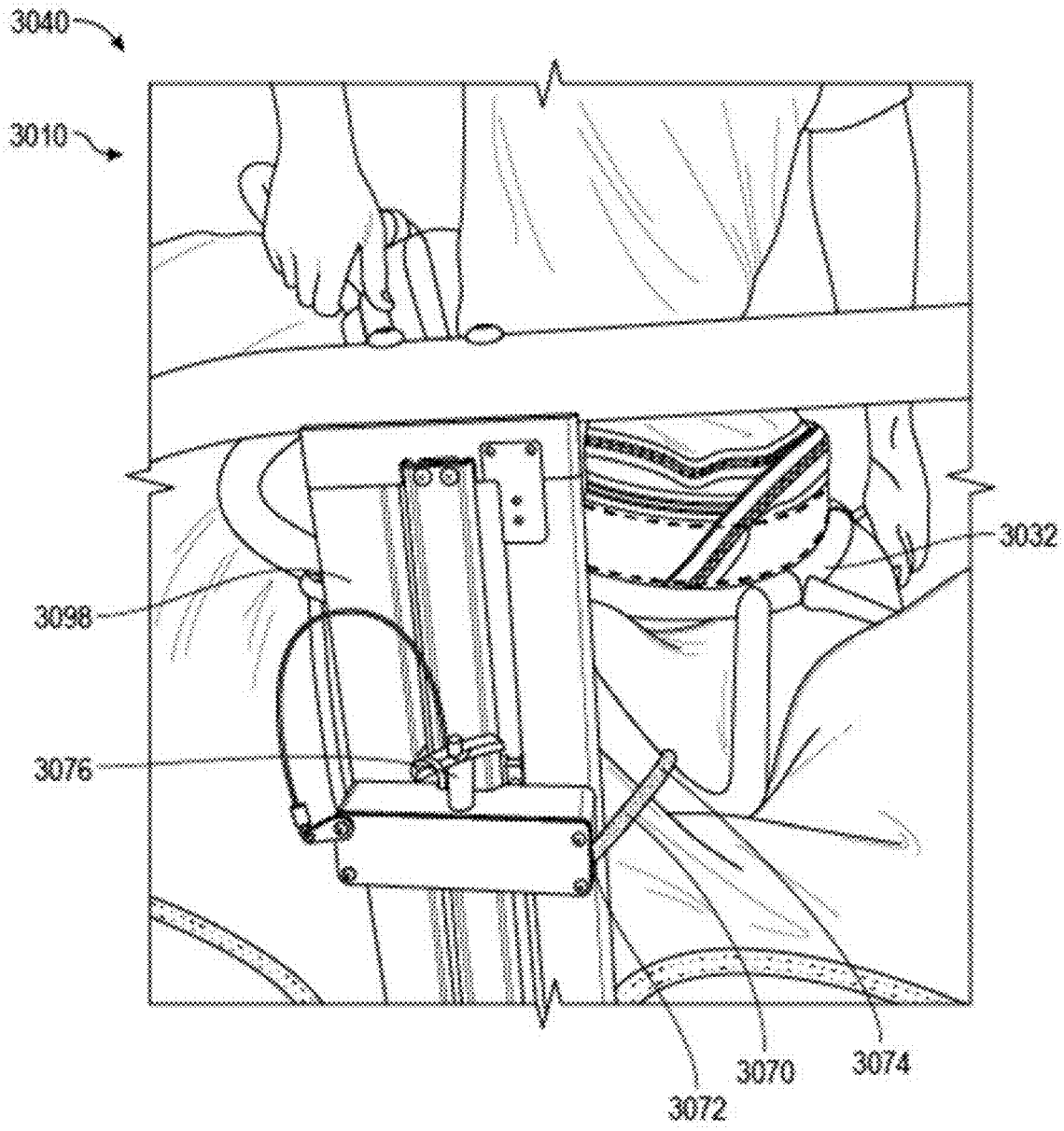
FIG. 7 is a right perspective view of a portion of the DAP exercise system and seal frame structure of FIG. 5A.
Figure 8:
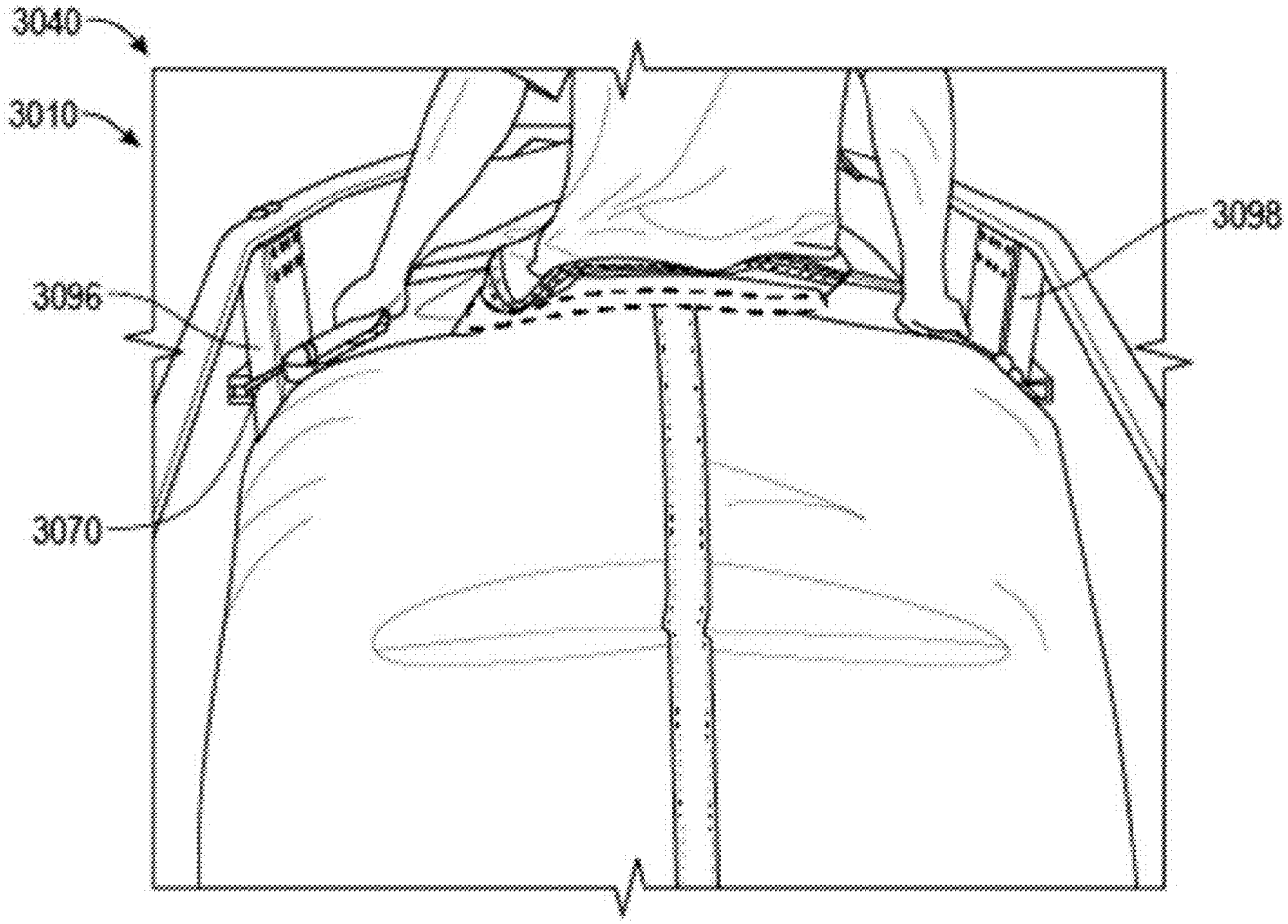
FIG. 8 is a rear view of a portion of the DAP exercise system and seal frame structure of FIG. 5A.
Figure 9:
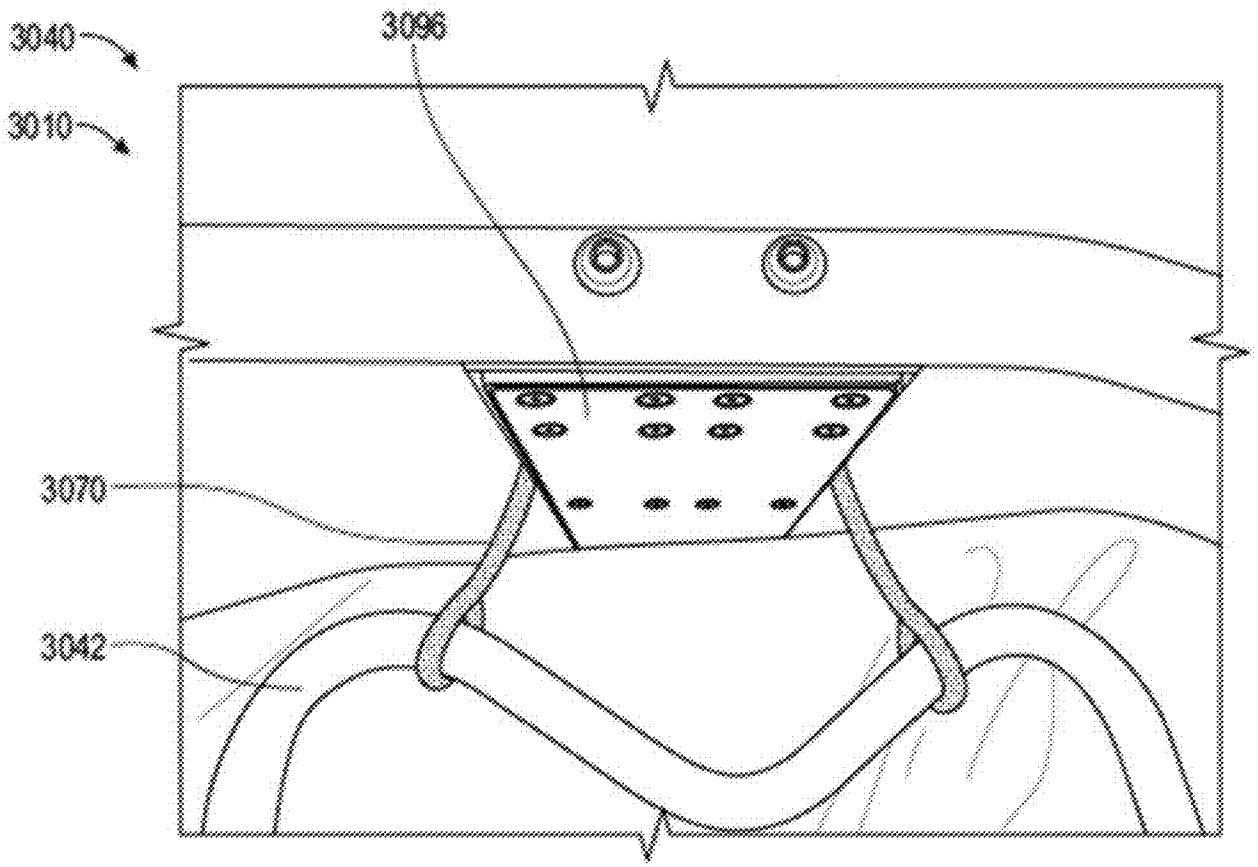
FIG. 9 is a close, top view of a right side portion of the DAP exercise system and seal frame structure of FIG. 5A.
Figure 10:
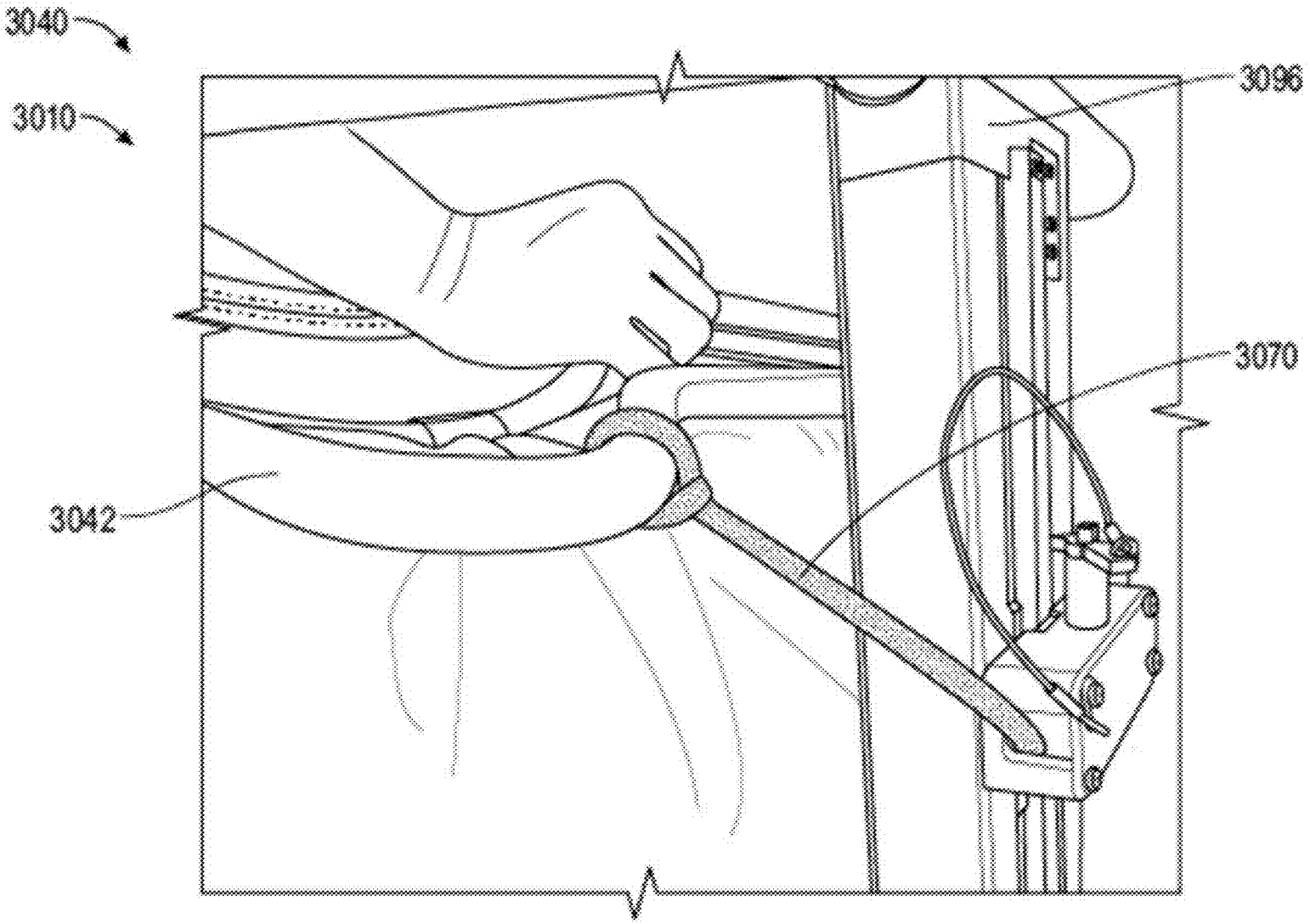
FIG. 10 is a close, front perspective view of a left side portion of the DAP exercise system and seal frame structure of FIG. 5A.

Wings can be angled on either side of the intended attachment point for the flexible restraints, thus keeping the attachment of the flexible restraints approximately fixed in a known location. The extended length of the wings toward the lift column can vary from zero (i.e. attached directly to the inner loop of the seal frame and avoiding wings entirely), to proximate the carriage on the lift column, thus putting the flexible restraints in a vertical orientation between their connection to the seal frame and the lift carriage. Several factors can indeed be considered in view of the geometry of the length of the flexible restraints, the extension distance of the wings toward the lift columns, the position and orientation of the carriage. One advantage of a flexible restraint is that in moving the lift carriage down, should an individual such as a technician or a child be stuck underneath the seal frame as it lowered, the vertical displacement play of the flexible restraints, i.e. moving from ~45 degrees (not shown) to the 45 degrees shown in FIG. 6B, gives a tactile warning sign to the individual to trigger an emergency response. For example, if the vertical restraints have a length of 12 inches, the vertical change between lowest and highest position of the seal frame for a given height of the carriage is 2×12 in sin (45 degrees) or about 17". That is to say, at the lowest carriage position on the vertical lift, an object about 17" tall would not be crushed by the downward motion of the lift column carriages.

At the same time however, this introduces a vertical movement of the seal frame during setup, whereby the inflated position of the seal frame can be this same distance (say 17") below where it will end up after inflation. This can make it awkward to connect the user to the system, and thus a method can be introduced whereby the system compensates for this vertical play in the lift system and brings the carriage artificially higher by a certain amount for attachment of the user, and then after confirming attachment, lowers itself back down the correct position for operation of the DAP machine. Aspects and features pertaining to such methods and related actions are described in an application filed on even date herewith incorporated herein by reference and identified above by Ser. No. 17/964,849 and title as "DAP Platform, Integrated Lifts, System and Related Devices and Methods." In order to avoid massive swings in the vertical play, it can be desirably to make the flexible restraints shorter which would require the wings to be longer. At an extreme, if the wings extend less than to above the lift carriage, a distance must be bridged horizontally by the flexible restraints. If the flexible restraint length is just equal to this gap, when the bag is inflated, an extremely high tensile stress (like a man on a tightrope) will be induced on the flexible restraints and cause susceptibility to failure of the flexible restraint. With roughly 1000 lbs of vertical restraining load at the lowest position and a deflection angle of the seal frame due to stretch in the flexible member of say 5 degrees, this tensile stress would be 17,000 lbs which is astronomical and would cause failure in the lift restrain over time.

One way to resolve this would be to extend the wings to the lift columns and flip the lift columns around so the carriage is on the inside surface of the lift columns. However the carriage on the inside can damage the enclosure during to repetitive vertical movement as discussed earlier. Another alternative could be extending the wings out beyond the lift column to an external carriage; however this puts a high bending moment and stress on the wings. Further still, this puts the wings in the proximity of other metal, and because of the flexibility in the restraints, this will likely lead to metal contacting metal and scratching or marring surfaces which can rust over time. Thus, it can be advantageous to keep the wings far enough away from the lift columns such that they cannot contact the lift columns and chip paint or the like. Therefore it can be desirable that the span of the wings is less than the inner distance between the vertical lifts and that the length of the flexible restraints is such that one side of the wings is prevented from contacting its nearest vertical lift due to the opposite restraint reaching its full length and not stretching further.

FIGS. 7-10 show movement extremes allowed for the wings including lateral movement right up to the point of but not inducing contact. Therefore the length of the flexible restraints plus the length of outside of one wing to outside of the other wing can be less than the distance from the attachment to one side of the lift carriage to the inside face of the opposite lift column, thus avoiding the possibility of the seal frame contacting any lift column during operation. A final force can be discussed which is the bending moment applied to each lift column due to the lateral loading imparted on the lift column by the enclosure. If only supported at the base and at the handrail connection as shown in FIG. 6A, or only by framing not proximate the user seal as in other DAP systems, the lift column effectively is acting as a cantilevered beam off the base because the handrail is lending very litter lateral stability.

The connection method to the base as shown can be very strong as discussed in the related, however the flexible restraints plus wings plus inner loop, i.e. the seal frame, can form a second connection that can greatly reduce the loading at the base. This horizontal force loading is carried laterally from one lift column to the other via members in tension. If the wings are extended close to the carriage, the flexible restraints are more vertically oriented and thus cannot help share this lateral load with the base connection of each lift column. Therefore, it is further advantageous to limit the extension of each wing to be inboard of the corresponding lift column, so that a sufficient angle can be formed by the flexible restraint to support lateral loading AND vertical loading without developing too high of a tensile force. As discussed, many angles were tried and while angles between 30 and 60 degrees did produce acceptable results, the optimal loading was developed at approximately an angle of 45 degrees of the flexible restraints.

With specific reference to FIGS. 6A and 6B, the use of bilaterally extended rigid wings 2833 as attachment points at their extents with each of the vertical lifts 2896, 2898 based on their restraint connectors 2836 allows for customized horizontal and vertical restraint angles between the seal frame 2832 and each vertical lift 2896, 2898, which as shown and identified as Angle β can be about 45 degrees in a balanced component force arrangement and preferably range between about thirty degrees and sixty degrees depending on tilt or pitch rotation preferences and 'float' movements during use. Such an arrangement laterally applies continual self-centering loads against the seal frame 2832 from opposite sides and across its width while avoiding excessively high vertical component loads being applied to the vertical lifts and restraints 2870. FIG. 6B further depicts a downward angle θ2 that can be provided between a middle region of the user seal and the restraint connectors and connections with flexible tensile restraints at opposite lateral edge regions of the seal frame. As discussed further below along with additional example arrangements for user seals and seal frame structures, a middle region of the seal frame can be vertically offset from connections at opposite edge regions of the user seal, which can provide benefits including greater arm swing space.

Each restraint 2870 can be formed from a flexible, high tensile strength component, such as various synthetic fiber-based ropes, straps, and the like made from a range of materials including polyester, polyethylene, composite and/or metal reinforced fibers. The use of flexible, high tensile strength connections applied across the width of the DAP System and at opposite sides of the seal frame 2832 can provide significant advantages for DAP System arrangements and operations in addition to much reduced cost and manufacturing and assembly complexity. In particular, DAP System 2840 can provide for enhanced freedoms of movement and flexibility for the user during use along with unweighting support, as well as do so in a safe environment and conditions.

Referring now to FIGS. 7 to 13A, example usage benefits and freedoms along with corresponding safety features are shown and displayed for a DAP System 3040 similar to the arrangement discussed above along with DAP System 2840 and seal frame 2832. As such, like numbers refer to like features.

Figure 11:
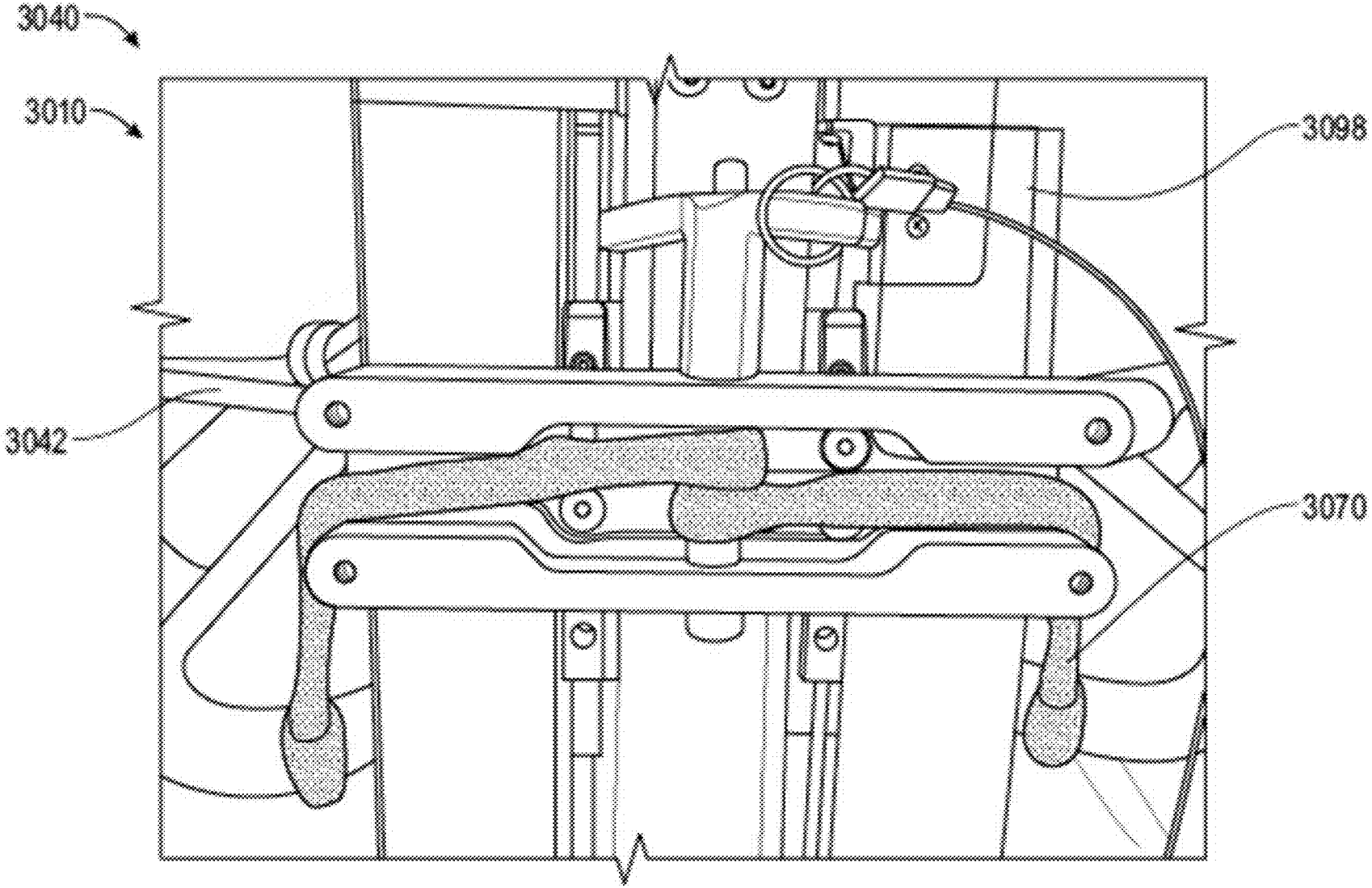
FIG. 11 is a close, left side perspective view of a portion of the DAP exercise system and seal frame structure of FIG. 5A showing a carriage of the left vertical lift having a quick disconnect pin connector installed in a pin channel of the carriage connector.
Figure 12A:
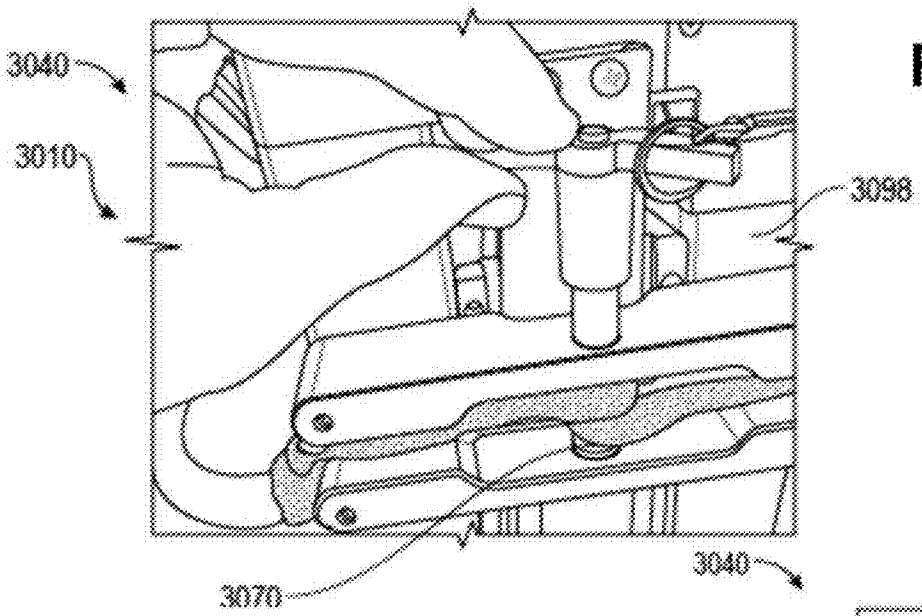
FIG. 12A is a close, front right perspective view of the portion of the DAP exercise system and seal frame structure of FIG. 11 showing the quick disconnect pin placed in a release state and initial withdrawal thereof.
Figure 12B:
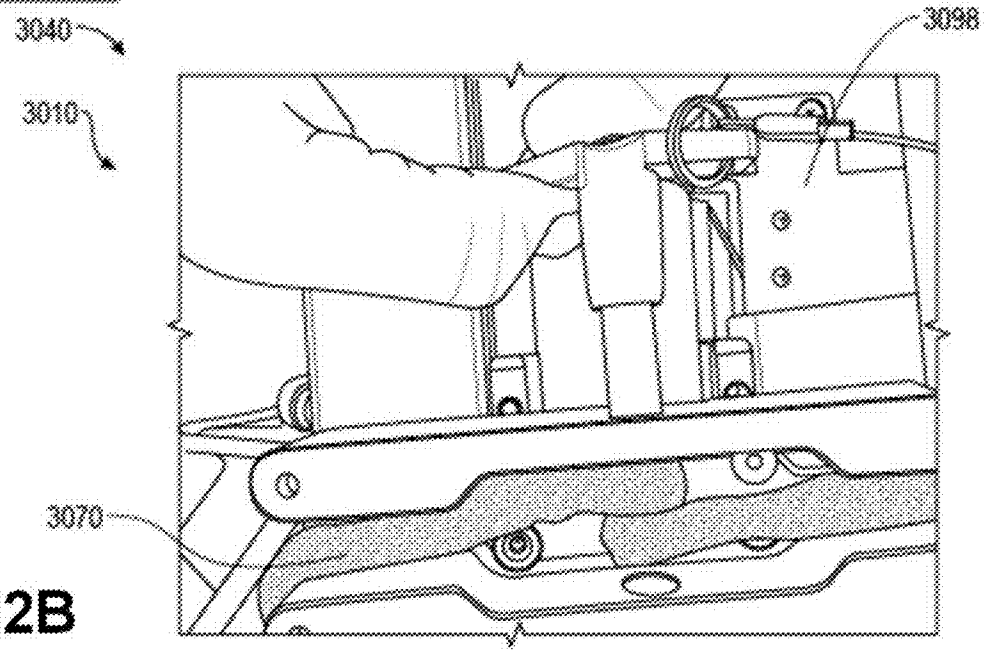
FIG. 12B is a close, front right perspective view of the portion of the DAP exercise system and seal frame structure of FIGS. 11 and 12A showing the quick disconnect pin further withdrawn from the pin channel.
Figure 12C:
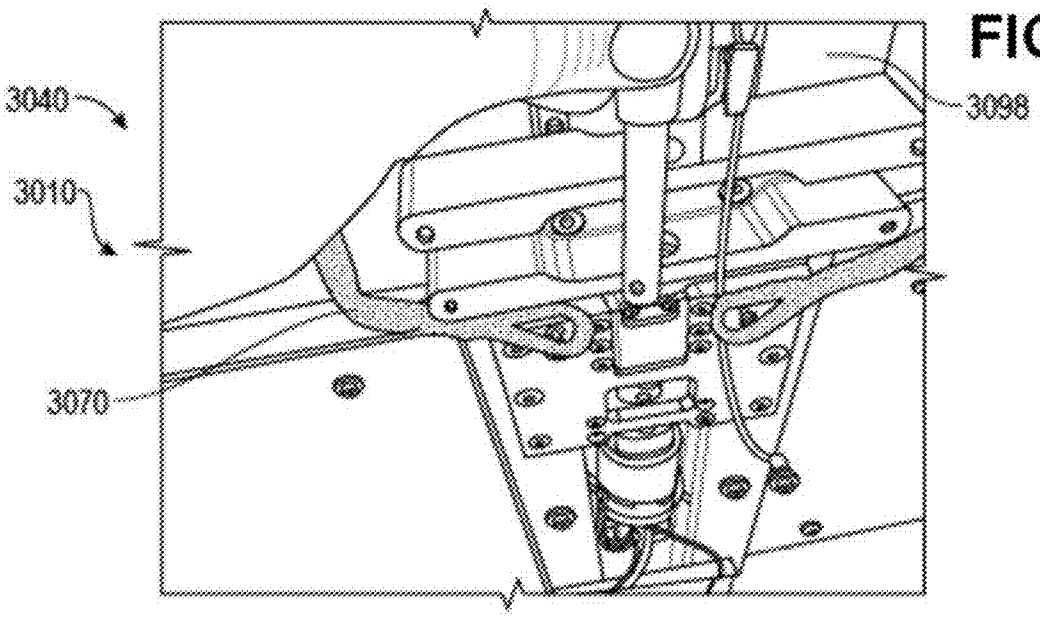
FIGS. 12C and 12D are close, upper right perspective views of the portion of the DAP exercise system and seal frame structure of FIGS. 11 to 12B showing the quick disconnect pin fully withdrawn from the pin channel.
Figure 12D:
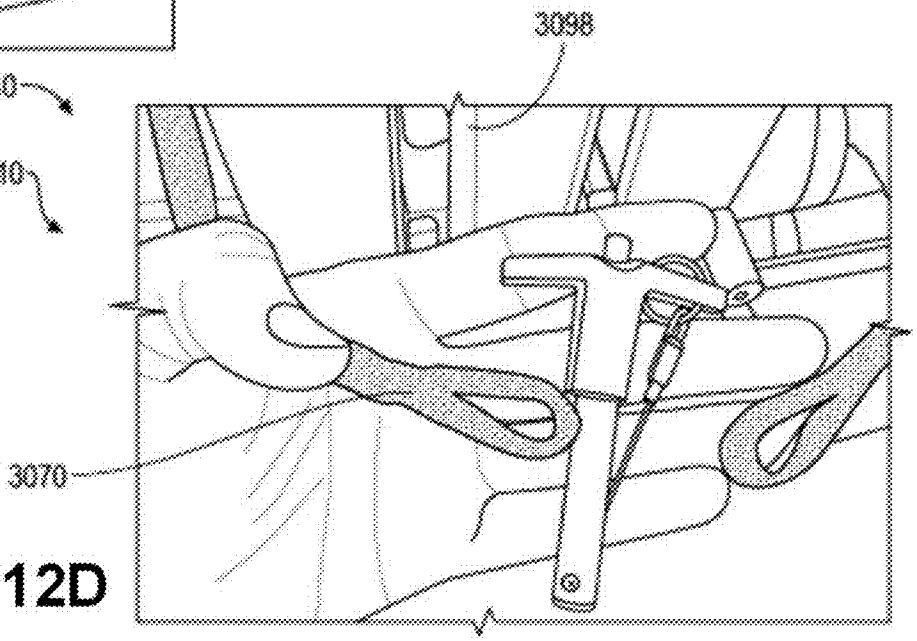

With particular reference to FIGS. 7 & 9-11, DAP System 3040 can further include a quick release device, secure coupling connector or simply releasable coupling 3076 for releasably securing restraint connections 3070 at each lift device 3096, 3098, for which the releasable coupling 3076 can include a detent release pin 3076 at the corresponding carriage interface. Each restraint 3070 can be arranged for quick installation based on the use of restraints having woven end loops or similar looped end features, which can permit quick attachment to a corresponding wing 3033 at restraint connector 3036 at one end and attachment to a corresponding lift carriage via release pin 3076. As best shown in FIG. 11, detent release pin 3076 can retain multiple restraint connections with the same vertical lift and thereby allow for quick release of all connections with a lift in the event of emergency or for safety purposes, for example if there were loss of power to the system and the user needed to get out. A quick release device can be a pin, screw, carabiner clip, or latch, or knot, or cam lock, or any other as kind of restraint that can secure one end of the flexible restraints. The release can be limited to one release per flexible restraint, or one release can release all restraints. The location for the release can be on the carriage as shown or can alternatively be somewhere on the seal frame or along a length of a restraint connector, such as an intermediate connection between two restraint connector sections.

Further, the release mechanism can similarly be located on the carriages as shown or otherwise on the seal frame, or at point in between. For example, each flexible restraint could be split into two pieces that are interlocked with a quick release mechanism like a carabiner. It is preferable that the release be dual action to avoid accidental activation by a third party or the user, but this is not necessarily so, and it is preferable that fewer release mechanisms as possible be activated. Two such release mechanisms are shown in FIGS. 7 and 11-13A, but these could be combined into a single point of release if for example the release were located on the seal frame and the two pins were connected with a cable such that release of a main central pin pulled out each of the secondary release pins.

The release, being activated by a dual action with one hand is preferable as the release can act as a safety mechanism to avoid a situation where the user is stuck in the lift system, with the lifts being non-operable, and the user needing to get out. The release therefore is preferably activated by a third party or by the user. As shown the lift is a pin with detent that captures loops in one end of the vertical restraints. When released, the pin slides out through the loops and immediately the floating seal frame is disconnected from that lift column. The pin can have a tapered end or the loops can have forming reinforcements that keep the loop shape, so that re-formation of the release assembly is quick and easy.

Figure 13A:
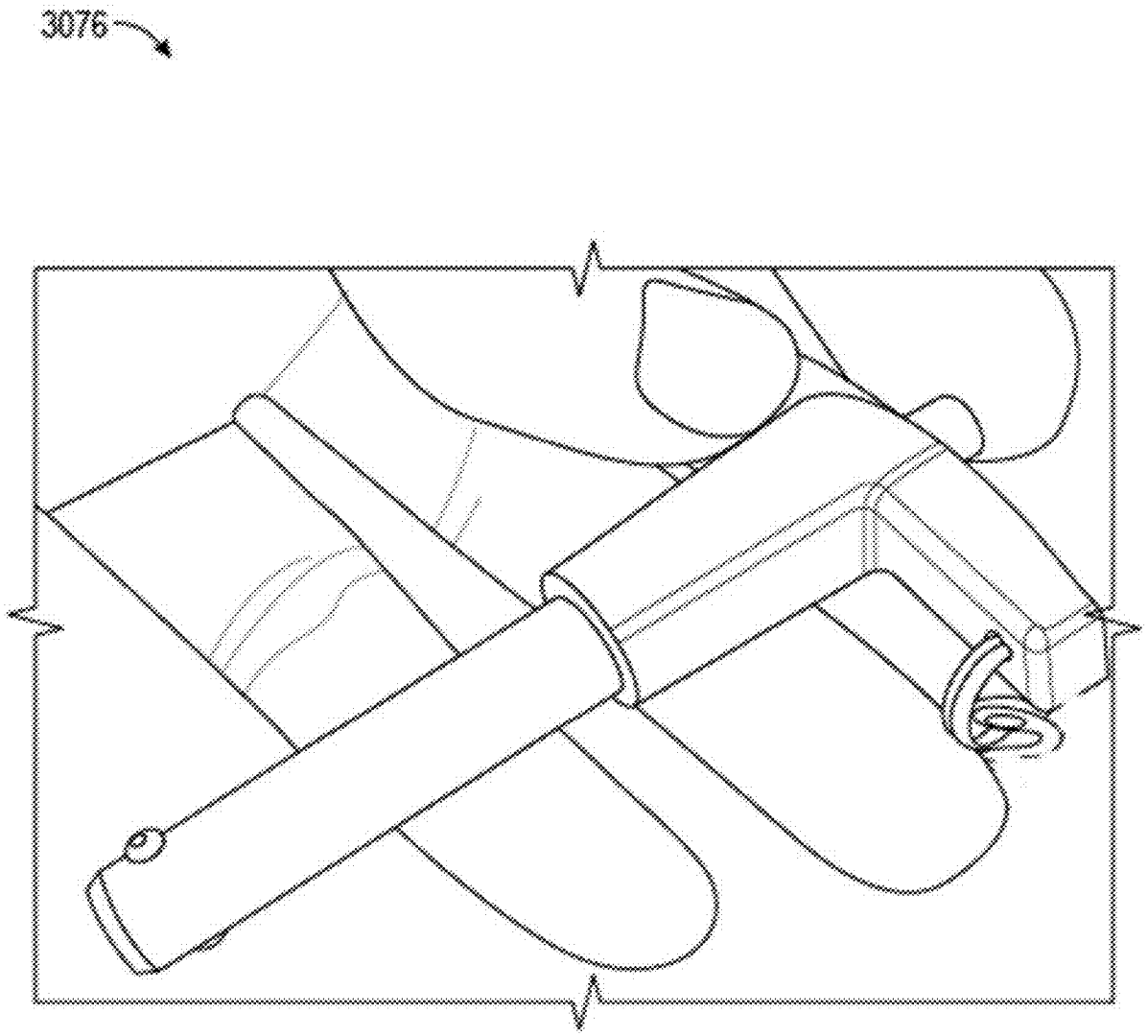
FIG. 13 is a close perspective view of the quick disconnect pin of FIGS. 11 to 12D.
Figure 13B:
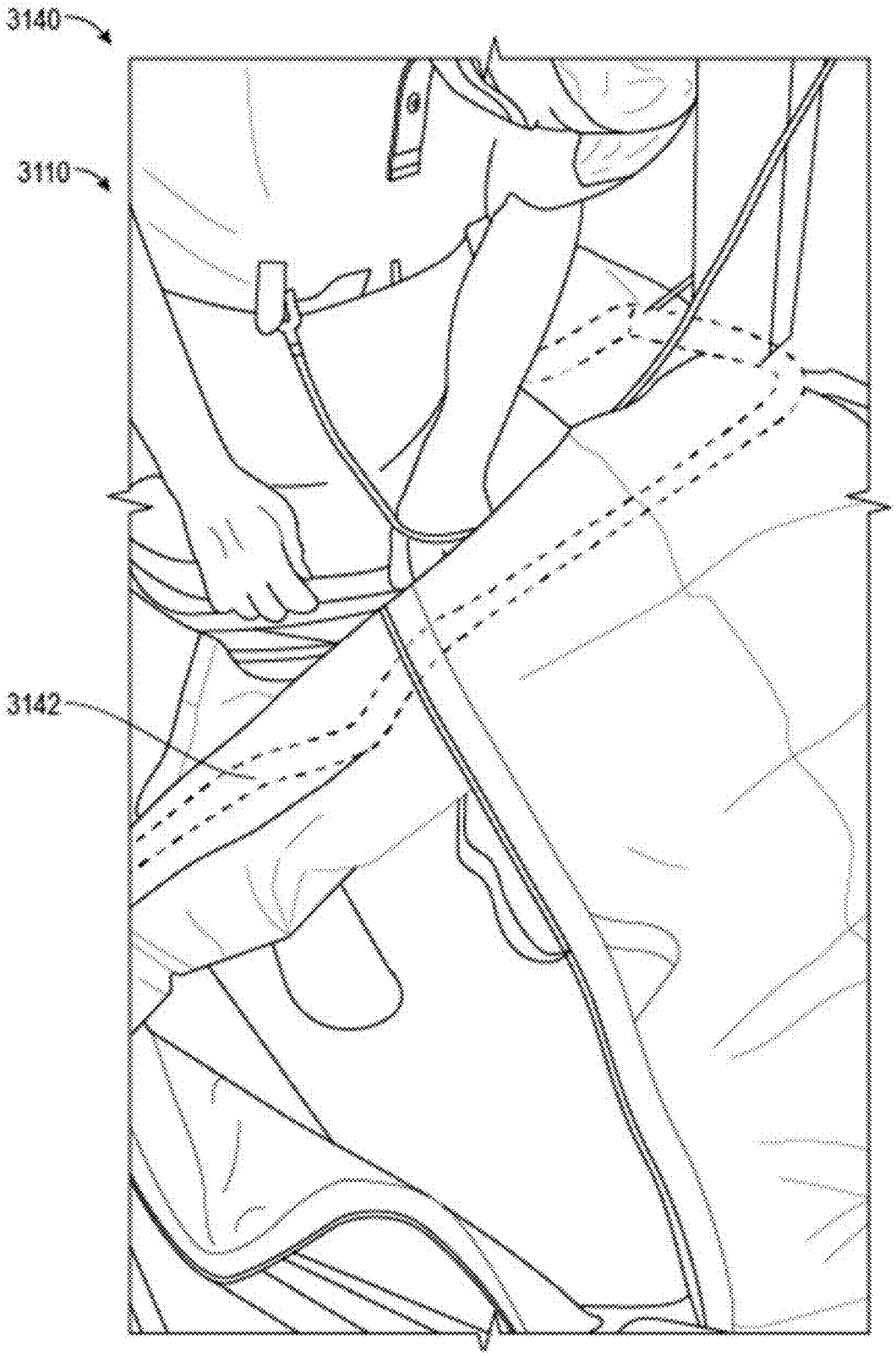

Referring now to FIG. 13B, a single release action is shown for release of an alternative seal frame arrangement 3142, which includes the same arrangement as shown in FIGS. 7 & 9-11 for use of single releasable pin engaging a corresponding pin opening in each carriage for securing a carriage end of each restraint with the carriage connector. As shown, user release of a single pin at either carriage can allow for release of the seal frame 3142 with the selected carriage for the released pin, such that the seal frame can tilt downward at the released lateral edge portion for enabling the user to disconnect the user seal interface and step out of the top opening and seal frame. As such, in the event of DAP system power loss, release of a single pin can allow for quick and easy exit for the user without requiring full release and disconnection of the seal from both carriages and both lifts.

With particular reference to FIGS. 7 to 10, significant movement freedoms and flexibility can be provided via DAP System 3040 for the user with a floating seal frame arrangement. As shown, the user can selectively modify tilt rotations of the seal frame 3032 on demand during use along with effecting lateral movements (L-R) across the width of DAP System 3040 and fore-aft movements of the same. The user can be allowed to sway laterally side to side as is common for natural walking gait mechanics, meaning the floating seal frame promotes better biomechanics as well. Such freedom of movement in an unweighting environments can be provided based on providing 'float' support for the user via the seal frame 3032 using an enclosure arrangement as described herein.

Thus, a floating seal frame arrangement can provide benefits in terms of safety via the natural vertical displacement that gives a warning to someone accidentally trapped underneath to activate an emergency shutoff, it provides better natural movement for the user, it avoids marring or banging between moving pieces of metal, it can assist in carrying very high lateral forces, and it can allow for tilt angles that can be induced to drive certain desired gait patterns. Multiple flexible restraints have been discussed and depicted, however the user shall also not that having one flexible restraint per side can also provide some or all of these advantages. Thus the number and exact connection location of each flexible restraint need not be limited to the description herein.

Figure 14A:
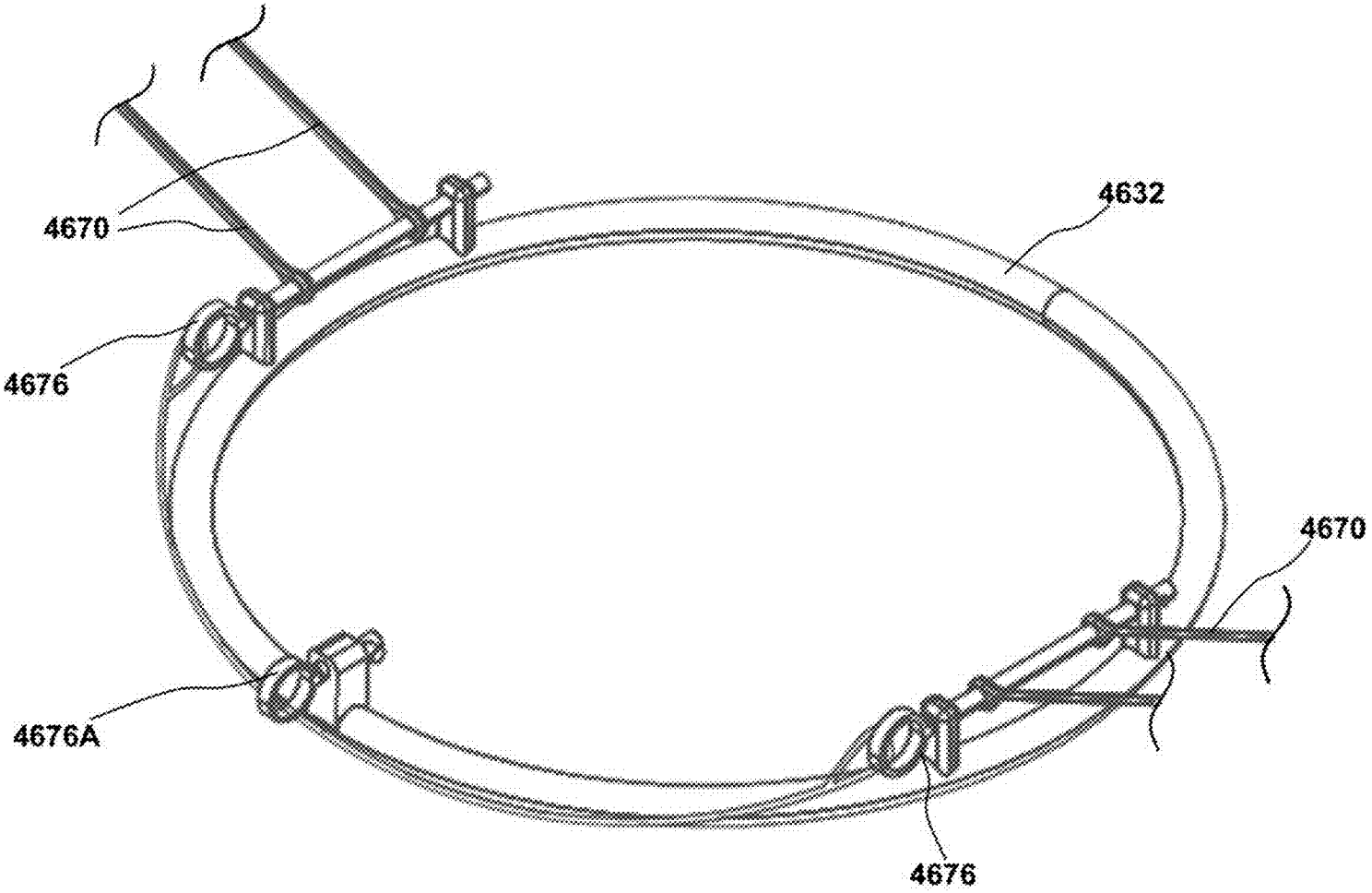
FIG. 14A is a perspective view of a schematic representation of an example seal frame of a seal frame structure having another quick release pin arrangement according to aspects and features described herein.
Figure 14B:
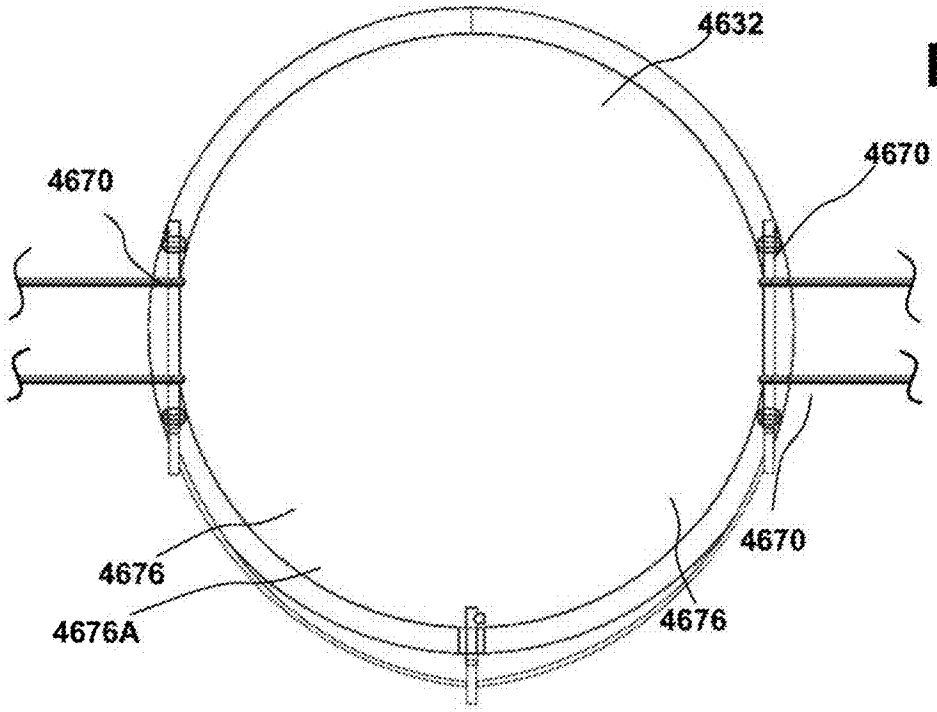
FIGS. 14B and 14C are top and side views respectively of the seal frame of FIG. 14A.
Figure 14C:
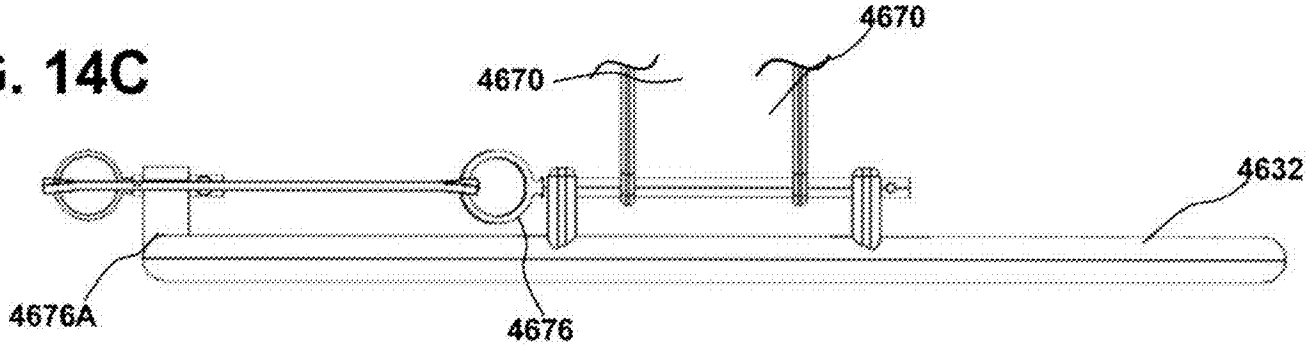

Referring now to FIGS. 14A to 14C, another seal frame 4632 is shown having another quick release pin arrangement that generally includes the same aspects, features and preferences of other seal frame arrangements and release pin arrangements as described herein except as noted below. Accordingly, like numbers refer to like features.

Seal frame 4632 can selectively include joint lateral connections at opposite lateral side regions with one or more flexible, high tensile strength restraints 4670 as has been discussed herein for selectively reinforcing the corresponding DAP System (not shown) and/or providing vertical height adjustments for the seal frame. Each of the opposing one or more restraints 4670 can be connected to the seal frame via a quick release pin 4676, which can optionally be tied to an overall system release pin 4676A. System release pin 4676A can be arranged to allow the user to quickly and simply withdraw the system release pin 4676A via withdrawal movement in a forward direction, for example, which can act to release each of the lateral quick release pins 4676 from connections with corresponding restraints 4670. In this manner, all connections between the seal frame 4632 and restraints 4670 can readily be released with a single motion. Alternatively, release pin 4676A can be omitted and each of the quick release pins 4676 can be activated independently to release the seal 4632 from the DAP system.

Figure 15:
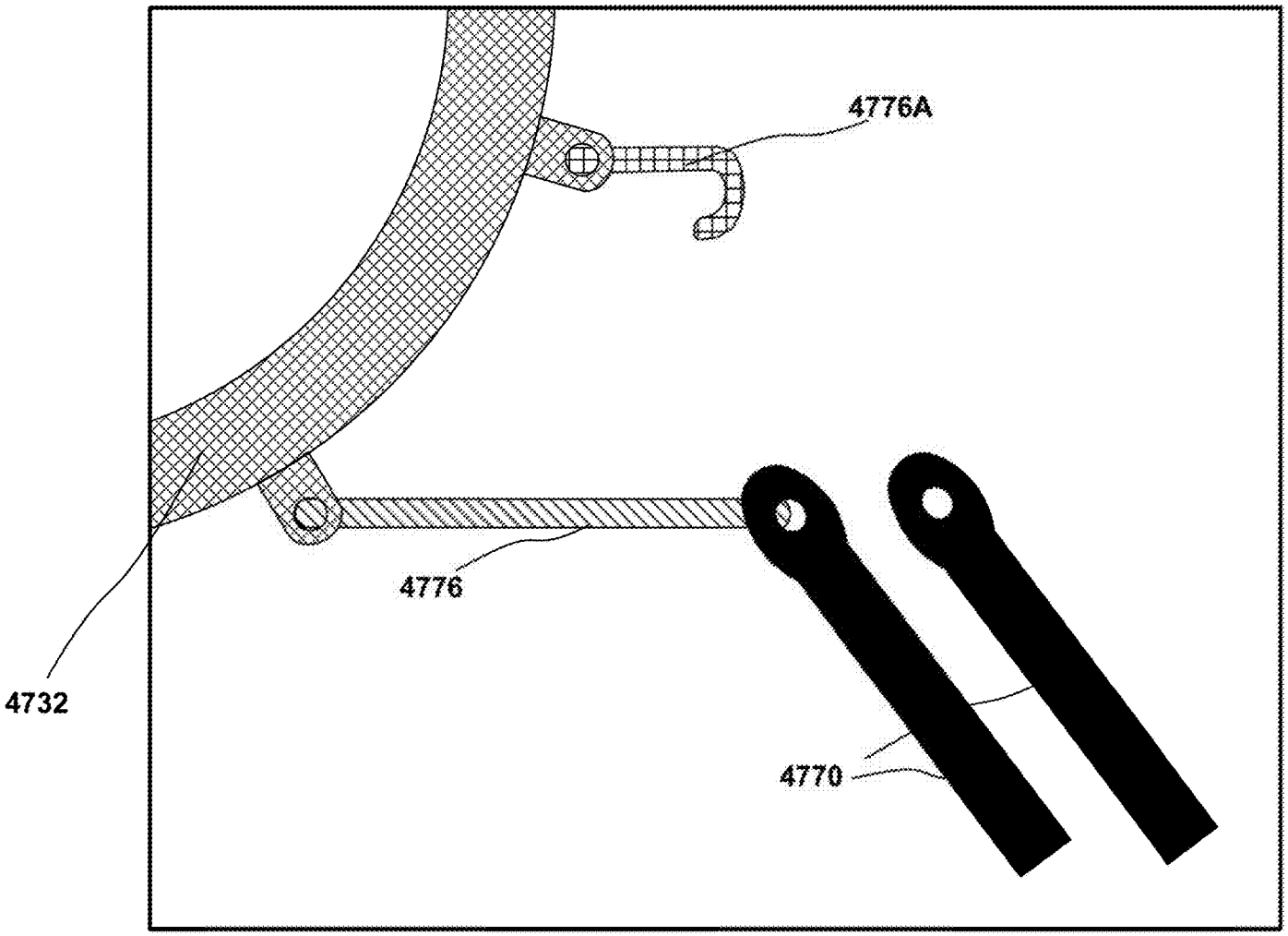
FIG. 15 is a top view of a portion of a further schematic representation of another example seal frame of a seal frame structure having a further quick release pin arrangement according to aspects and features described herein.

Referring now to FIG. 15, a further seal frame 4732 is schematically shown having another quick release pin arrangement of release pins 4776 that generally includes the same aspects, features and preferences of other seal frame arrangements and release pin arrangements as described herein except as noted below. Accordingly, like numbers refer to like features.

Release pins 4776 differ from other arrangements in that a single rotatable 'hook' or similar joining release 4776A is arranged on the seal frame 4732 at each lateral side for quickly releasing connections at each lateral side with one or more flexible, high tensile strength restraints 4770 connected thereto. In this manner and/or similar arrangements readily accessible to the user, selective connections established between the seal frame 4732 and left or right vertical lifts (not shown) can readily be disconnected. Such a release system can act as a gate latch or other latching system so that no pins are removed from the DAP system which might get lost. The release pin 4776, upon release, pivots away from the joining release 4776A, or latch, and one released from the latch, allows the restraints 4770 to slide off, thus disconnecting the seal frame from the DAP system.

Fixed Seal Frame Structure

Referring now to FIGS. 16A to 19B, a seal frame structure 3328 is generally shown that can be used with DAP Structure described herein or in related applications described at the beginning of this specification and incorporated herein by reference, which can include DAP System 2840 discussed above, and generally includes the same aspects and features of DAP System 2840 and other DAP Systems described herein and in the related applications except as discussed below. As such, like numbers refer to like features.

Seal frame structure 3328 includes a pair of opposing lifts 3396, 3398 that can be integrated into and/or secured to a corresponding DAP platform along opposite lateral sides thereof and attached at a midregion of the platform in the longitudinal direction of the DAP system. Each lift includes a carriage 3311 that can be vertically driven under control of the DAP system. A seal frame is connected at opposite lateral end regions to a corresponding lift and carriage via user-releasable couplings 3376, such as a user-releasable pin. Seal frame structure 3328 differs from seal frame structures described above in that the seal frame is rigidly connected with each carriage instead of via the use of flexible restraints. Further, the seal frame has contoured shape in the transverse direction such that a middle region of the seal frame is vertically offset from the carriage connectors at opposite side regions of the seal frame, which can conform well with an enclosure having a curved shape at a top portion of the enclosure and provide performance benefits during use. For instance, the vertical offset of the middle region can provide greater arm swing for the user. In addition, the middle region is configured for attachment to the enclosure about the enclosure top opening and user seal interface attachment location at an offset distance from the user seal attachment location. As discussed further below along with aspects and features of additional examples of seal frames and seal frame structures, offset spacing from the user seal interface can enable greater freedoms of movement for the user during ambulation.

As shown, seal frame 3332 can be released by the user in the event of power failure during use. The opposite end region carriage connectors of the seal frame include downward open or downward oriented U-shaped or C-shaped channels as can be seen in FIG. 16B, which are configured to nest with and receive corresponding extensions from each carriage to form a rigid connection therewith. The user-releasable couplings formed as releasable pins 3376 are configured for extending through corresponding securement holes through both of the seal frame and the mated extensions to secure the rigid connections therebetween. As such, in the event of power loss or other urgent circumstances, the user can remove the user-releasable couplings 3376 to disconnect the rigid connections with the carriages 3311 for lifting the seal frame off the carriages and lowering to the ground to enable easy user disconnection and exit from the DAP system.

Figure 16A:
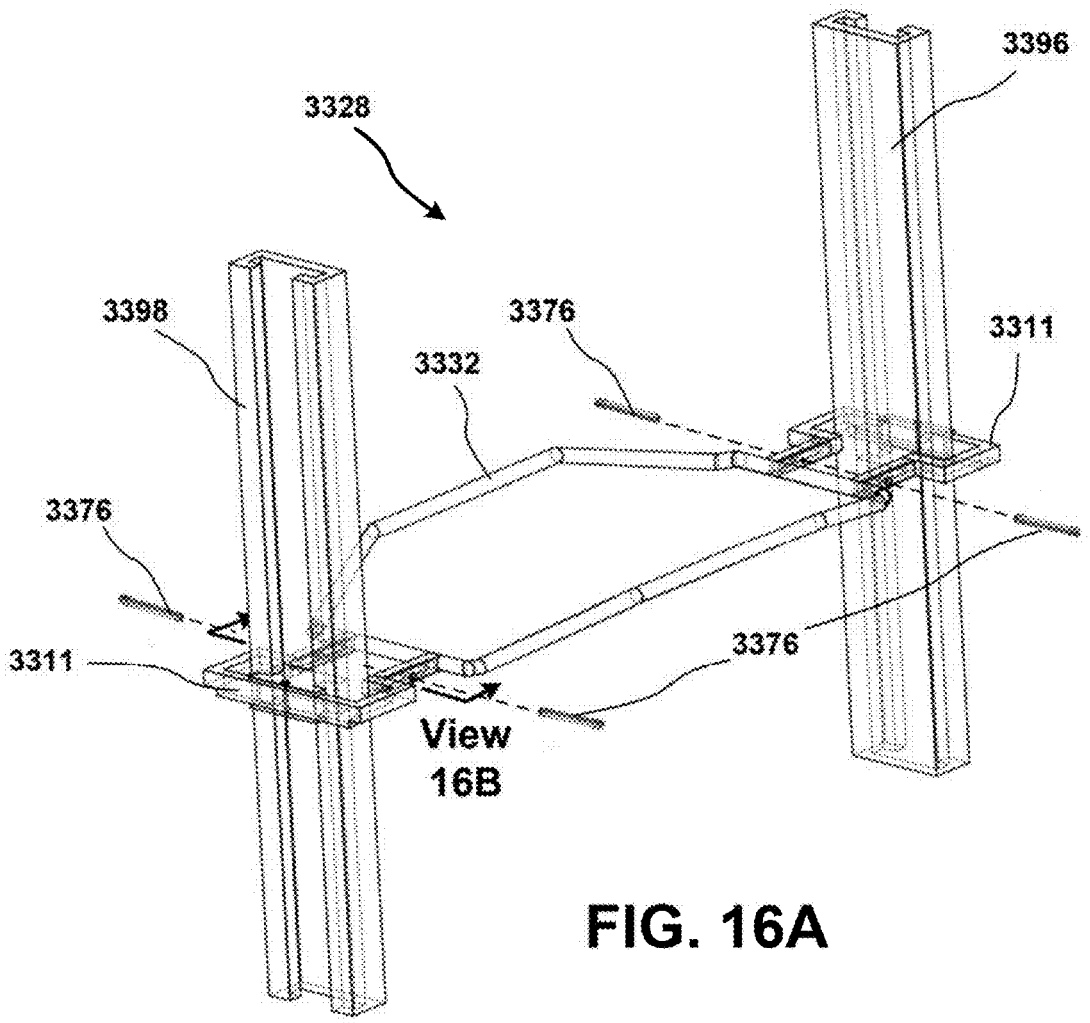
FIG. 16A a schematic perspective view of an additional example seal frame structure for a rigid connection arrangement for the seal frame and having a quick disconnect arrangement according to aspects and features described herein, which is shown with the carriage of each lift in a partially raised condition for the carriage of each lift.
Figure 16B:
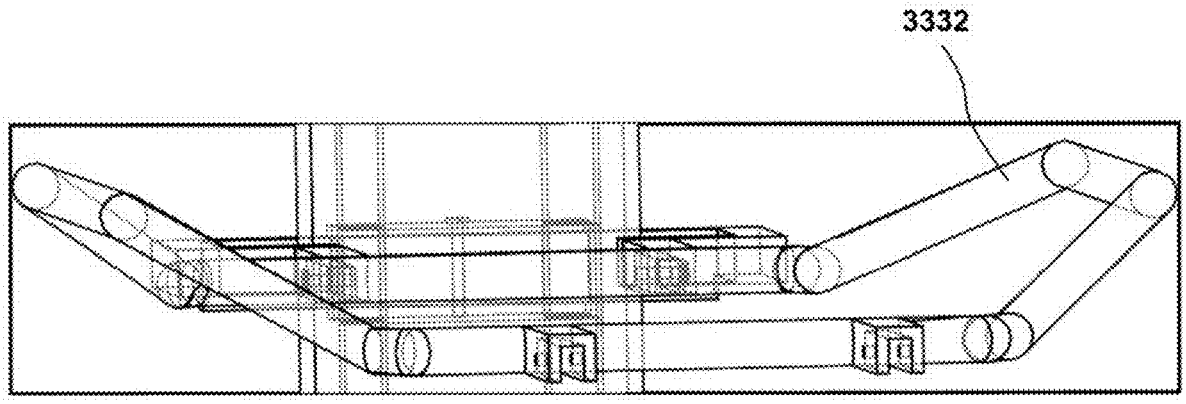
FIG. 16B is a side perspective view a portion of the seal frame structure from the viewpoint indicated on FIG. 16A.
Figure 18A:
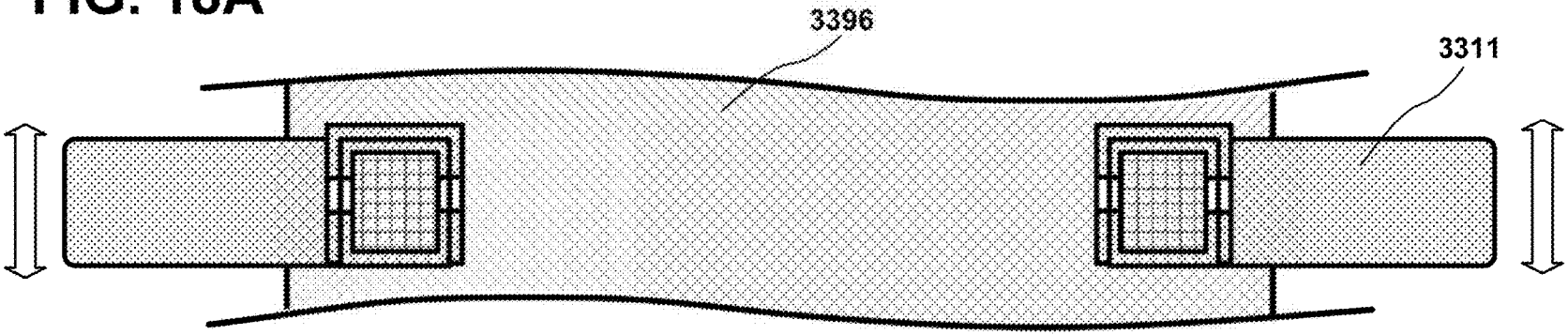
FIGS. 18A and 18B are close plan views of portions of the seal frame structure of FIG. 17A from the viewpoints indicated on FIG. 17A.
Figure 18C:
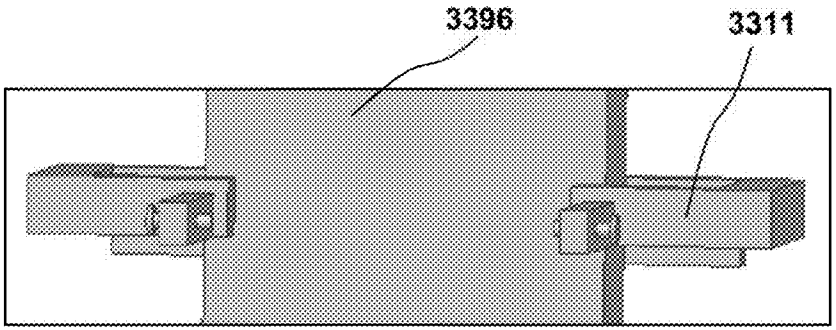
FIG. 18C is a side perspective view of the portion of the seal frame structure of FIGS. 16A & 17A including a portion of a lift and the corresponding carriage depicted with the seal frame removed.
Figure 18B:
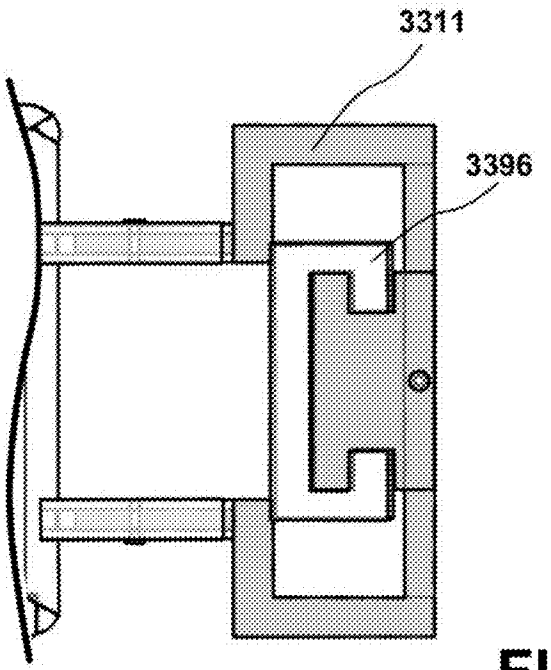
Figure 19A:
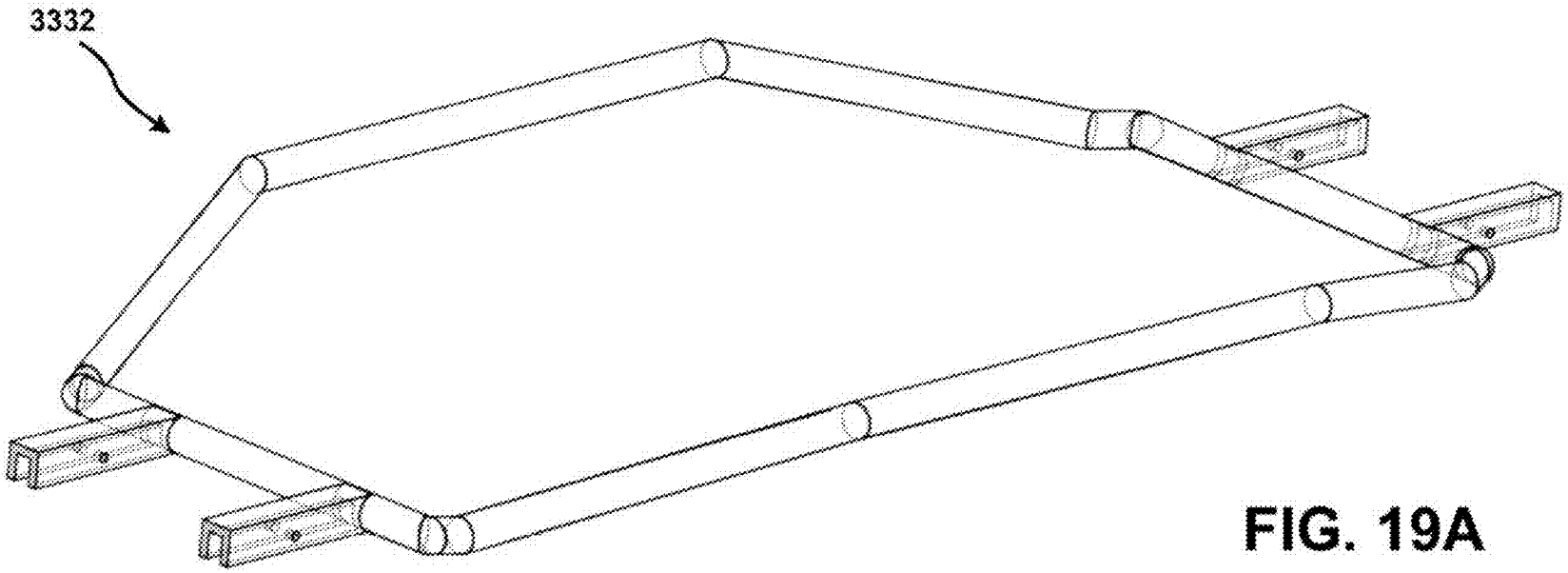
FIG. 19A is a perspective view of the seal frame of the seal frame structure of FIG. 16A.
Figure 19B:
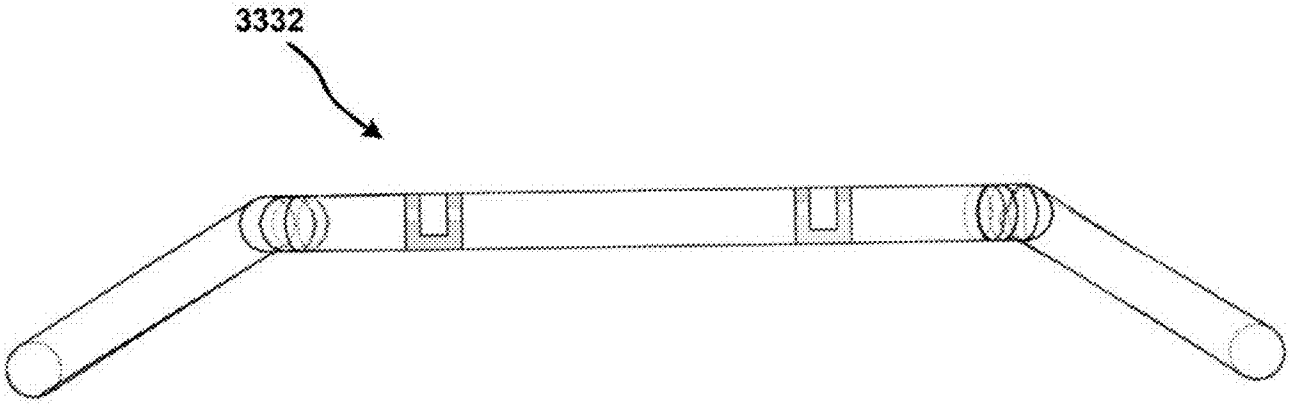
FIG. 19B is a front view of the seal frame of FIG. 19B.

As depicted in FIGS. 16A and 17A, such a rigid connection arrangement for the seal frame structure can operate the same or similar to operations described herein and in related applications for providing powered height adjustment operations for a fixed connection user seal arrangement, as well as for enabling manual release therefrom in the event of power loss.

Floating Seal Frame Structures With Shaping Members

Referring now to FIGS. 20 to 25D, a further example seal frame 3432 is generally shown for a seal frame structure 3428 that generally includes the same aspects and features described above for floating seal frame structure 2828 and seal frame 2832 except as discussed hereafter. Accordingly, like numbers refer to like features. Seal frame 3432 primarily differs from seal frame 2832, in that seal frame 3432 lacks an inner frame circle; Is configured for attachment proximate the top opening at a greater offset distance from the top opening and, in particular, at a greater offset distance from the user seal interface with the top opening; Has a more pronounced vertical offset between a middle region and edge region connectors; and Is configured for use with a pair of lateral shaping members for increased user mobility during ambulation in lateral directions.

Figure 20:
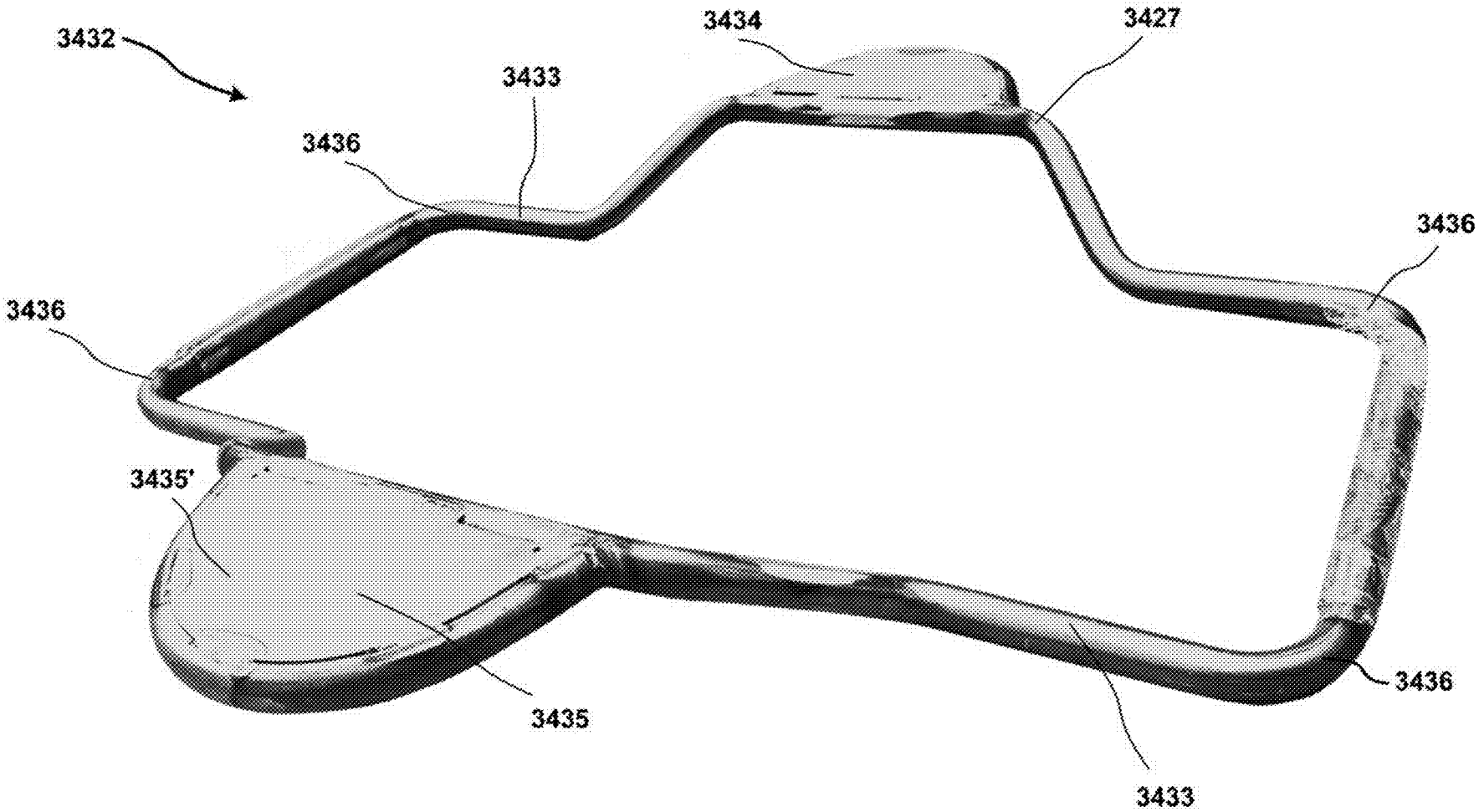
FIG. 20 is a perspective view of an example loop-shaped, arch-like seal frame of a seal frame structure according to aspects and features described herein.

FIG. 20 shows seal frame 3432 apart from the seal frame structure and DAP system, and without corresponding shaping members with which seal frame structure is configured to engage when inflated for providing various benefits discussed hereafter. As shown, seal frame 3432 lacks an inner circle member or other internal structures connecting a forward region of the seal frame to which the head 3434 is attached with a rearward region to which the tail 3435 is attached. Further, seal frame 3432 includes a middle region 3427 that is vertically offset from lateral edge regions of the wings 3433. These differences along with interactions in the inflated condition with added shaping members attached to the enclosure, can further enhance applied force connections between carriages and the seal frame for reducing stress on the lifts, and provide performance benefits for the user including greater lateral movement flexibility during ambulation.

Seal frame 3432 is configured to be attached to a top portion of the enclosure in a spaced apart arrangement with respect to the top opening and the user seal interface instead of having a close proximity arrangement as intended for seal frame 2832, which is configured to be attached in close proximity to the top opening and the user seal interface therewith. This is accomplished in part based on the offset height arrangement of the middle portion 3427 with respect to opposite edge regions of the wings 3433 and the restraint connectors 3436, and further based on the use of shaping members attached to the enclosure as discussed hereafter. In addition, as discussed along with FIG. 24A, the middle portion vertical offset height arrangement of seal frame 3432 is configured for further reducing forces and stress applied to the lifts for the floating seal frame arrangement.

Figure 21:
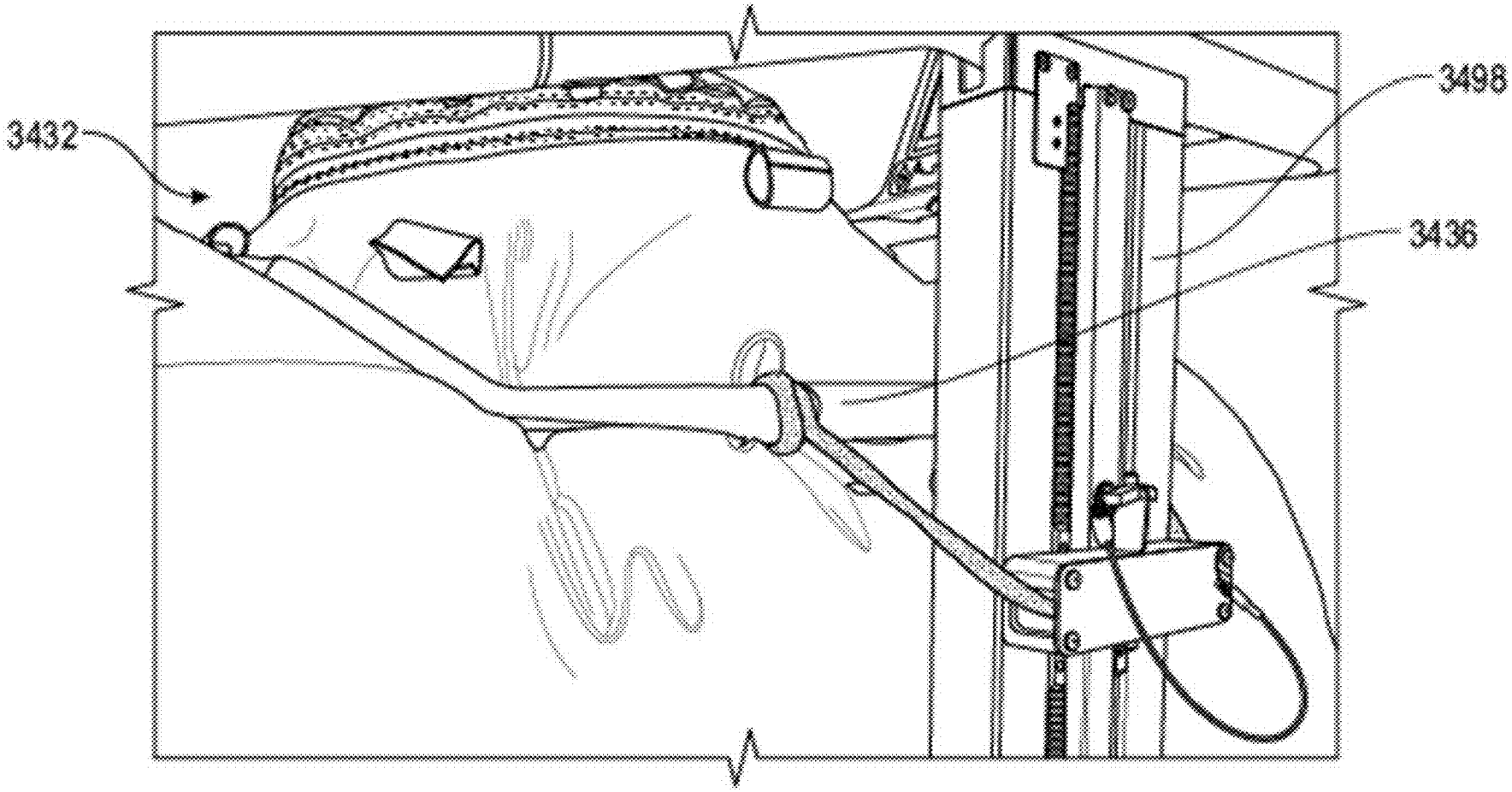
FIG. 21 is a side perspective view of a portion of the seal frame of FIG. 20 and a corresponding seal frame structure shown installed on a DAP system in an inflated condition.
Figure 22B:
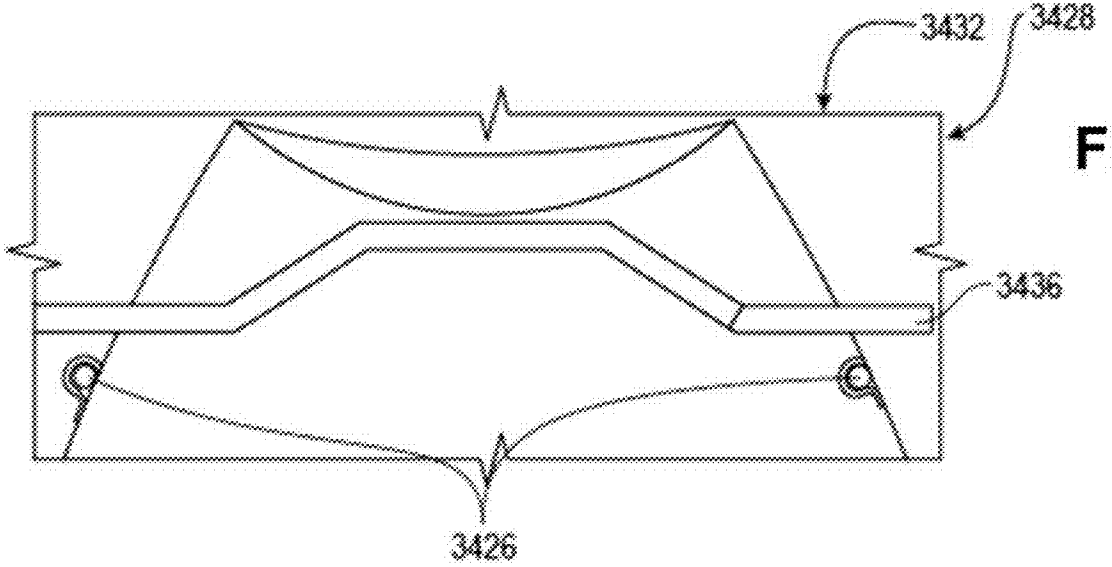
FIG. 22B is a schematic front view of a variation of the seal frame structure of FIG. 22A according to aspects and features described herein, which is depicted as the inflatable enclosure begins to inflate and having shaping members attached to an inner side of the inflatable enclosure.
Figure 22A:
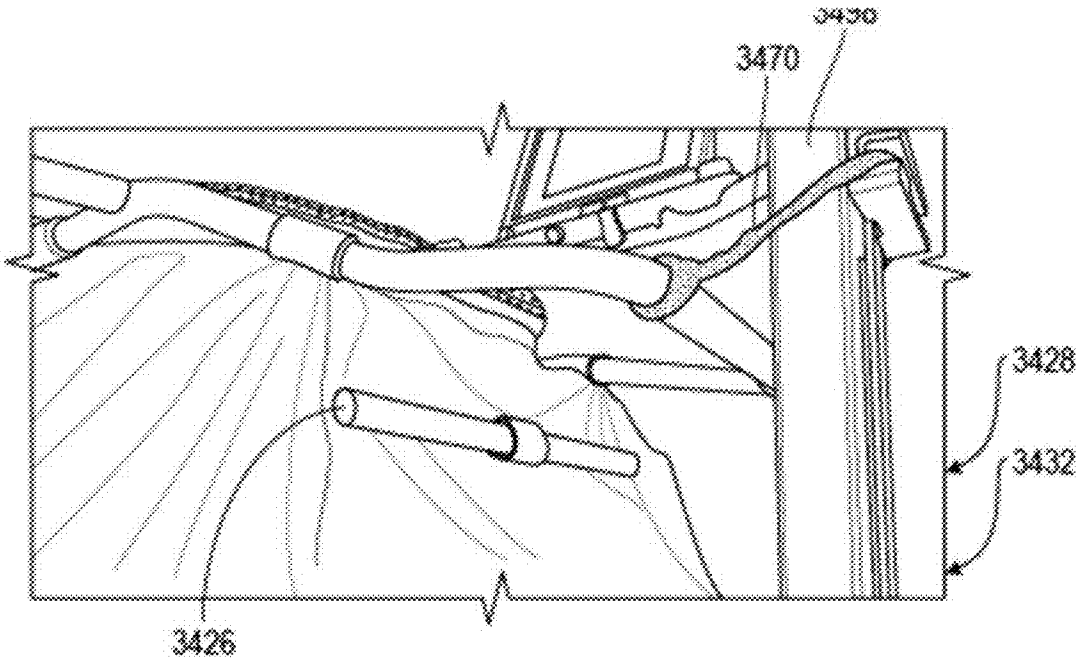
FIG. 22A is a perspective view of a portion of yet another example seal frame structure shown with the seal frame of FIGS. 20 and 21 and having shaping members attached to the inflatable enclosure according to aspects and features described herein, which is shown in a raised, uninflated condition having the shaping members attached to an outer side of the inflatable enclosure.

With reference to FIG. 22B, seal frame structure 3432 is configured to engage a shaping member 3436 attached to a top portion of the inflatable enclosure when in the inflated condition, such that a pair of shaping members 3436 attached to the enclosure are configured to engage and extend across each wing 3433 to interfere with or block the enclosure from extending between side arms that form each wing when inflated. As depicted in FIG. 22B, such shaping members can be attached to the enclosure material either internally or externally (left vs. right side of FIG. 22B). As can be seen in FIG. 22A, shaping members attached to the enclosure are not configured to engage the seal frame 3432 in the uninflated condition and are not attached to or part of the seal frame. However, seal frame 3432 is not configured for use without the shaping members being installed. As shown in FIG. 21, use of seal frame 3432 in the inflated state can permit excessive enclosure material penetration within the seal frame and/or can exert high stress levels on attachments between the enclosure material and the seal frame.

Figure 23A:
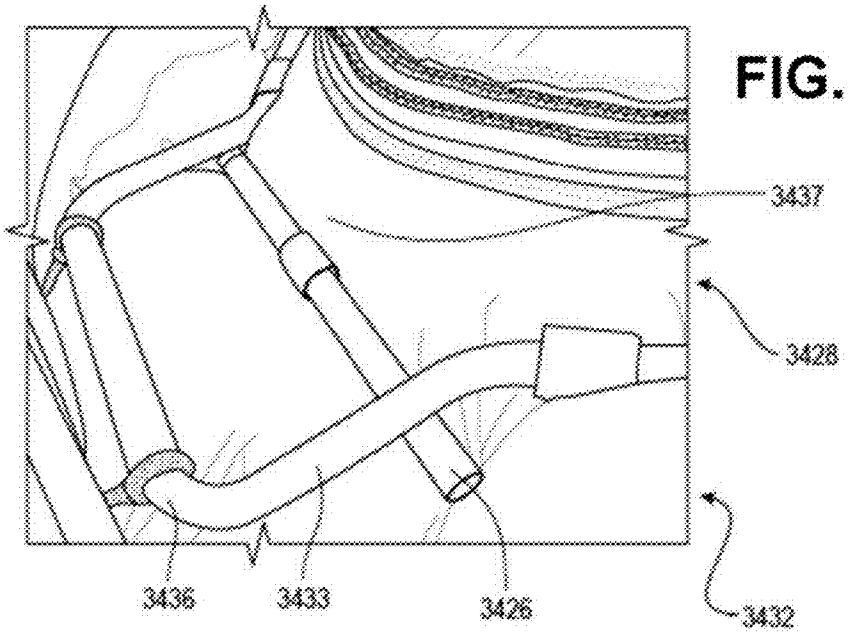
FIGS. 23A and 23B are perspective views of portions of the seal frame structure of FIG. 22B.
Figure 23B:
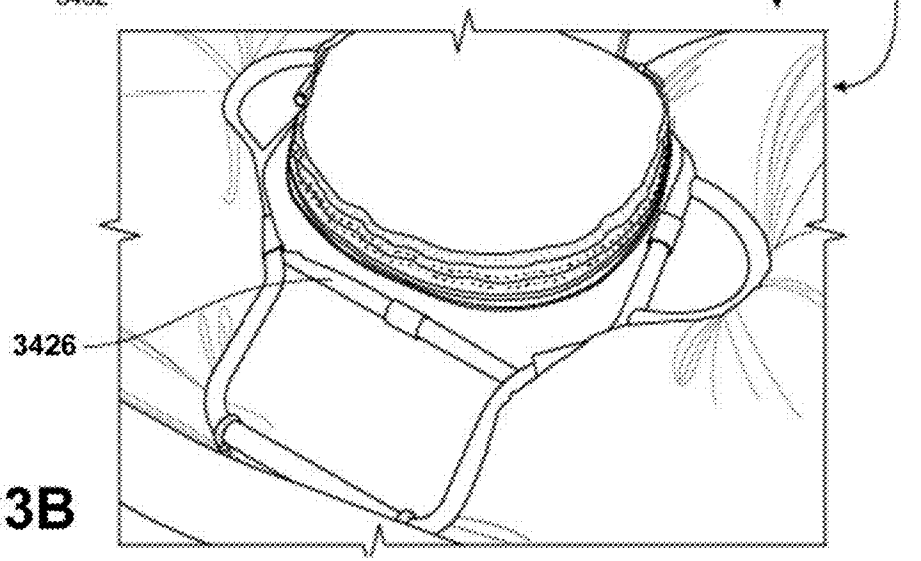

However, as shown in FIGS. 23A and 23B, seal frame 3432 in combination with lateral shaping members 3426 can provide effective height adjustment interactions with the enclosure along with improving lateral movement flexibility for the user. In particular, the lateral shaping members 3426 can be configured to extend across opposite arms of each wing 3433 and engage enclosure material when inflated at about the same horizontal offset distance as fore and aft use seal boundary regions, but at a greater vertical drop vs. fore and aft boundary regions 3427. Thus, as shown in FIG. 23A, lateral boundary regions 3437 formed upon engagement of the seal frame 3432 and the lateral shaping member 3426 can be substantially vertically inclined or inclined at a greater angle than fore/aft user seal boundary regions. This can allow for movement flexibility with less resistance in lateral directions vs. fore/aft directions during ambulation consistent with naturally greater side to side movements of users during ambulation than fore/aft movements.

Figure 24A:
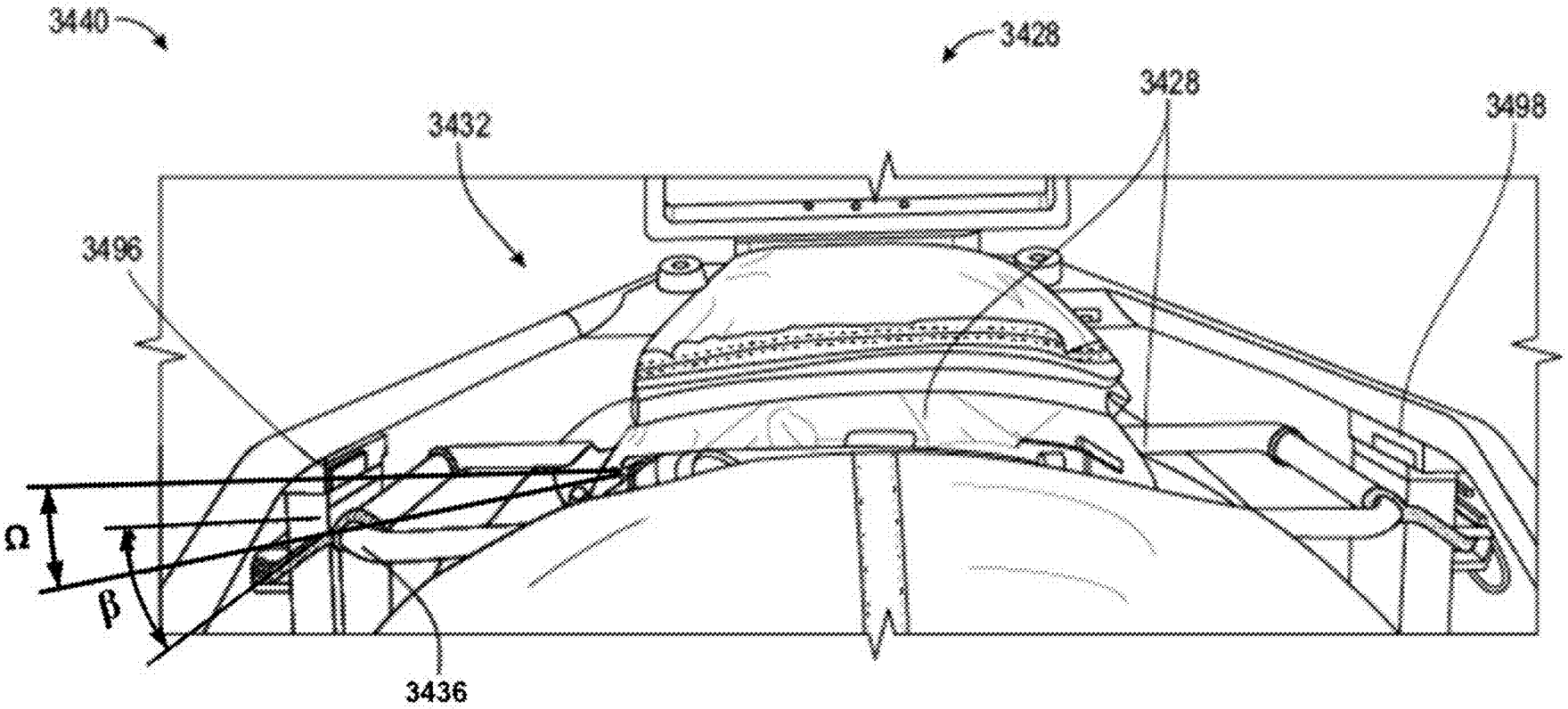
FIG. 24A is a rear perspective view of a portion of the seal frame structure of FIG. 22B.
Figure 24B:
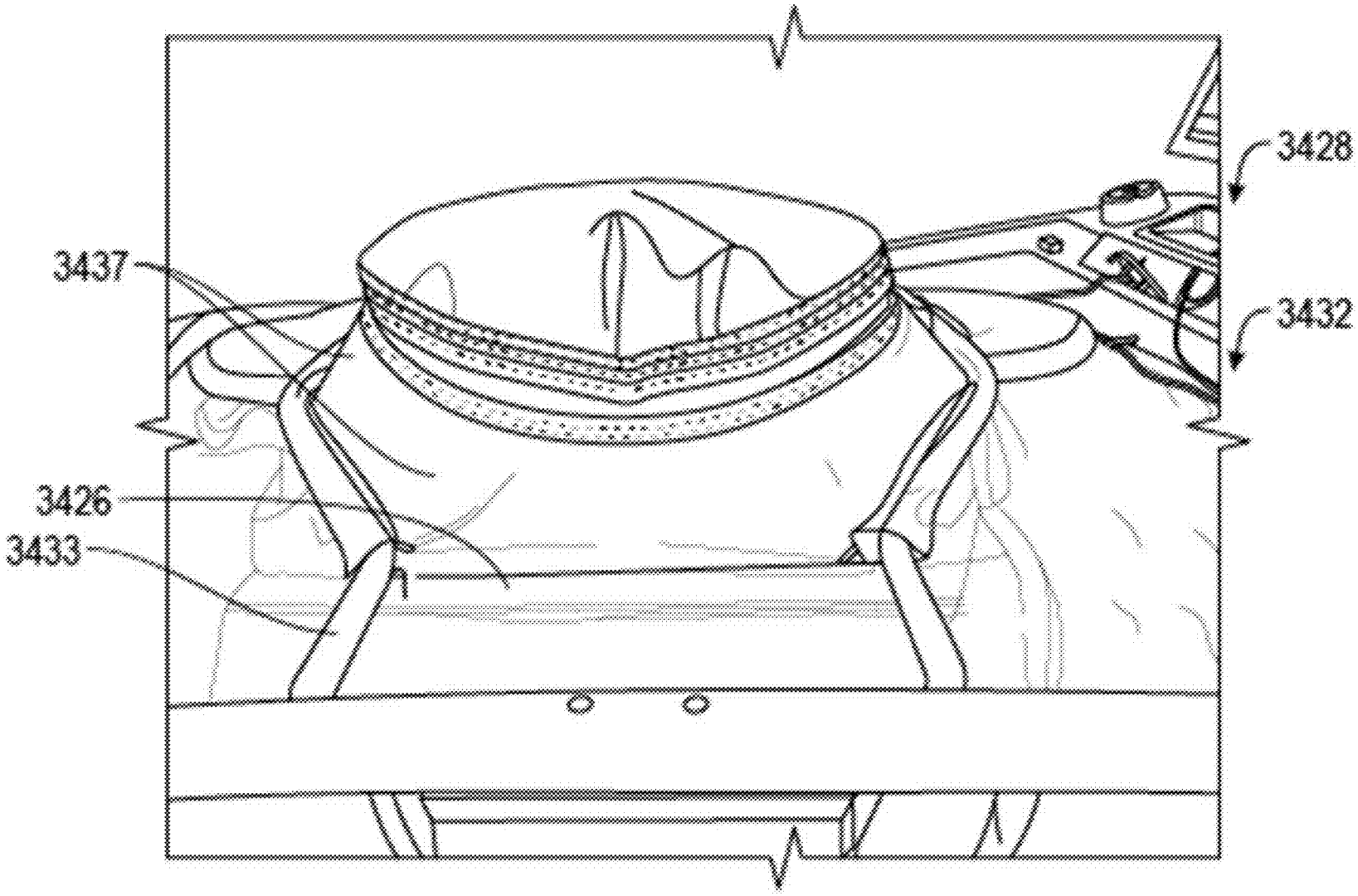
FIG. 24B is a side perspective view of a portion of the seal frame structure of FIG. 22B.
Figure 25A:
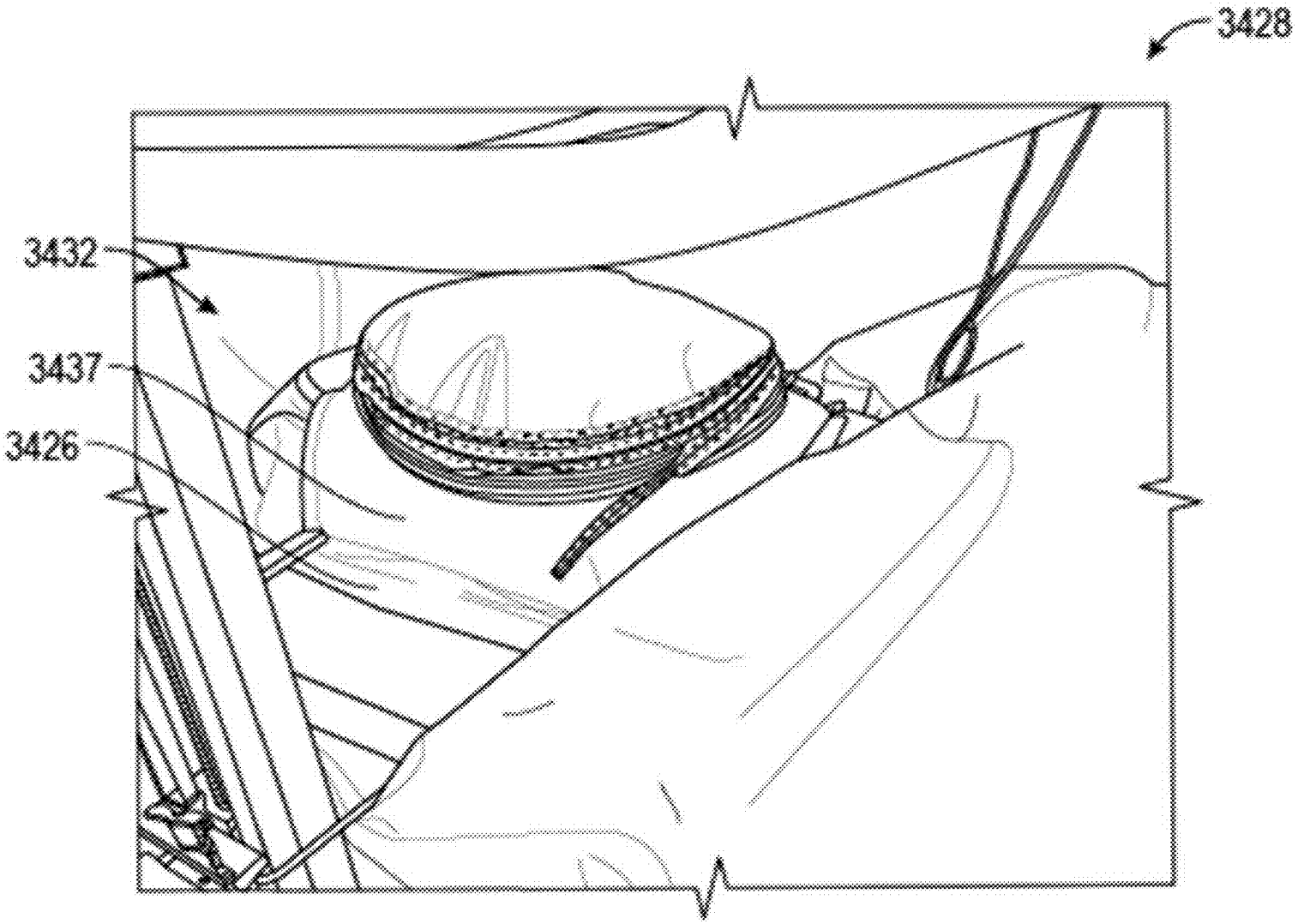
FIG. 25A is a side perspective view of a portion of the seal frame structure of FIG. 22B.
Figure 25B:
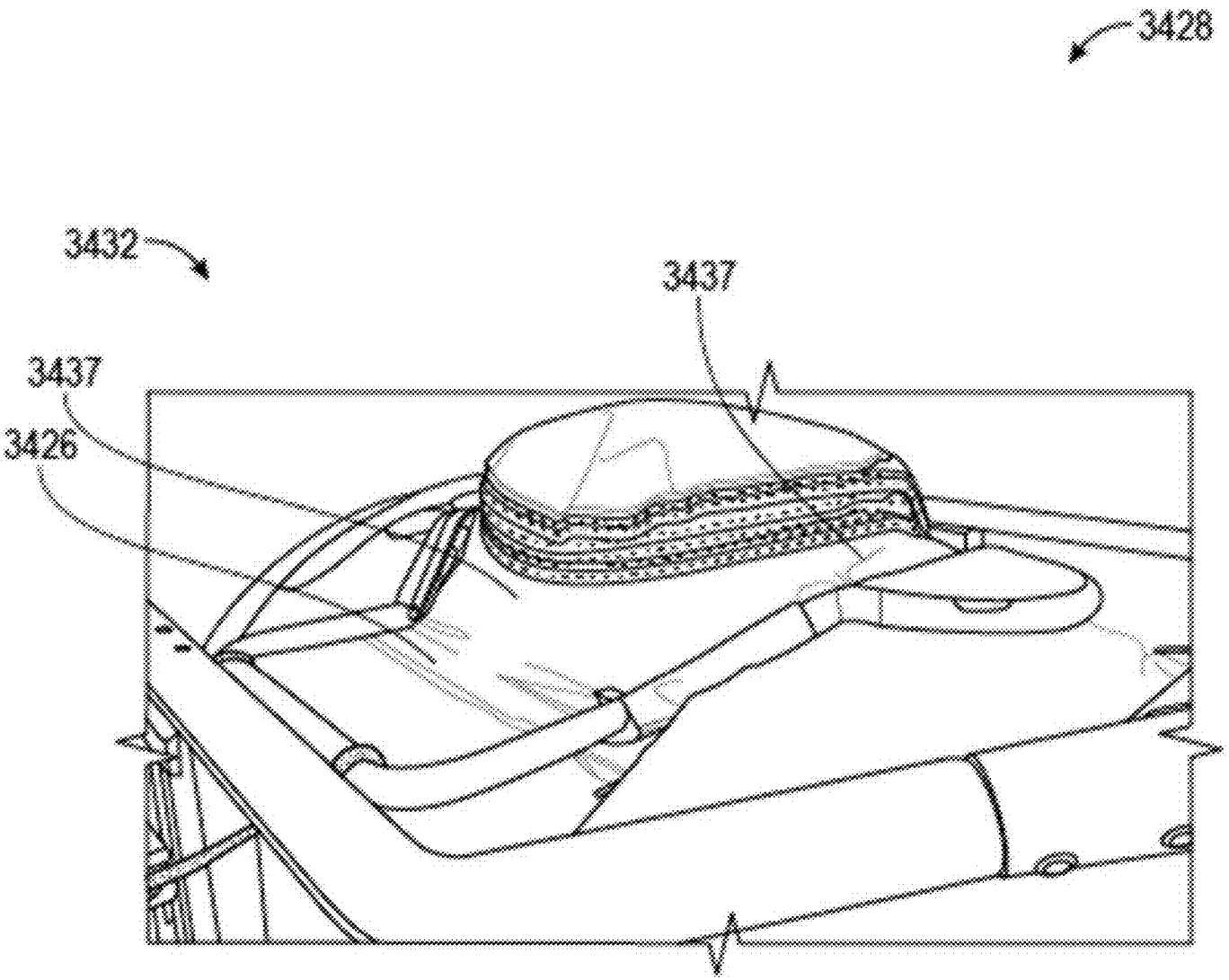
FIG. 25B is a front, side perspective view of a portion of the seal frame structure of FIG. 22B.
Figure 25C:
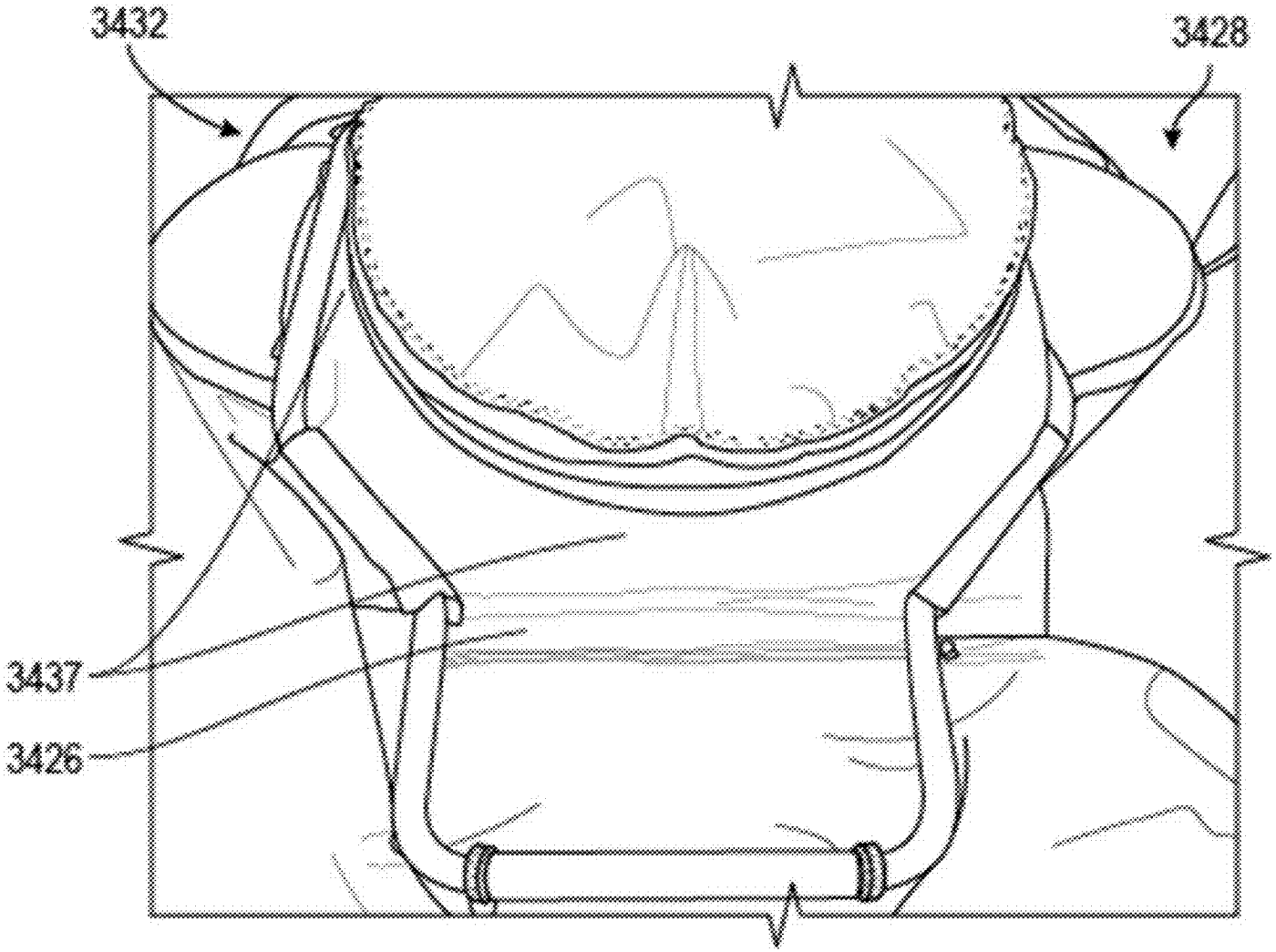
FIG. 25C is a top, side perspective view of a portion of the seal frame structure of FIG. 22B.
Figure 25D:
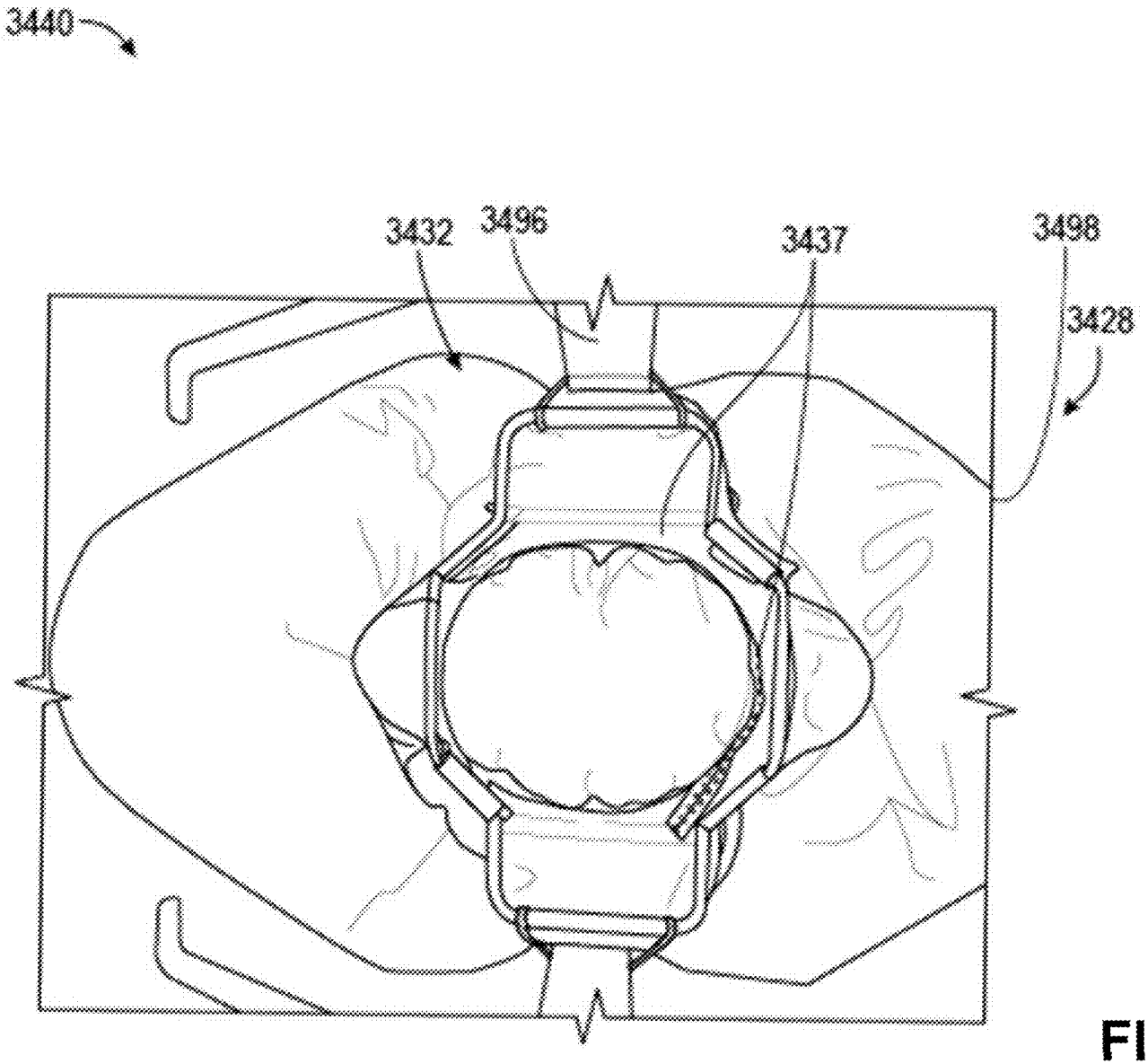
FIG. 25D is a top perspective view of a portion of the seal frame structure of FIG. 22B.

As can be seen in FIG. 24A to 25D, lateral user seal boundary region shaping can further be improved with attachment of the lateral shaping members 3426 to an inner side of the inflatable enclosure. In addition, as further shown in the same figures, such the beneficial shaping of the user seal boundary region 3437 is maintained through a range of height adjustments including at high height settings (FIGS. 24A and 24B), at low height settings (FIGS. 25A, C and D), and at mid-range height settings (FIG. 25B). As further seen in the same figures, further enhanced arm swing space can be provided from the arrangement of user seal 3432 versus seal frame 2832. Further, as indicated in FIG. 24A, based on the arrangement of seal frame 3432 including the vertical offset provided by the middle region 3427 versus restraint connectors 3436 and the extended width of user seal 3432, the overall downward force component applied to the flexible tensile restraint connections 3470 is improved based on the combined benefits of downward angle Ω from the middle region 3727 to the restraint connectors 3436, and the downward angle from restraint connectors 3436 to each carriage connector.

Figure 26A:
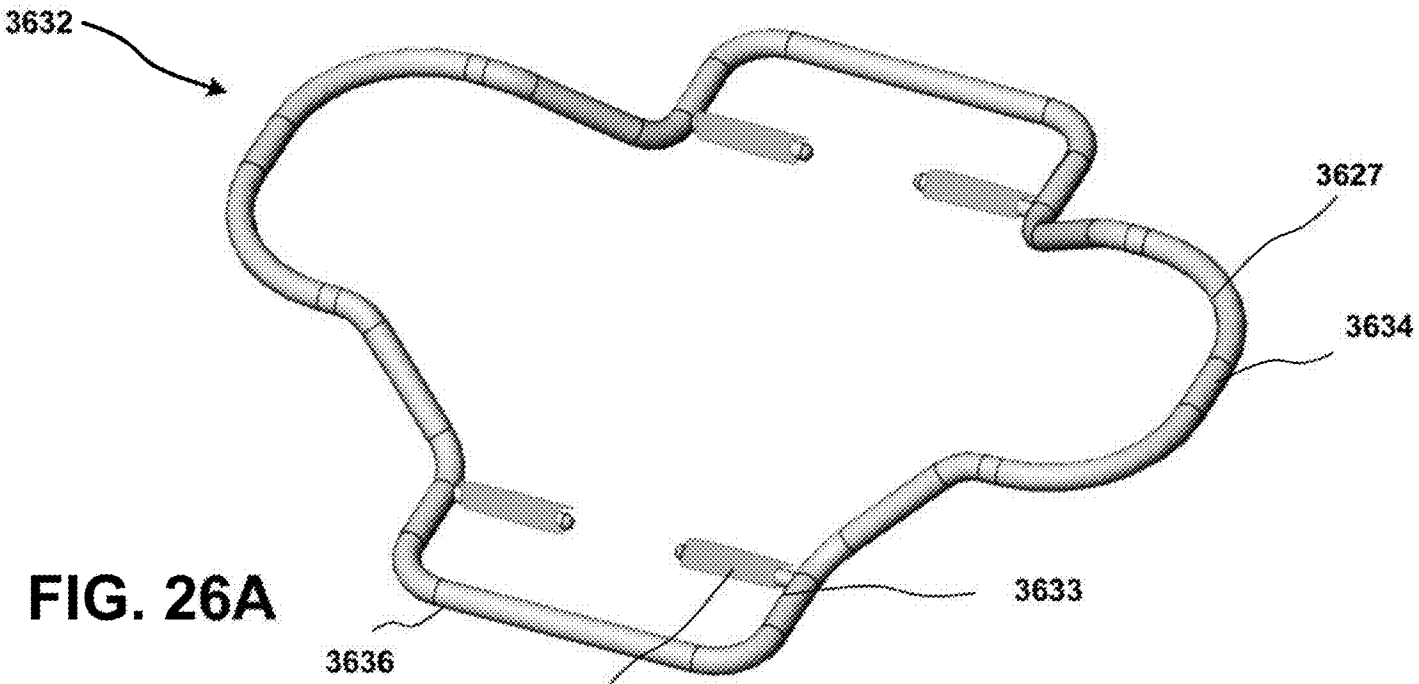
FIG. 26A is a schematic perspective view of yet another loop-shaped, arch-type seal frame of a seal frame structure having shaping members integrated into the seal frame according to aspects and features described herein.
Figure 26B:
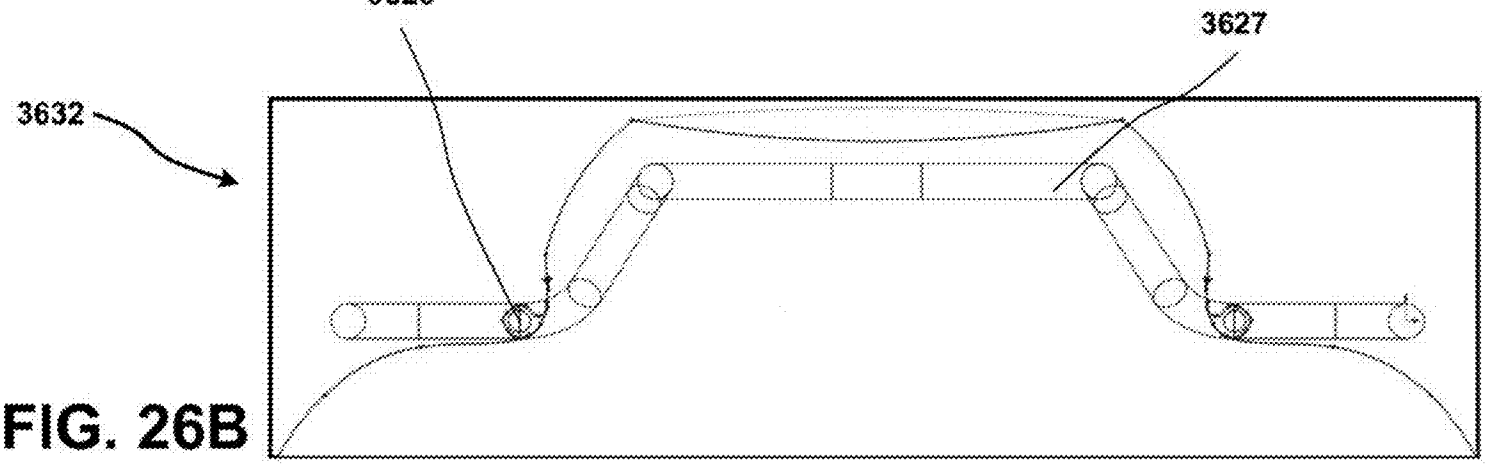
FIG. 26B is a front view of the seal frame and a portion of the seal frame structure of FIG. 26A.
Figure 27A:
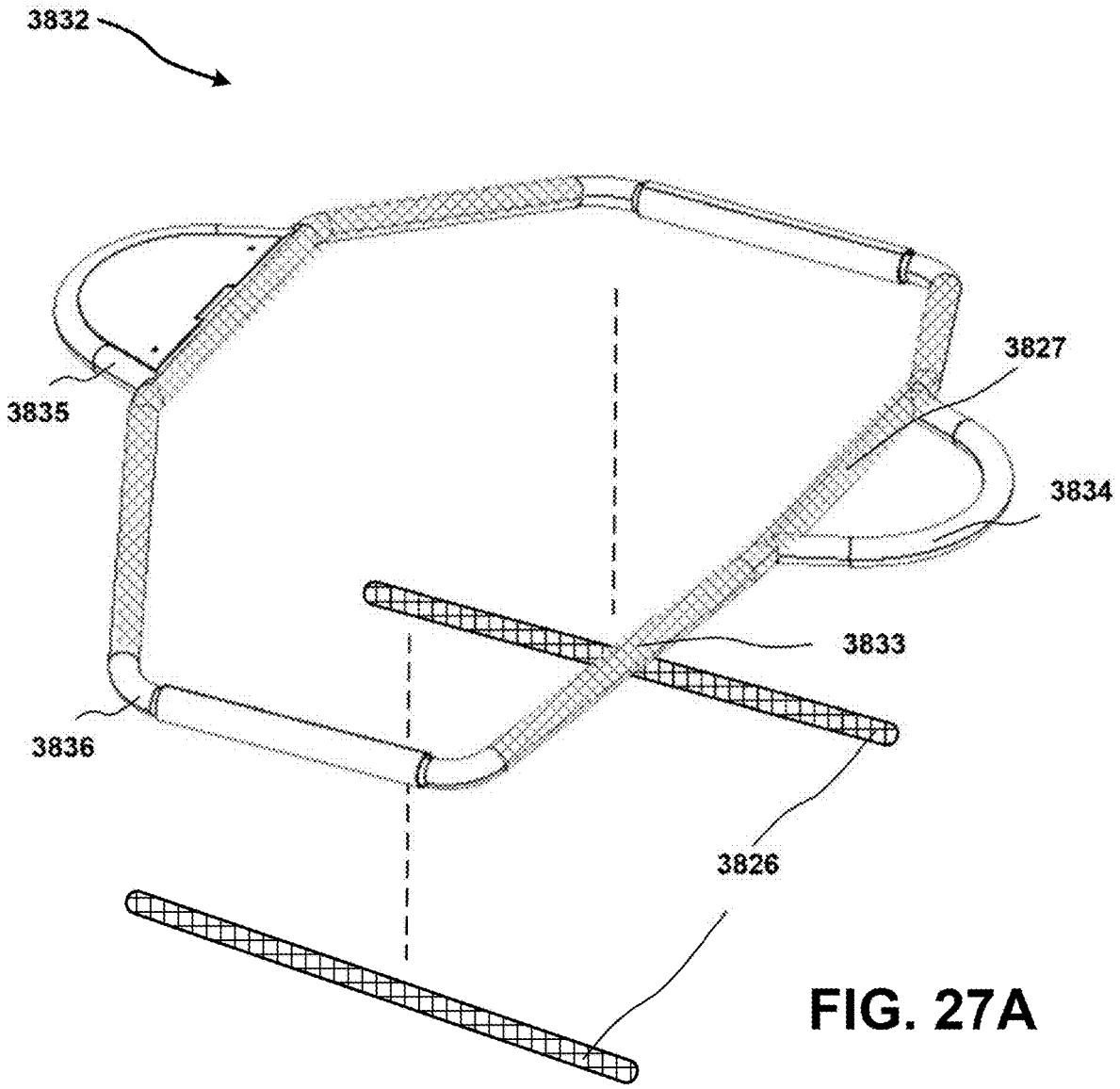
FIG. 27A is a schematic perspective view of another loop-shaped, arch-type seal frame of a seal frame structure having shaping members that can be attached to an inflatable enclosure of a DAP system according to aspects and features described herein.
Figure 27B:
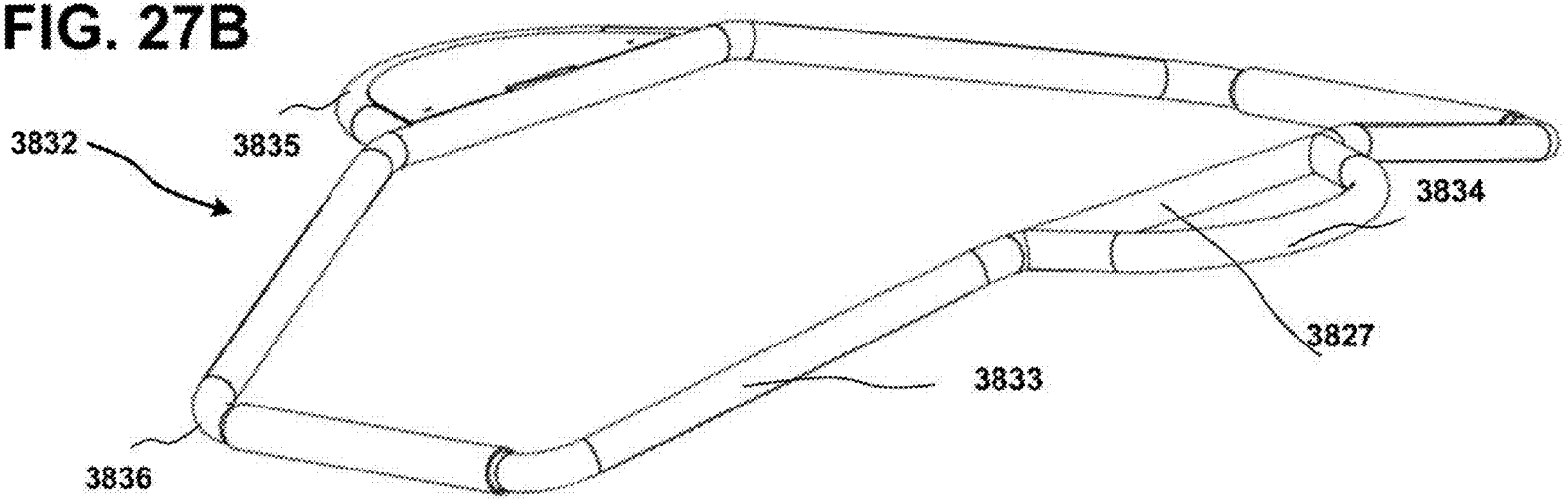
FIG. 27B is another perspective view of the seal frame structure of FIG. 27A shown without the shaping members.
Figure 27C:
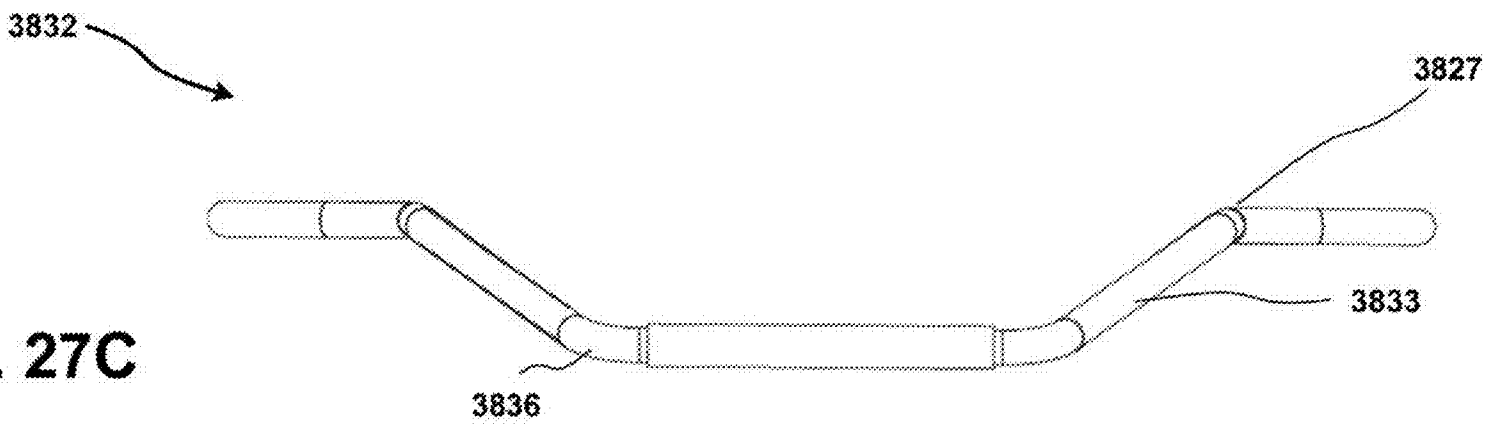
FIG. 27C is a side view the seal frame structure of FIG. 27A shown without the shaping members.
Figure 27D:
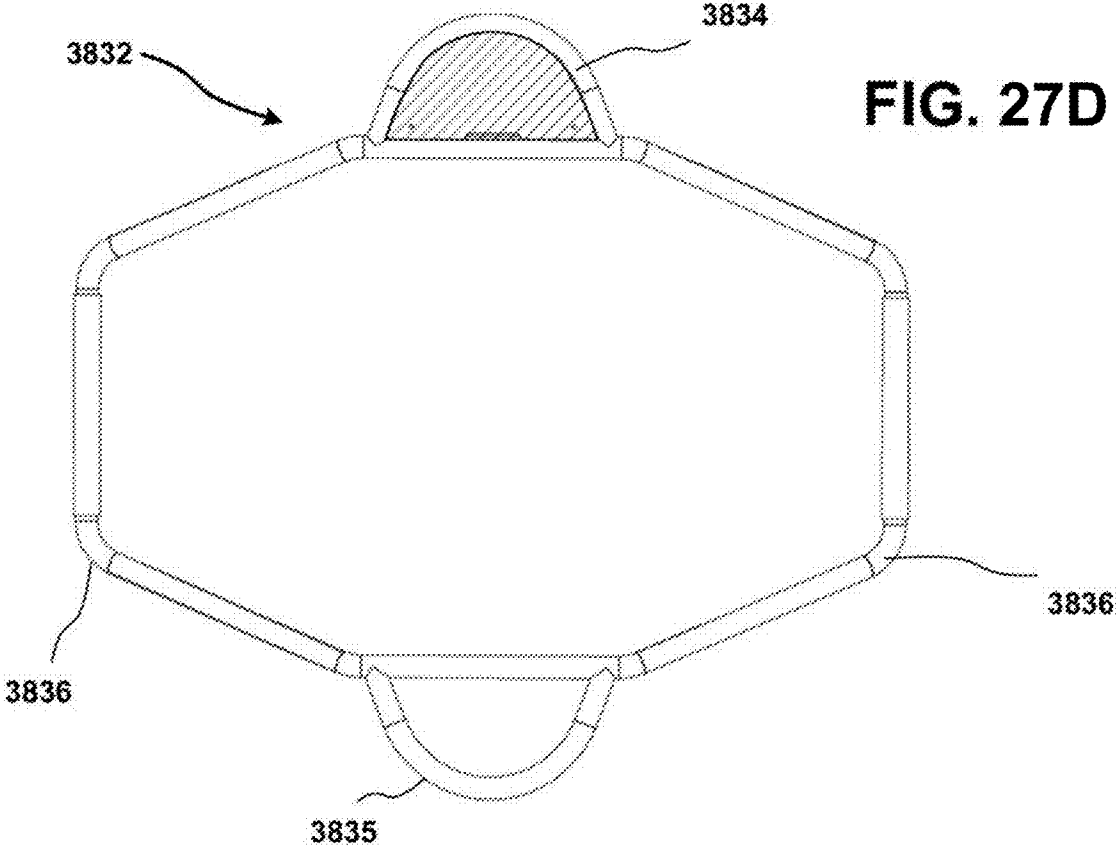
FIG. 27D is a top view of the seal frame structure of FIG. 27A shown without the shaping members.
Figure 27E:
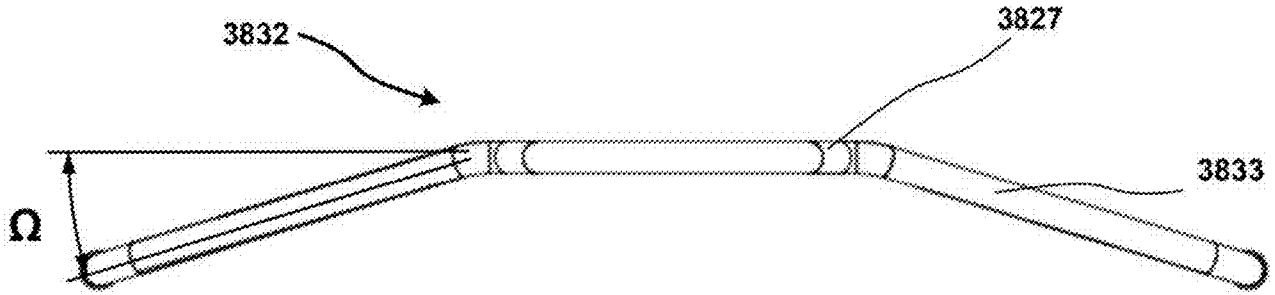
FIG. 27E is a front view of the seal frame structure of FIG. 27A shown without the shaping members.
Figure 28:
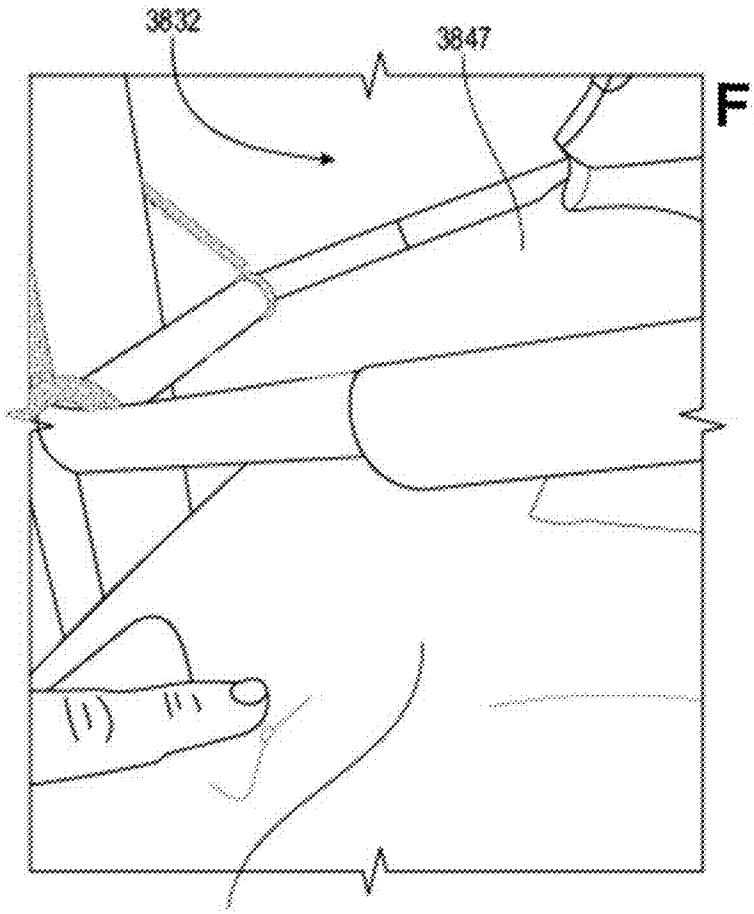
FIG. 28 is a front perspective view of a portion of the seal frame structure of FIG. 27A installed on a DAP structure shown with a shaping member attached to an inner side of the inflatable enclosure according to aspects and features described herein, which is shown in a raised, partially inflated condition.
Figure 29:
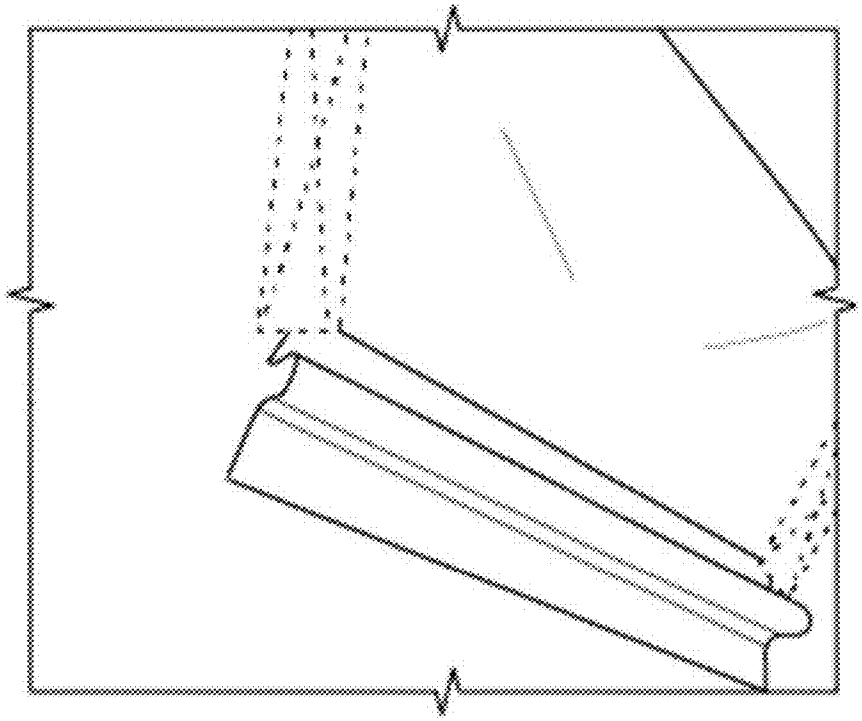
FIG. 29 is a perspective view of an inner side of the enclosure depicted with the seal frame structure of FIG. 28 having the shaping member attached thereto.
Figure 30:
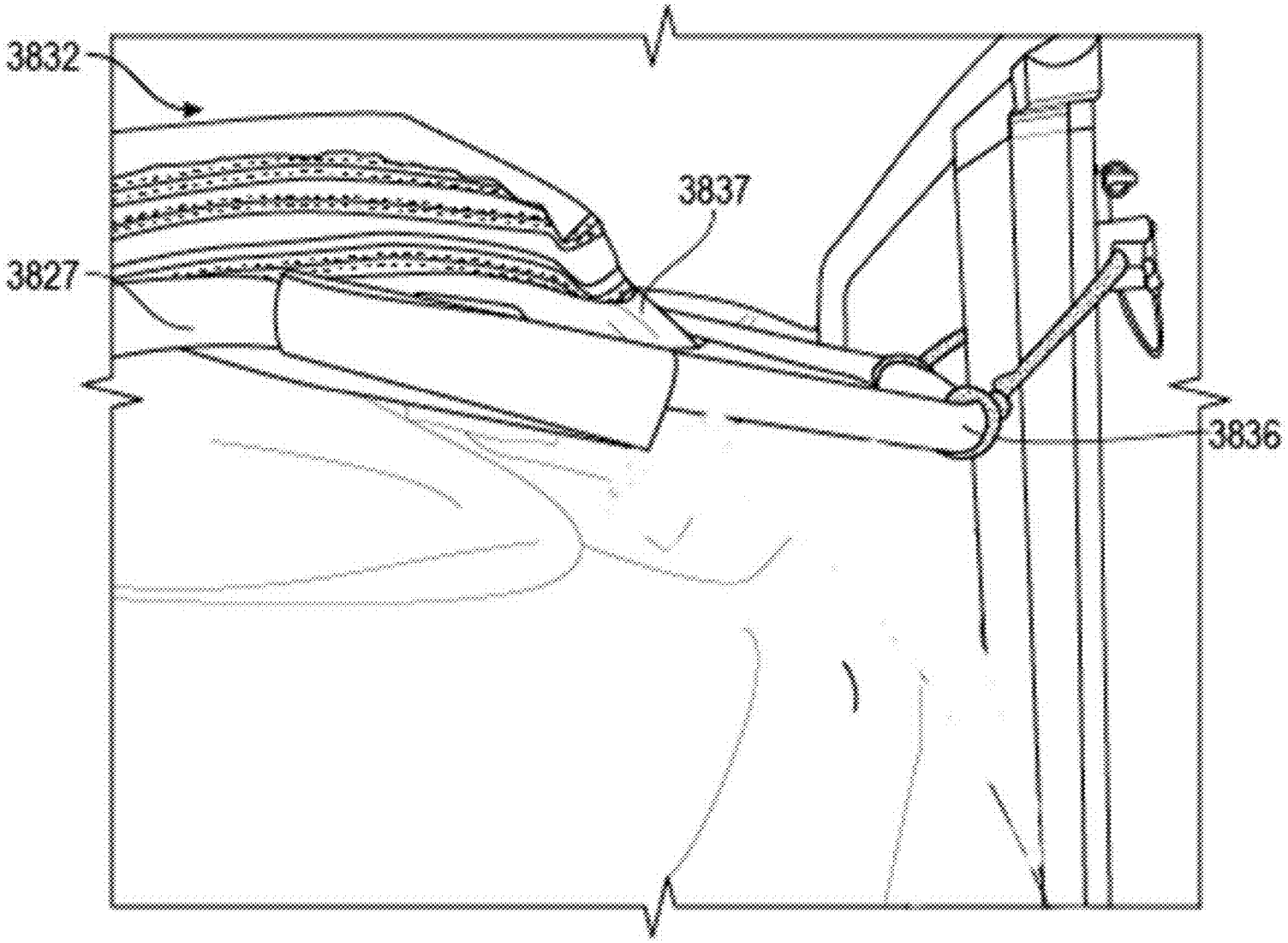
FIG. 30 is a front perspective view of another portion of the seal frame structure of FIG. 28 at an opposite lateral side of the DAP system shown in an uninflated condition.
Figure 31:
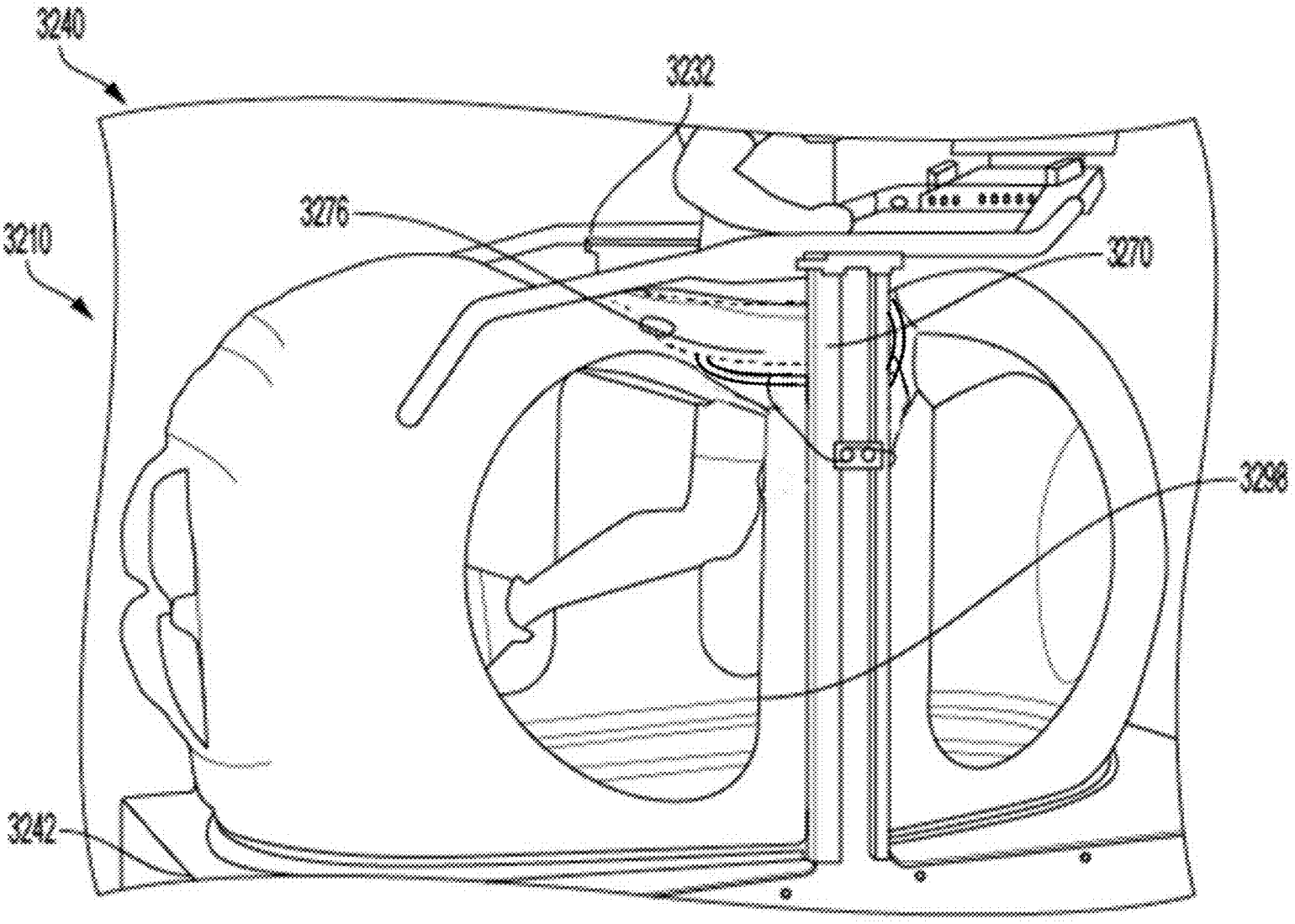
FIG. 31 is side perspective view of the seal frame structure and DAP system of FIG. 28 shown inflated and raised to desired height with the seal frame in a floating arrangement during use.
Figure 32:
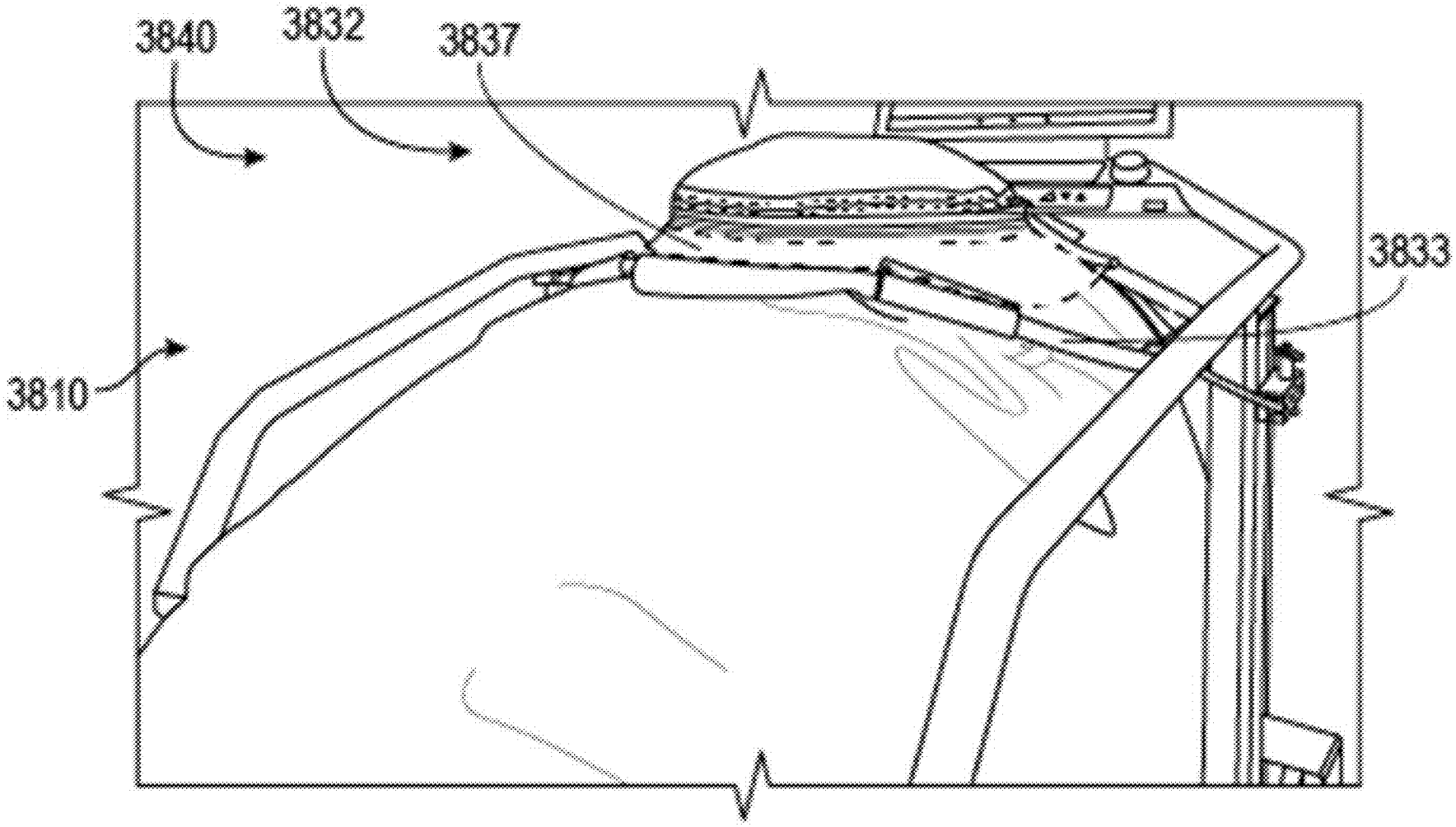
FIG. 32 is a rear perspective view of a portion of the seal frame structure installation with a DAP system of FIG. 31.
Figure 33:
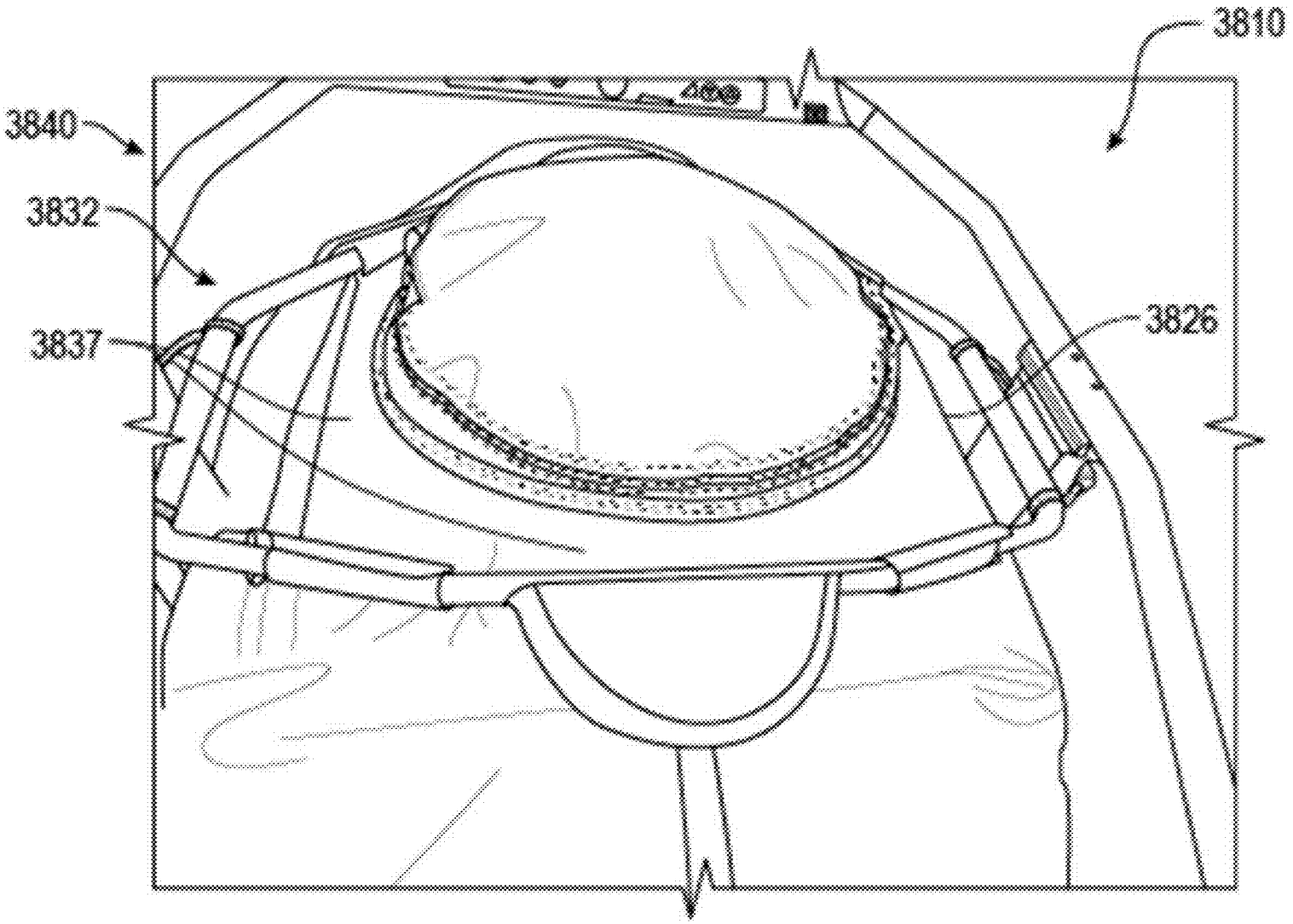
FIG. 33 is a rear, top perspective view of a portion of the seal frame structure installation with a DAP system of FIG. 31.
Figure 34:
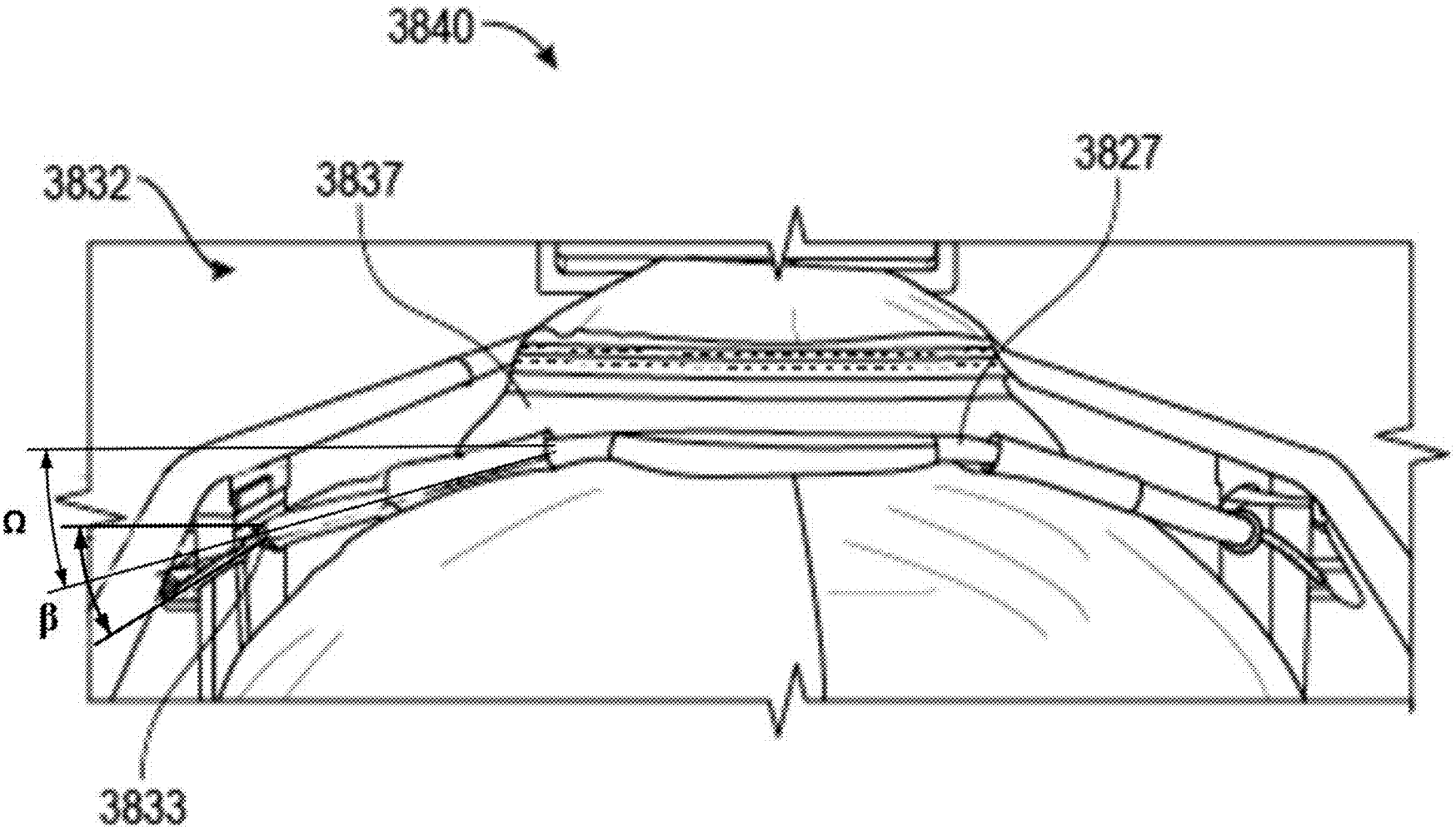
FIG. 34 is a rear, side perspective view of a portion of the seal frame structure installation with a DAP system of FIG. 31.
Figure 35:
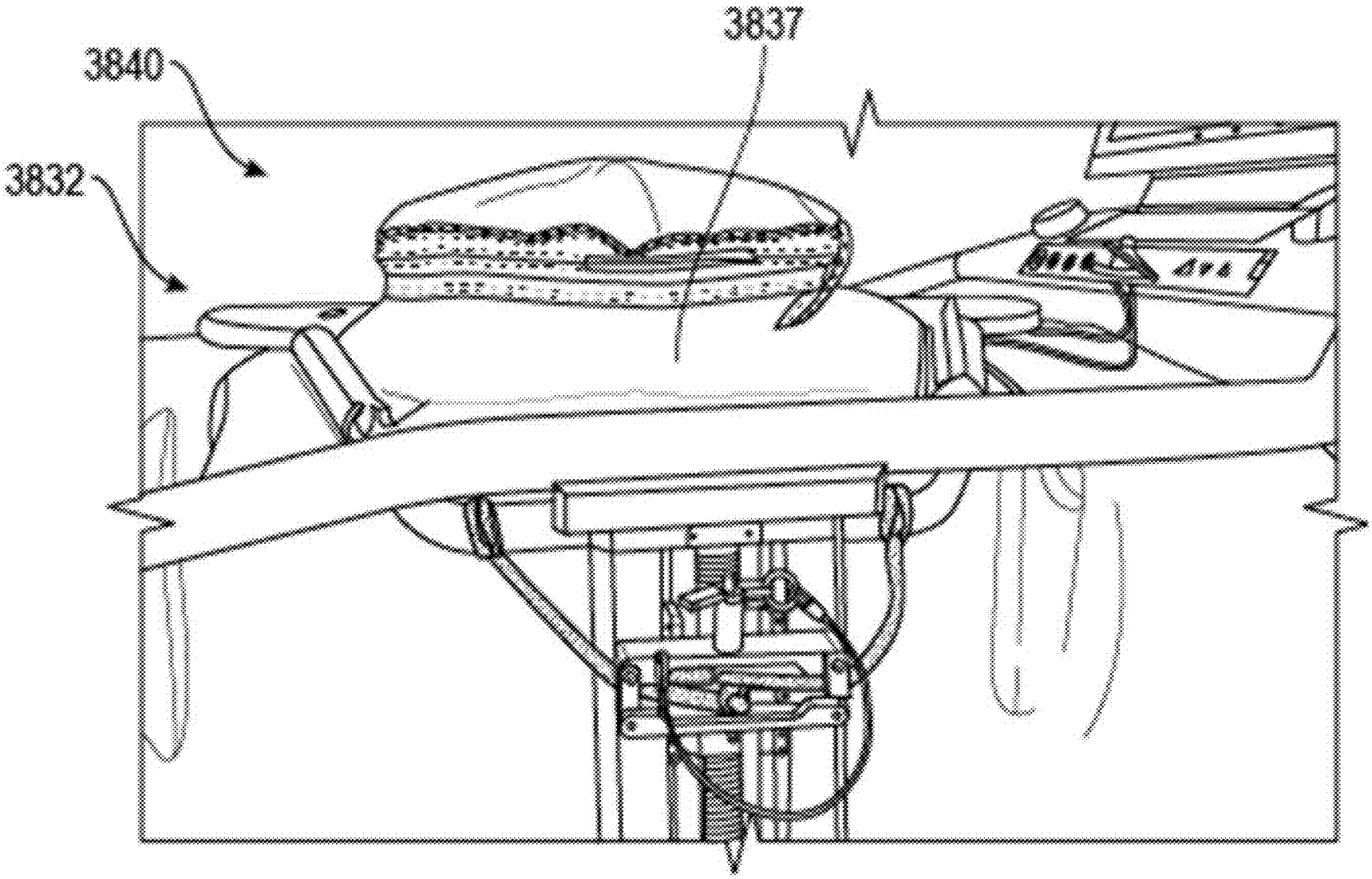
FIG. 35 is a side perspective view of a portion of the seal frame structure installation with a DAP system of FIG. 31.
Figure 36:
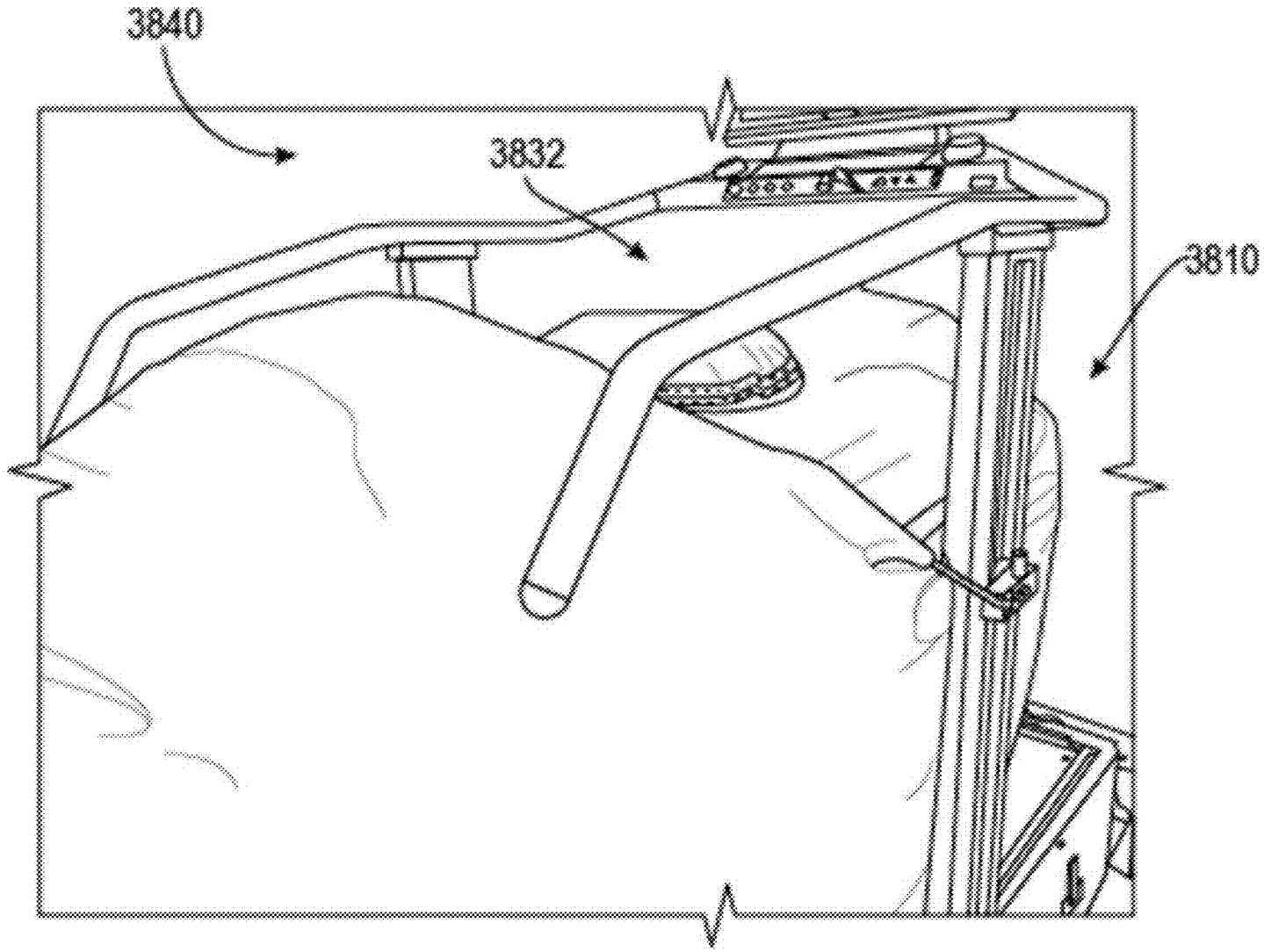
FIG. 36 is a rear, side perspective view of a portion of the seal frame structure installation with a DAP system of FIG. 31 shown in a lowered height condition.
Figure 37:
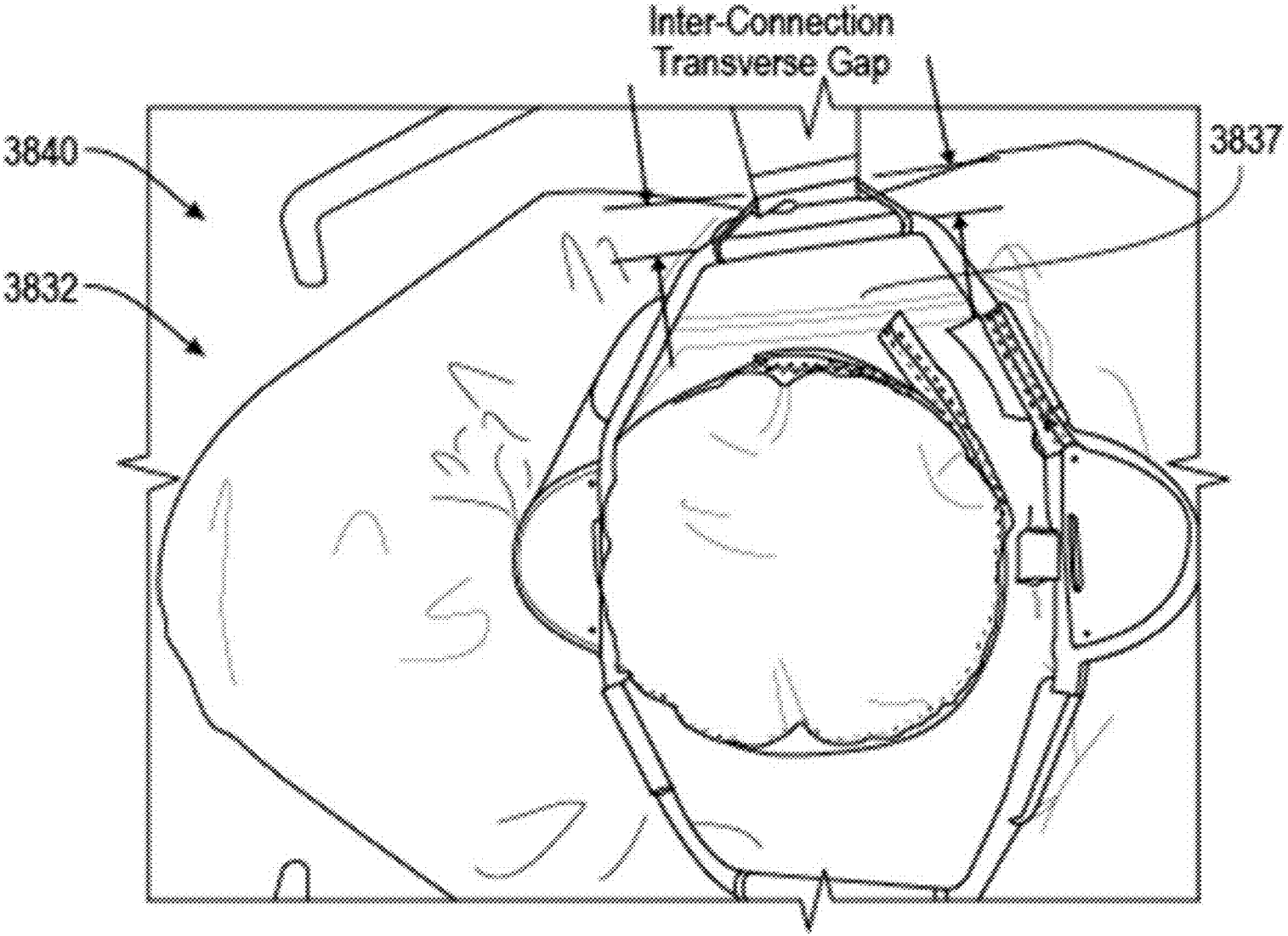
FIG. 37 is a top perspective view of a portion of the seal frame structure installation in the lowered condition of FIG. 36.
Figure 38:
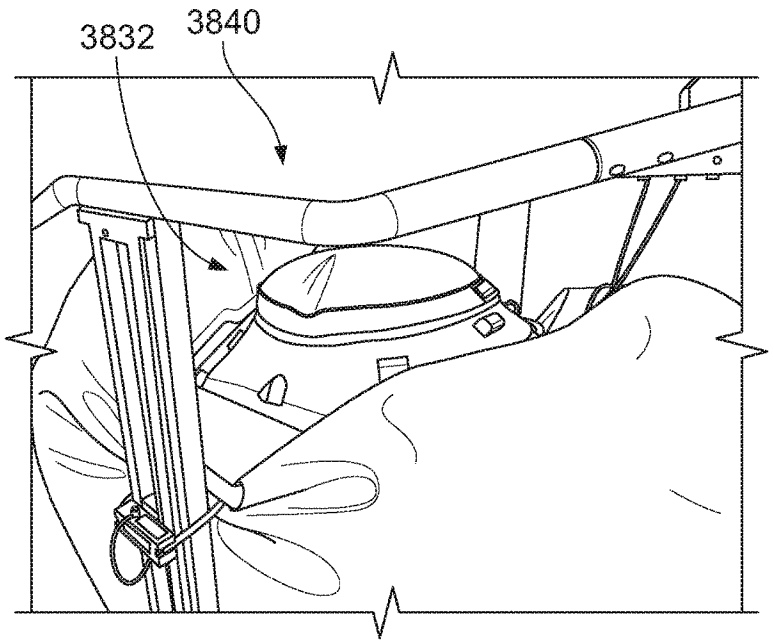
FIG. 38 is a front, side perspective view of a portion of the seal frame structure installation in the lowered condition of FIG. 36.
Figure 39:
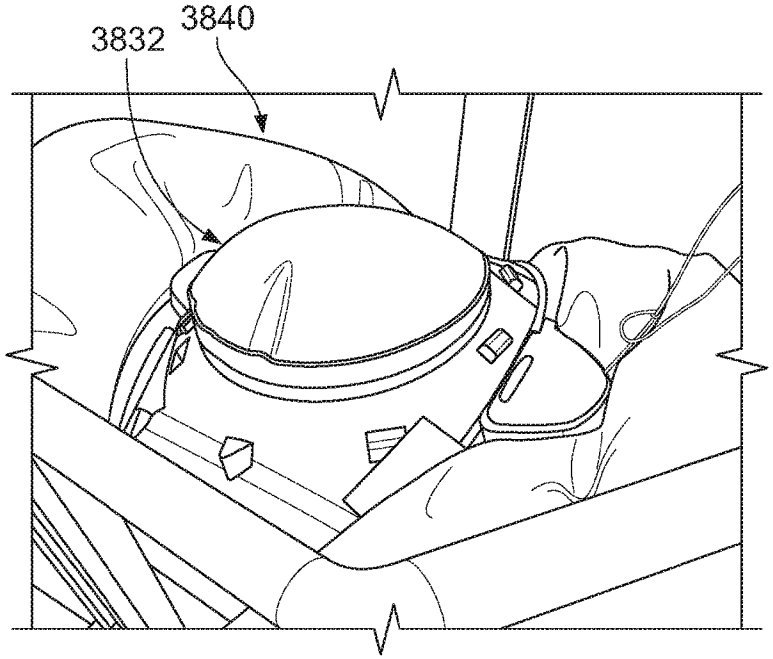
FIG. 39 is a front, side perspective view of a portion of the seal frame structure installation in the lowered condition of FIG. 36.
Figure 40:
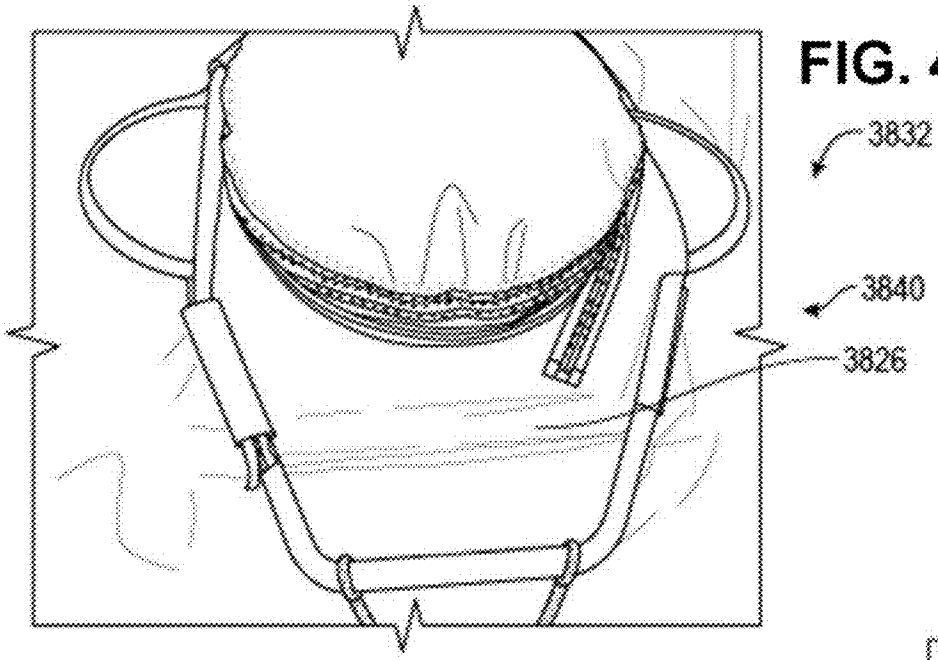
FIG. 40 is a top, side perspective view of a portion of the seal frame structure installation in the lowered condition of FIG. 36.
Figure 41:
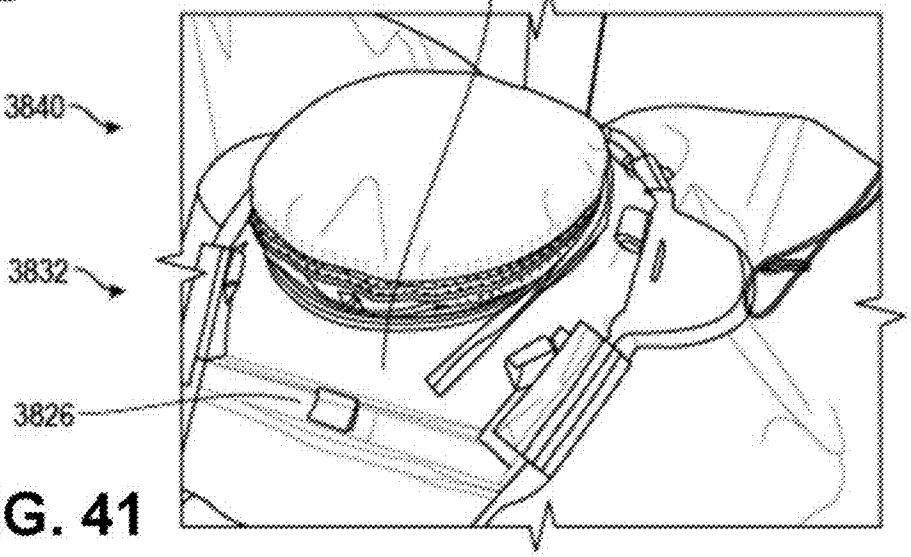
FIG. 41 is an elevated, front, side perspective view of a portion of the seal frame structure installation in the lowered condition of FIG. 36.
Figure 42:
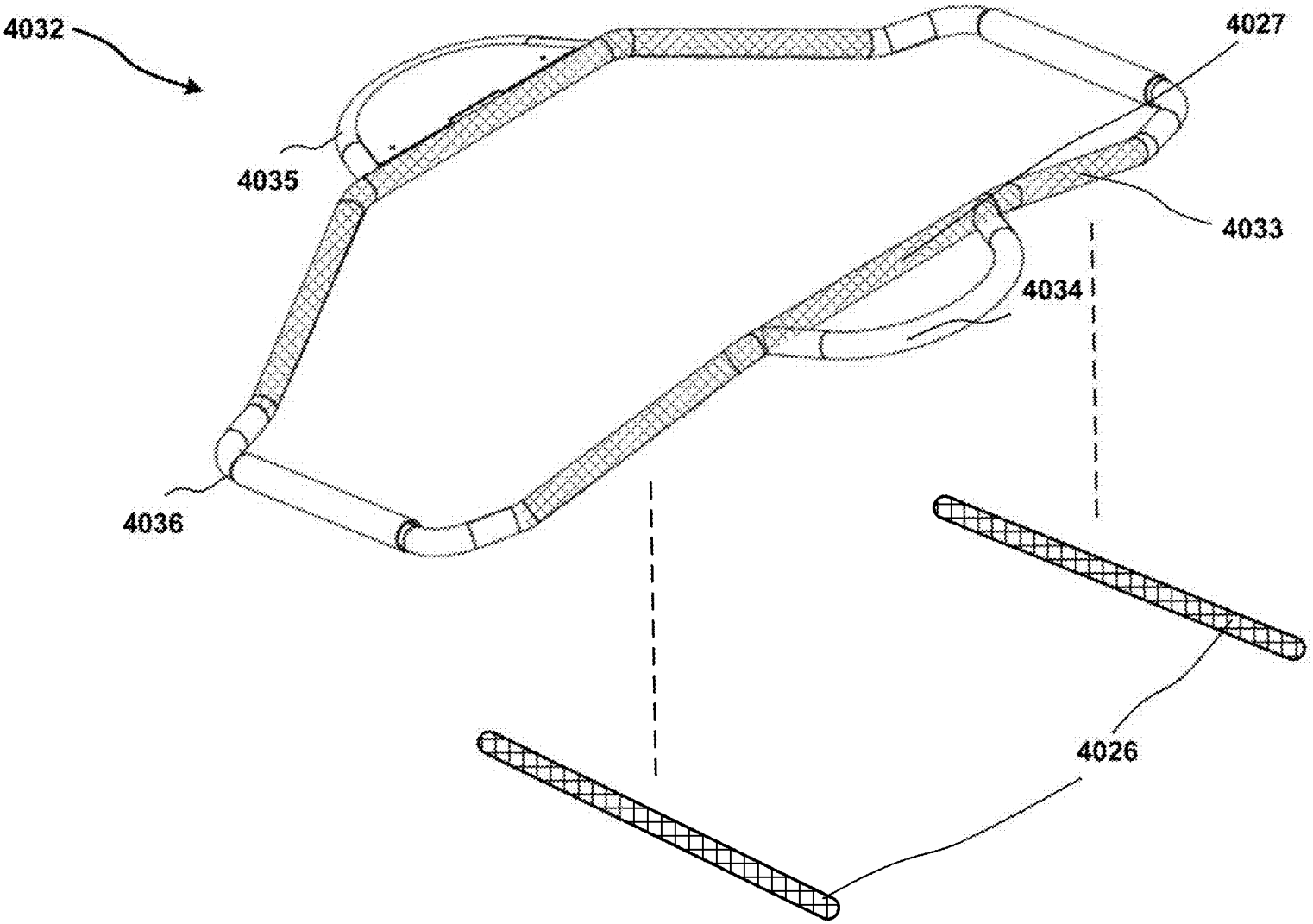
FIG. 42 is a schematic perspective view of a further loop-shaped, arch-type seal frame of a seal frame structure shown with shaping members that can be attached to an inflatable enclosure according to aspects and features described herein.
Figure 43:
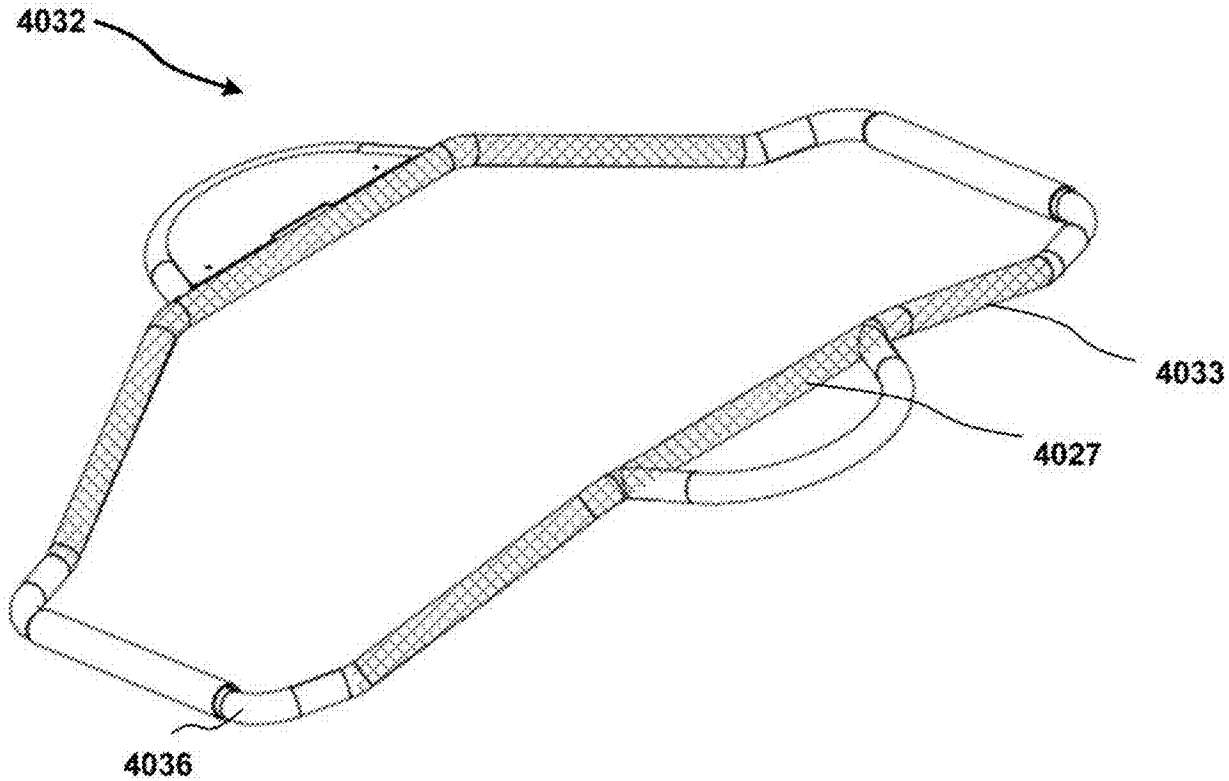
FIG. 43 is another perspective view of the seal frame of FIG. 43 shown without the shaping members.
Figure 44:
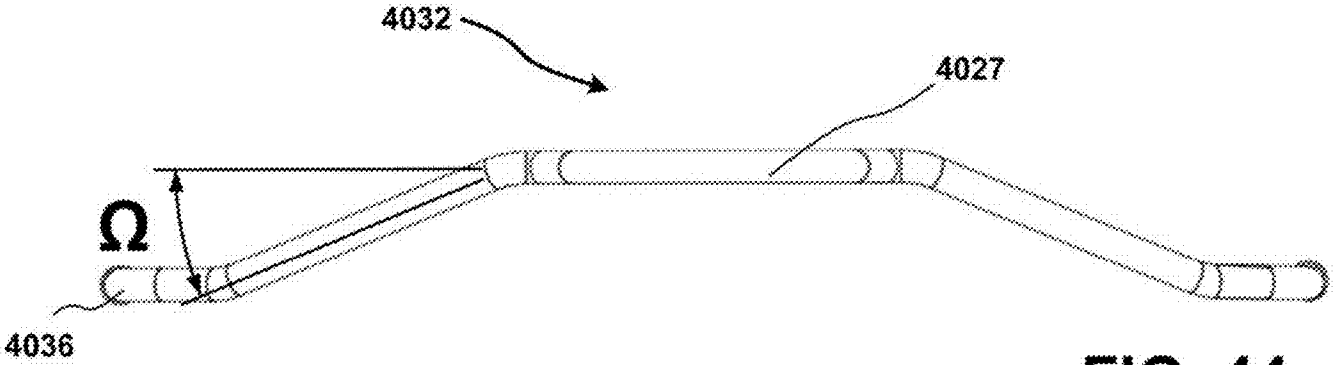
FIG. 44 is a side view the seal frame of FIG. 43 shown without the shaping members.
Figure 45:
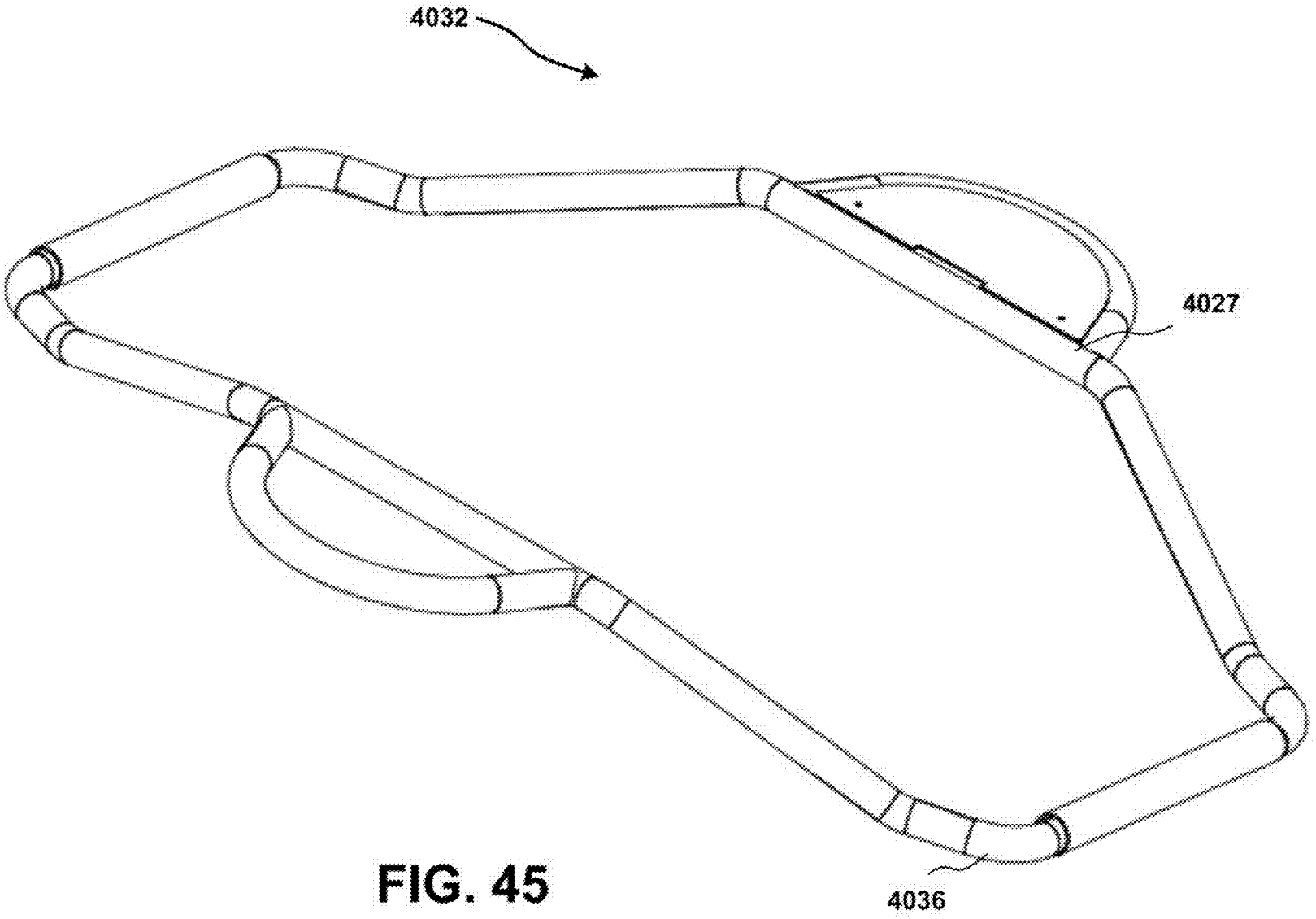
FIG. 45 is a top view of the seal frame of FIG. 43 shown without the shaping members.
Figure 46:
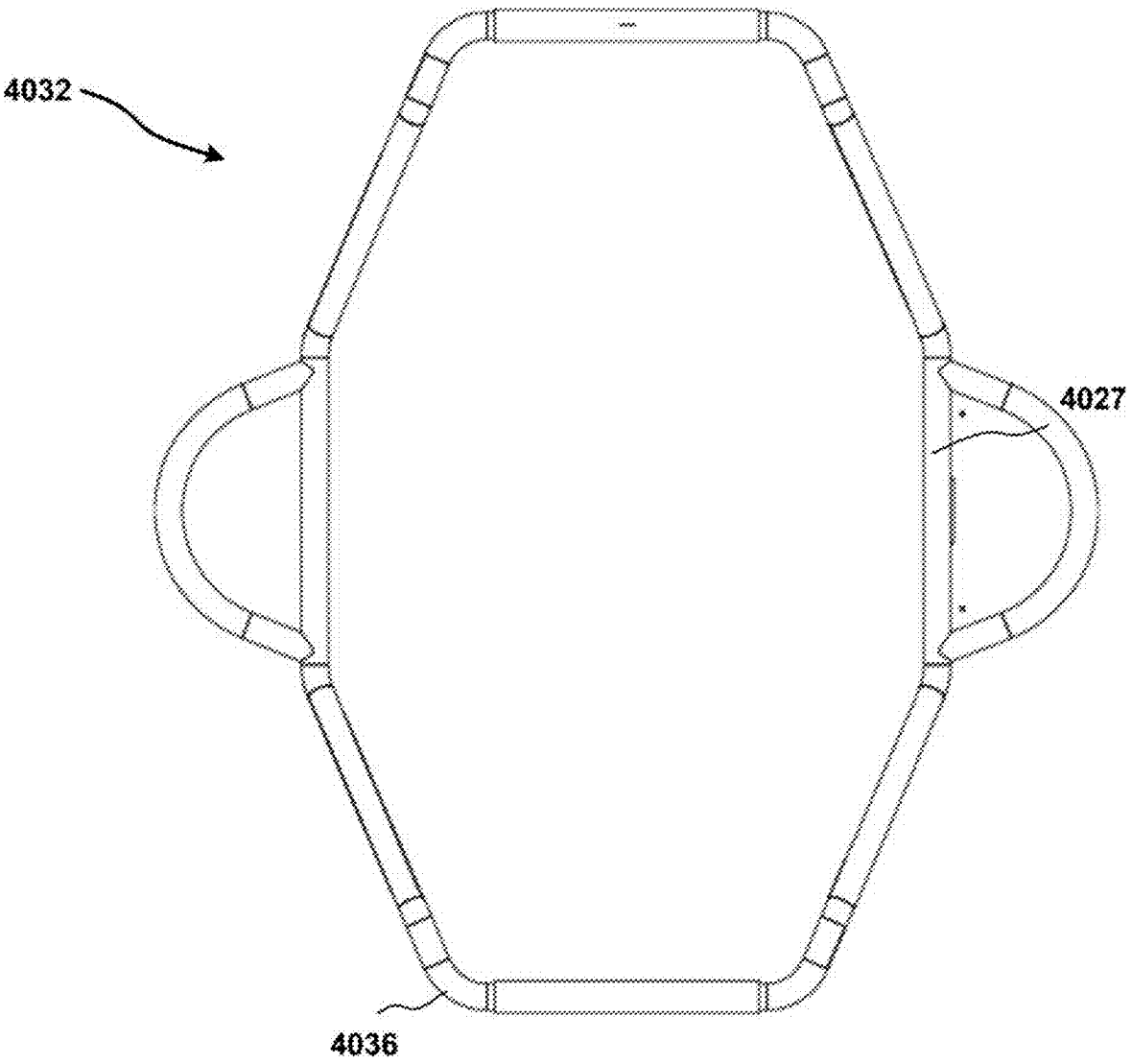
FIG. 46 is a top view of the seal frame of FIG. 43 shown without the shaping members.
Figure 47:
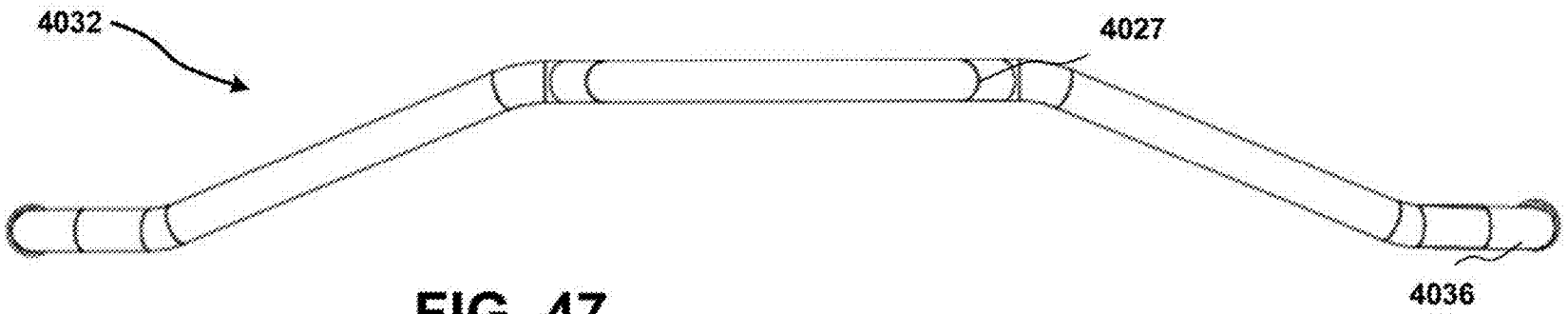
FIG. 47 is a front view of the seal frame of FIG. 43 shown without the shaping members.
Figure 48:
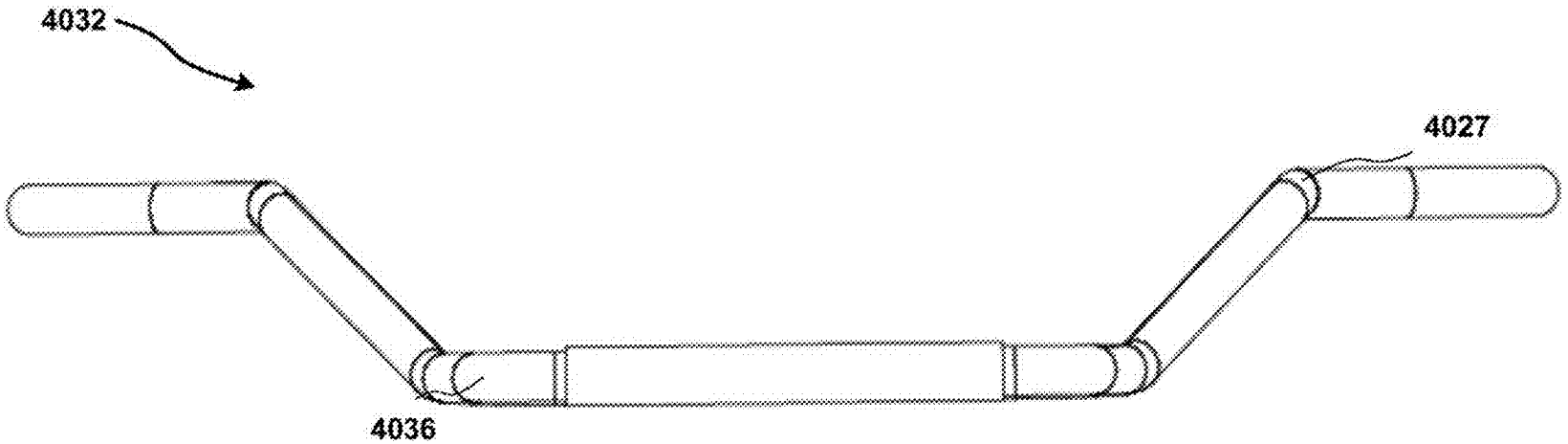
FIG. 48 is a side view of the seal frame of FIG. 43 shown without the shaping members.

Referring now to FIGS. 26A and 26B, another seal frame arrangement 3632 is generally shown, which includes the same aspects and features as seal frames 2832 and 3432 discussed above, except as discussed hereafter. Accordingly, like numbers refer to like features. Seal frame 3632 depicts an alternative seal frame configured as a variation of seal frame 3432, which includes the use of lateral shaping member 3426 attached to the seal frame and inline with the seal frame structure rather than disposed below the seal frame during interference contact in the inflated condition, and further explores potential enhanced movement freedoms in the fore/aft direction.

Referring now to FIGS. 27A to 27E, a further seal frame arrangement 3832 is generally shown, which includes the same aspects and features as seal frame 3432 discussed above, except as discussed hereafter. Accordingly, like numbers refer to like features. Seal frame 3832 generally retains beneficial features of seal frame 3432 with a few modifications. As with seal frame 3432, seal frame 3832 includes a vertical offset height between a middle region 3827 and restraint connectors 3836 at opposite lateral edge regions of the wings 3833, as well as extended width therebetween. Further, seal frame 3832 is configured for use with lateral shaping members 3826 internally attached to the inflatable enclosure. Seal frame 3832 primarily differs from seal frame 3432 in that pairs of arms forming the wings 3833 and extending from the middle region 3827 to the restraint connectors 3836 are vertically angled downward and are angled inward toward opposing sets of arms extending from the middle region to the restraint connectors. As such, seal frame 3832 provides a more gentle or gradual sloping arrangement compared with user seal 3432, which reduce potential snags or wear for engaging contact with the enclosure while maintaining benefits provided by user seal 3432.

Figure 49:
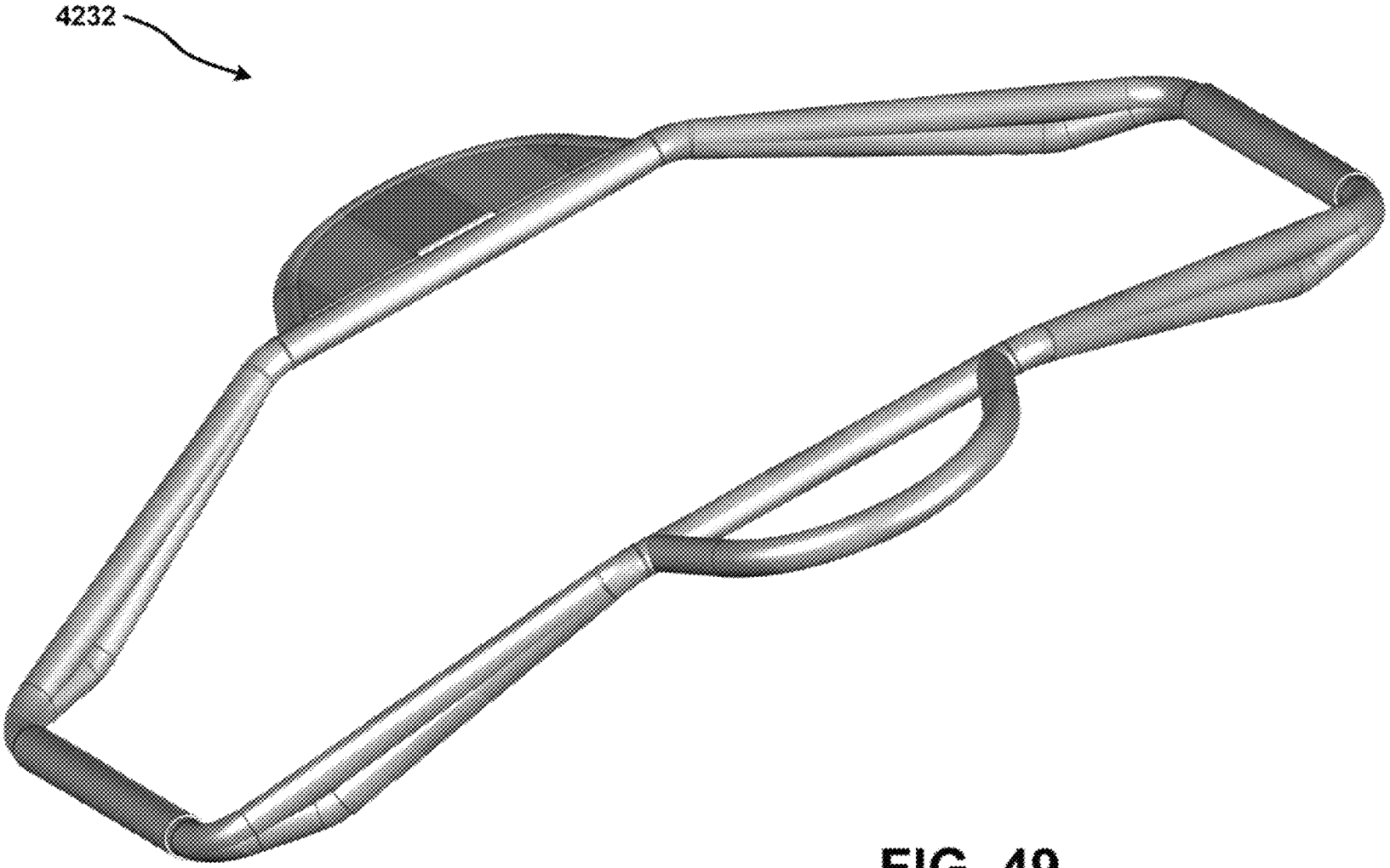
FIG. 49 is a schematic perspective view of the example loop-shaped, arch-type seal frame of FIG. 27B overlaid with the example loop-shaped, arch-type seal frame of FIG. 43 showing differences therebetween.

Referring now to FIGS. 42 to 49, a further seal frame arrangement 4032 is generally shown, which includes the same aspects and features as seal frames 3432 and 3832 discussed above, except as discussed hereafter. Accordingly, like numbers refer to like features. Seal frame 4032 generally retains beneficial features of seal frame 3432 and modifications of seal frame 3832 with an additional primary modification. The wings 4033 of seal frame 4032 includes bends at their lateral end regions in an opposite direction from the downward vertical angles of the wings, which generally orients the lateral end regions of each wing 4033 within a common horizontal plane at the restraint connectors 4036. As such, seal frame 4032 more easily be placed flat when at the lowest position prior to being lifted by each of the carriages, and further can more easily be handled by a user in the event of manual disconnection from the carriages in the event of power loss or other reasons for removal and handling of the seal frame. FIG. 49 shows a combined seal frame 4232 formed as an overlay of seal frame 3842 with seal frame 4032, which shows the modified wing shape of seal frame 4032 to form the horizontal end regions without other significant modification.

Figure 50:
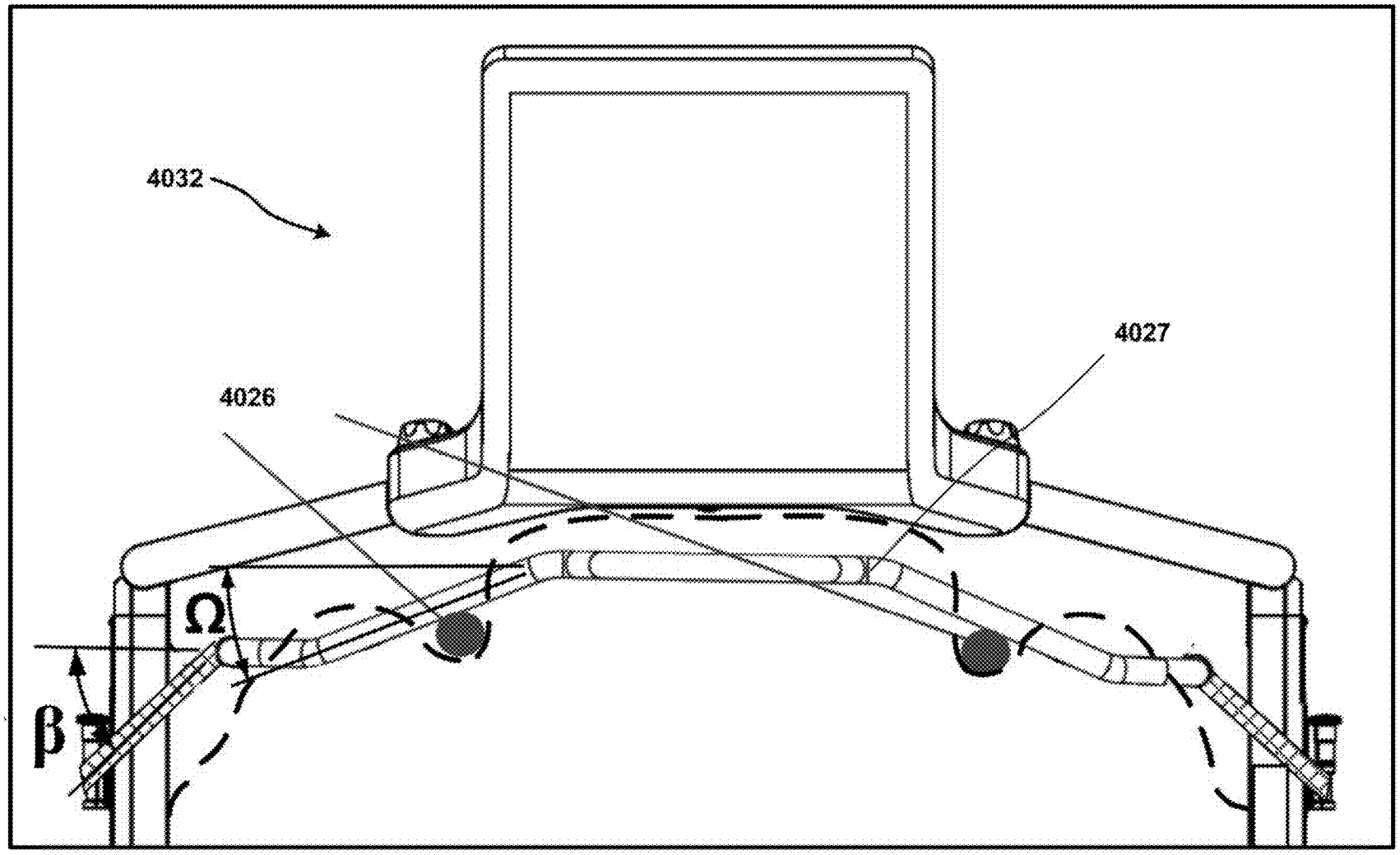
FIG. 50 is a schematic front view of a portion of the seal frame structure of FIG. 42 installed on a DAP structure shown with the pair of shaping members attached to an outer side of the inflatable enclosure according to aspects and features described herein, which is depicted in a raised, inflated condition with the seal frame in a floating arrangement.
Figure 51:
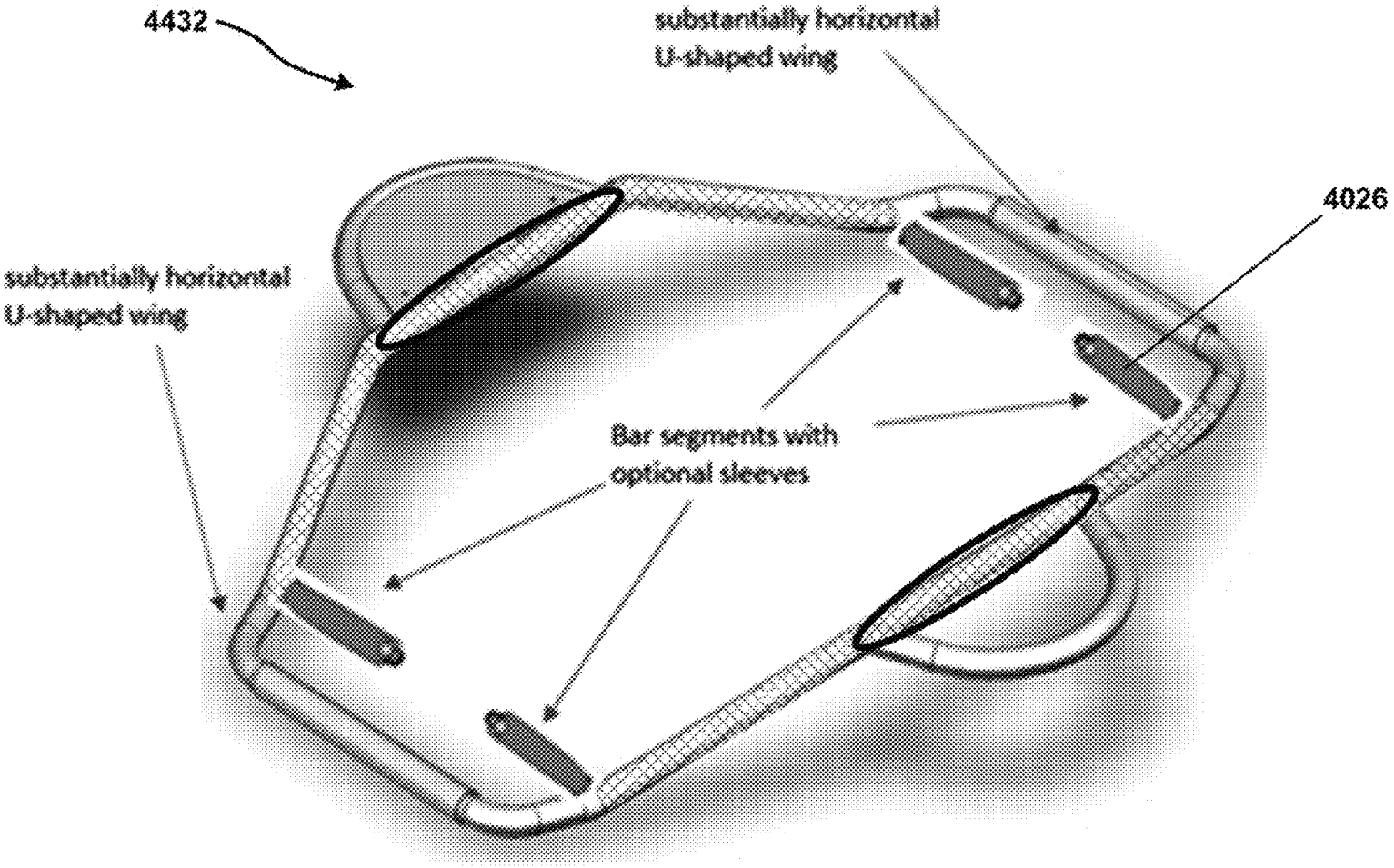
FIG. 51 is a schematic perspective view of yet another loop-shaped, arch-type seal frame of a seal frame structure having shaping members integrated into the seal frame according to aspects and features described herein.

Referring now to FIGS. 50 and 51, alternative variations are schematically shown for seal frame 4032 discussed above. FIG. 50 shows a potential combination of seal frame 4032 with lateral shaping members 4026 attached externally to a top portion of the inflatable enclosure, which is an optional implementation arrangement for user seal 4032. FIG. 51 depicts user seal 4432 as a modified version of user seal 4032 having integrated, attached internal lateral shaping members 4026. Both optional arrangements illustrate that various aspects, features and options discussed and described herein pertaining to seal frame structures, seal frame structures and arrangements, and DAP system configuration, options, features and constructions can be modified and combined in a many different ways that fall within the scope of novel and inventive subject matter presented herein and considered part of the invention or scope of inventions.

The subject matter described above is provided by way of illustration only and should not be construed as limiting. Various modifications and changes can be made to the subject matter described herein without following the example embodiments or arrangements and applications illustrated and described, and without departing from the true spirit and scope of the arrangements or embodiments of the concepts and technologies disclosed herein.

Although various embodiments or arrangements have been described as having particular features and/or combinations of components, other arrangements or embodiments are possible having a combination of any features and/or components from any of arrangements or embodiments as discussed above. Aspects have been described in the general context of exercise devices, and more specifically supplemental lifting, unweighting or differential air pressures mechanisms, devices, systems, and methods for exercise devices, but inventive aspects are not necessarily limited to use with exercise devices.

What is claimed is:

1. A floating seal frame structure usable with a differential air pressure (DAP) exercise system and enabling seal frame height adjustment during use thereof, the DAP exercise system comprising an inflatable enclosure having a base secured to a support platform and an opposite top portion defining a user port, the user port configured for a portion of a user's body and a user seal worn by the user to extend therethrough, the user seal is configured to securely attach to the inflatable enclosure proximate a user seal interface when the inflatable enclosure is in an inflated condition and, when installed creates a substantially airtight seal with the inflatable enclosure, wherein during use, air pressure within the inflatable enclosure exerts unweighting force on the user, the floating seal frame structure comprising:

a seal frame configured for attachment to the top portion about the user port, the seal frame defining a first and a second restraint connector at opposite sides thereof;

a plurality of vertical lifts comprising a first lift and a second lift each configured for securely connecting with the DAP exercise system at opposite sides thereof and at a corresponding longitudinal position along the DAP exercise system proximate the user port, each of the first and second lifts comprising one of a vertically lockable or one of a non-backdrivable powered lift configured to maintain a usage height setting of a corresponding vertically drivable carriage connector attached thereto, each lift configured for driving movement of the corresponding vertically drivable carriage connector to adjust a height of the carriage connector for an exercise session; and at least two tensile restraints comprising a first tensile restraint corresponding with the first lift and a second tensile restraint corresponding with the second lift, each tensile restraint having a first end attached to a corresponding one of the first and the second restraint connector, a second end attached to a corresponding one of the first lift and the second lift, and a restraint length between the first end and the second end, a distance between the first and the second end of each of the first tensile restraint and the second tensile restraint in the inflated condition defining a corresponding one of a first restraint length limit and a second restraint length limit;

wherein:

when installed on the DAP exercise system for the exercise session, the seal frame is retained in a floating arrangement urged upward by the inflatable enclosure when inflated and restrained downward at a seal frame height established by the first and second tensile restraints at the first and the second restraint length limits;

at least one of the first restraint connector, the first carriage connector, the second restraint connector, and the second carriage connector comprises at least one user-releasable coupling operatively connecting the seal frame with one of the first and the second lift;

the at least one user-releasable coupling is configured to securely connect the at least one first and second lift and the user seal during use and enable rapid user-release of a connection secured by the coupling between the seal frame and the at least one first and second lift in the event of power loss; and the at least one user-releasable coupling comprises a withdrawable lock member extending through a lock channel in a secure connection arrangement and configured for disconnecting the secure connection when withdrawn from the lock channel.

2. The seal frame structure of claim 1, wherein:

a user seal boundary region is defined by regions of the enclosure top portion framed by the seal frame in the floating arrangement and extending inward from the seal frame to the user seal interface;

the seal frame height determines a boundary region height and an interface height;

the plurality of lifts drivingly adjusts the corresponding carriage heights for setting the seal frame height in the floating arrangement via the first and second tensile restraint connectors and thereby heights of the user seal boundary region and the interface height;

from a top view, the seal frame defines a two-dimensional hoop shape about a top view, two-dimensional shape of the user port;

from a front, cross-sectional view corresponding with a front, cross-sectional view of the DAP exercise system, the seal frame defines two-dimensional contoured arch shape having a middle region centrally arranged about a middle region of the user seal interface, the middle region elevated an offset height from the opposite first and second restraint connectors; and the height of the seal frame middle region determining a height of the boundary region and the user seal interface.

3. The seal frame structure of claim 2, wherein, during use, the offset height is configured such that a height of an upper portion of the user seal boundary region is higher than a height of the first and second restraint connectors and heights of each of the first and second carriage.

4. The seal frame structure of claim 3, wherein:

a seal frame transverse width between the first and second restraint connectors is configured such that each of the first and second restraint connectors extends laterally away from the seal frame middle region and beyond lateral extents of the enclosure top portion when the seal frame height is disposed at a maximum height; and each of the first and second restraint connectors is disposed adjacent to the corresponding carriage connector.

5. The seal frame structure of claim 2, wherein the seal frame further comprises:

a first pair of side arms laterally extending away from the seal frame middle region to a first side region of the user seal in a horizontally converging, vertically downward orientation;

a first wing arm connecting the first pair of side arms to each other at the first side region;

a second pair of side arms laterally extending away from the seal frame middle region to the second side region of the user seal in a horizontally converging, vertically downward orientation;

a second wing arm connecting the second pair of side arms to each other at the second side region; and a pair of middle members connecting the left first pair of side arms to the right second pair of side arms at opposite fore-aft regions of the seal frame middle region.

6. The seal frame structure of claim 5, wherein:

the first pair of side arms each define an intermediate bend in a vertical angular direction opposite a downward vertical angle of the first pair of side arms to form substantially horizontal distal end portions; and the second pair of side arms each define an intermediate bend in a vertical angular direction opposite a downward vertical angle to the second pair of side arms to form substantially horizontal distal end portions.

7. The seal frame structure of claim 5, further comprising:

a first lateral shaping member and a second lateral shaping member each oriented substantially parallel with the DAP exercise system longitudinal direction and, during use, each configured to engage and bridge across the corresponding first and second pair of side arms and interfere with a region of the enclosure top portion proximate a longitudinal gap between the corresponding first or second pair of side arms; and each first and second lateral shaping member extending an interference length greater than the corresponding longitudinal gap at an interference location for the corresponding first and second pair of side arms.

8. The seal frame structure of claim 7, wherein each first and second lateral shaping member is configured to be attached to inflatable enclosure top portion proximate the interference location without being affixed to the seal frame.

9. The seal frame structure of claim 8, wherein:

the first and second lateral shaping members are located within the inflatable enclosure and affixed to an interior side of the top portion via a longitudinal stitch line along at least one side of each lateral shaping member;

each longitudinal stitch line defines a fold line along a proximate region of the enclosure top portion at a corresponding side region of the corresponding first and second lateral shaping member; and the fold lines enhance arm swing clearance space and transverse user freedoms of movement during use.

10. The seal frame structure of claim 7, wherein:

the seal frame defines a plurality of interference locations disposed along an extent of each first and second pair of side arms for the corresponding first and second lateral shaping member; and the interference location for each first and second lateral shaping member is selected from the corresponding plurality of interference locations for customizing at least one performance parameter comprising:

reducing potential tears or damage to the inflatable enclosure;

reducing inflatable enclosure infiltration into opposing seal frame lateral regions for at least a portion of the user seal range of heights;

enhancing arm swing clearance;

customizing the user seal boundary region proximate the seal frame lateral regions; and adjusting characteristics of the user seal boundary region for enhancing user movement freedom during ambulation.

11. The seal frame structure of claim 7, wherein:

the pair of middle members are longitudinally spaced apart from and disposed vertically below a corresponding adjacent fore and aft portion of the user seal interface by a longitudinal gap and a longitudinal drop and define fore and aft longitudinal boundary region portions having a first slope;

the interference location for each first and second lateral shaping member is horizontally spaced apart from and disposed vertically below a corresponding adjacent first and second side region of the user seal interface by a lateral gap and a lateral drop and define a pair of lateral boundary region portions having a second slope;

the lateral gap substantially matches the longitudinal gap, the lateral drop is greater than the longitudinal drop; and the pair of lateral boundary region portions and the fore and aft boundary region portions cooperate to shape the user seal boundary region for enhancing performance features comprising user arm swing clearance, user exercise mobility, and transverse user freedoms of movement during ambulation.

12. The seal frame structure of claim 2, wherein the two-dimensional hoop shape and the two-dimensional contoured arch shape correspond with a transverse curvature and a contoured shape of the enclosure top portion.

13. The seal frame structure of claim 2, wherein:

at least one of the offset heights for the two-dimensional contoured arch shape and a transverse width of the two-dimensional hoop shape between the first and second restraint connectors is customized according to a desired feature for use of the seal frame structure with the DAP exercise system; and the feature comprises one of the following:

a height of the pair of lifts;

a height of a structure connected to the pair of lifts;

a height of a pair of handlebars supported by the pair of lifts;

a carriage height;

a range for the carriage height;

a range for the seal frame height;

a range for the user seal interface;

user freedom of movement in or more directions;

user arm swing;

a damage risk for the inflatable enclosure comprising wear risk, pinch risk, and bind risk during use including during a plurality of height adjustments;

height adjustment controls;

height adjustment performance;

system or component stresses;

seal frame integrity;

user safety including emergency release of the seal for user exit;

user ease of access comprising entry into and withdrawal from the seal frame, the user seal and the user port; and manipulation, handling or control of the seal frame before, after or during use.

14. The seal frame structure of claim 1, wherein:

the seal frame first restraint connector comprises a forward first restraint connector at a forward location of a first side region of the seal frame and a rearward first restraint connector at a rearward location of the first side region of the seal frame;

the seal frame second restraint connector comprises a forward second restraint connector at a forward location of a second side region of the seal frame and a rearward second restraint connector at a rearward location of the second side region of the seal frame;

the first tensile restraint comprises a first pair of tensile restraints each having a first end configured for securely attaching to the first carriage connector and a second end for securely attaching to a corresponding one of the forward first restraint connector and the rearward first restraint connector; and the second tensile restraint comprises a second pair of tensile restraints each having a first end configured for securely attaching to the second carriage connector and a second end for securely attaching to a corresponding one of the forward second restraint connector and the rearward second restraint connector.

15. A floating seal frame structure usable with a differential air pressure (DAP) exercise system and enabling seal frame height adjustment during use thereof, the DAP exercise system comprising an inflatable enclosure having a base secured to a support platform and an opposite top portion defining a user port, the user port configured for a portion of a user's body and a user seal worn by the user to extend therethrough, the user seal configured to securely attach to the enclosure at a user seal interface and, when installed, create an airtight seal with the enclosure when in an inflated condition, wherein during use, air pressure within the inflatable enclosure exerts unweighting force on the user, the floating seal frame structure comprising:

a seal frame configured for attachment to the top portion about the user port, the seal frame defining a first and a second lift connector at opposite sides thereof;

a plurality of motorized vertical lifts including a first lift and a second lift each configured for securely connecting with the DAP exercise system at opposite sides thereof and at corresponding longitudinal positions along the DAP exercise system proximate the user port;

a first carriage connected to the first lift and vertically drivable by the first lift, the first carriage having a first carriage connector configured for securely coupling with the seal frame;

a second carriage connected to the second lift and vertically drivable by the second lift, the second carriage having a second carriage connector configured for securely coupling with the seal frame;

a user-releasable coupling configured to maintain a secure connection between the seal frame and at least one of the first carriage connector and the second carriage connector while disposed in a reinforcement arrangement corresponding with DAP exercise system use, the user-releasable coupling configured to disconnect the secure connection upon user release from the reinforcement arrangement;

a coupling passage defined through at least one of the first lift connector, the first carriage connector, the second lift connector and the second carriage connector, the coupling passage configured for receiving and retaining a portion of the coupling when in the reinforcement arrangement; and a sensor configured to detect presence of the portion of the coupling extended through the coupling passage in the reinforcement arrangement and withdrawal of the portion of the coupling at least partially from the coupling passage;

wherein, when installed on the DAP exercise system:

each vertical lift comprises one of a vertically lockable lift or one of a non-backdrivable motorized lift configured to maintain a height setting for the respective first and second carriage connector and for the seal frame securely connected thereto until each lift is vertically unlocked or driven under electrical power;

user release of the coupling from the reinforcement arrangement causes disconnection of the secure connection between the user seal and the at least one of the first and second carriage connectors;

user release of the coupling from the reinforcement arrangement comprises removal of the portion of the coupling at least partially from the passage; and the sensor is configured to send an immediate alert notification to a control device of the DAP exercise system for performing urgent actions comprising: interrupting one or more operations of the DAP exercise system or the exercise device, disconnecting power to the DAP exercise system or the exercise device, and activating an alert notification including a visible or audible alert.

16. The seal frame structure of claim 15, wherein the user-releasable coupling comprises at least one engagement member comprising: a pin; a bolt; a shackle; a lock ring; a detente pin, a spring-loaded clip; a hook and loop interface; a coaxial interface between support members; a buckle; a post; a pivotable or rotatable lock member; an over-center lock linkage; a rigid interface structure; mated pairs of structural members; multi-member assemblies; combinations of rigid interface members; and combinations of the at least one engagement member with one or more engagement members or fixed supports.

17. The seal frame structure of claim 15, further comprising:

a first tensile restraint connecting a first carriage connector with a first seal frame connector;

a second tensile restraint connecting a second carriage connector with a second seal frame connector;

a first and a second vertical drive device each operatively connected to the corresponding first and second lift; and at least one controller operatively connected to the first and second lift controlling vertical drive operations for the first and the second lift within a range of relative heights between the carriages of each lift without racking between the first and second vertical drive devices or racking between a corresponding lead screw assembly of the vertical drive devices, the range of relative heights for lift operations without the racking comprising a vertical offset distance between the carriages of less than 14 inches.

18. The seal frame structure of claim 15, wherein in the event of power loss for the DAP exercise system, user release of the coupling enables manual modification of the seal frame height setting for facilitating user withdrawal from seal frame and DAP exercise system.

19. A floating seal frame structure usable with a differential air pressure (DAP) exercise system and enabling seal frame height adjustment during use thereof, the DAP exercise system comprising an inflatable enclosure having a base secured to a support platform and an opposite top portion defining a user port, the user port configured for a portion of a user's body and a user seal worn by the user to extend therethrough, the user seal is configured to securely attach to the inflatable enclosure proximate a user seal interface when the inflatable enclosure is in an inflated condition and, when installed creates a substantially airtight seal with the inflatable enclosure, wherein during use, air pressure within the inflatable enclosure exerts unweighting force on the user, the floating seal frame structure comprising:

a seal frame configured for attachment to the top portion about the user port, the seal frame defining a first and a second restraint connector at opposite sides thereof;

a plurality of vertical lifts comprising a first lift and a second lift each configured for securely connecting with the DAP exercise system at opposite sides thereof and at a corresponding longitudinal position along the DAP exercise system proximate the user port, each of the first and second lifts comprising one of a vertically lockable or one of a non-backdrivable powered lift configured to maintain a usage height setting of a corresponding vertically drivable carriage connector attached thereto, each lift configured for driving movement of the corresponding vertically drivable carriage connector to adjust a height of the carriage connector for an exercise session; and at least two tensile restraints comprising a first restraint corresponding with the first lift and a second restraint corresponding with the second lift, each tensile restraint having a first end attached to a corresponding one of the first and the second restraint connector, a second end attached to a corresponding one of the first lift and the second lift, and a restraint length between the first end and the second end, a distance between the first and the second end of each of the tensile restraint and the second tensile restraint in the inflated condition defining a corresponding one of a first restraint length limit and a second restraint length limit;

wherein:

when installed on the DAP exercise system for the exercise session, the seal frame is retained in a floating arrangement urged upward by the inflatable enclosure when inflated and restrained downward at a seal frame height established by the first and second tensile restraints at the first and the second restraint length limits;

a user seal boundary region is defined by regions of the enclosure top portion framed by the seal frame in the floating arrangement and extending inward from the seal frame to the user seal interface;

the seal frame height determines a boundary region height and an interface height;

the plurality of lifts drivingly adjusts the corresponding carriage heights for setting the seal frame height in the floating arrangement via the first and second tensile restraint connections and thereby heights of the user seal boundary region and the interface height;

from a top view, the seal frame defines a two-dimensional hoop shape about a top view, two-dimensional shape of the user port;

from a front, cross-sectional view corresponding with a front, cross-sectional view of the DAP exercise system, the seal frame defines a two-dimensional contoured arch shape having a middle region centrally arranged about a middle region of the user seal interface, the middle region elevated an offset height from the opposite first and second restraint connectors; and the height of the seal frame middle region determining a height of the boundary region and the user seal interface.

20. A floating seal frame structure usable with a differential air pressure (DAP) exercise system and enabling seal frame height adjustment during use thereof, the DAP exercise system comprising an inflatable enclosure having a base secured to a support platform and an opposite top portion defining a user port, the user port configured for a portion of a user's body and a user seal worn by the user to extend therethrough, the user seal configured to securely attach to the inflatable enclosure at a user seal interface and, when installed, create an airtight seal with the inflatable enclosure when in an inflated condition, wherein during use, air pressure within the inflatable enclosure exerts unweighting force on the user, the floating seal frame structure comprising:

a seal frame configured for attachment to the top portion about the user port, the seal frame defining a first and a second lift connector at opposite sides thereof;

a plurality of motorized vertical lifts including a first lift and a second lift each configured for securely connecting with the DAP exercise system at opposite sides thereof and at corresponding longitudinal positions along the DAP exercise system proximate the user port;

a first carriage connected to the first lift and vertically drivable by the first lift, the first carriage having a first carriage connector configured for securely coupling with the seal frame;

a second carriage connected to the second lift and vertically drivable by the second lift, the second carriage having a second carriage connector configured for securely coupling with the seal frame;

a user-releasable coupling configured to maintain a secure connection between the seal frame and at least one of the first carriage connector and the second carriage connector while disposed in a reinforcement arrangement corresponding with DAP exercise system use, the user-releasable coupling configured to disconnect the secure connection upon user release from the reinforcement arrangement;

a first tensile restraint connecting a first carriage connector with a first seal frame connector;

a second tensile restraint connecting a second carriage connector with a second seal frame connector;

a first and a second vertical drive device each operatively connected to the corresponding first and second lift; and at least one controller operatively connected to the first and second lift controlling vertical drive operations for the first and the second lift within a range of relative heights between the carriages of each lift without racking between the first and second vertical drive devices or racking between a corresponding lead screw assembly of the vertical drive devices, the range of relative heights for lift operations without the racking comprising a vertical offset distance between the carriages of less than 14 inches;

wherein, when installed on the DAP exercise system:

each vertical lift comprises one of a vertically lockable lift or one of a non-backdrivable motorized lift configured to maintain a height setting for the respective first and second carriage connector and for the seal frame securely connected thereto until each lift is vertically unlocked or driven under electrical power; and user release of the coupling from the reinforcement arrangement causes disconnection of the secure connection between the user seal and the at least one of the first and second carriage connectors.

* * * * *